US011180342B2

(12) United States Patent
Kasahara

(10) Patent No.: US 11,180,342 B2
(45) **Date of Patent: *Nov. 23, 2021**

(54) REEL

(71) Applicant: MAX CO., LTD., Tokyo (JP)

(72) Inventor: Akira Kasahara, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/859,262

(22) Filed: Apr. 27, 2020

(65) Prior Publication Data

US 2020/0255255 A1 Aug. 13, 2020

Related U.S. Application Data

(63) Continuation of application No. 15/577,178, filed as application No. PCT/JP2016/071405 on Jul. 21, 2016, now Pat. No. 10,717,626.

(30) Foreign Application Priority Data

Jul. 22, 2015 (JP) ..... 2015-145259
Jul. 8, 2016 (JP) ..... 2016-135746

(51) Int. Cl.
*B65H 75/18* (2006.01)
*B65H 75/14* (2006.01)

(52) U.S. Cl.
CPC ..... *B65H 75/182* (2013.01); *B65H 75/14* (2013.01); *B65H 2701/36* (2013.01); *B65H 2701/534* (2013.01)

(58) Field of Classification Search
CPC .. B65H 75/182; B65H 75/14; B65H 2701/36; B65H 2701/534
See application file for complete search history.

(56) References Cited

U.S. PATENT DOCUMENTS 3,039,226 A * 6/1962 Bagdonas ..... A01K 97/06 43/57.2
3,501,110 A 3/1970 Green
(Continued)

FOREIGN PATENT DOCUMENTS

CL 201703252 A1 12/2017
CL 201703253 A1 12/2017
(Continued)

OTHER PUBLICATIONS

Office Action in VN 1-2018-00275 dated Jan. 29, 2021, (3 pages, including English translation).
(Continued)

*Primary Examiner* — Michael E Gallion
(74) *Attorney, Agent, or Firm* — Rothwell, Figg, Ernst & Manbeck, P.C.

(57) ABSTRACT

The reel which can mount substantial amounts of information for identifying the type of a wire wound thereon without increasing the hub size. The reel includes a hub that includes a winding part, a pair of flanges that face each other with the winding part interposed therebetween, first information display portions that are disposed on a first circumference about a shaft center of the hub of at least a surface of the flange, and a second information display portion that is disposed on a second circumference having a smaller diameter than that of the first circumference. The second information display portion is disposed in a region surrounded, in a circumferential direction, by both inner ends of the adjacent first information display portions and the shaft center of the hub.

14 Claims, 33 Drawing Sheets

(56) References Cited

U.S. PATENT DOCUMENTS

| | | | | |
|---|---|---|---|---|
| 3,940,086 | A | 2/1976 | Stoquelet | |
| 4,512,361 | A | 4/1985 | Tisbo et al. | |
| 5,622,333 | A * | 4/1997 | Jacques | B65H 75/241 242/118.5 |
| 5,671,856 | A * | 9/1997 | Lisch | A01K 97/06 206/519 |
| 7,828,242 | B2 * | 11/2010 | Snitselaar | B65H 75/22 242/608.2 |
| 10,717,626 | B2 * | 7/2020 | Kasahara | B65H 75/182 |
| 2006/0196989 | A1 * | 9/2006 | Bartley | B65D 85/04 242/601 |
| 2007/0257146 | A1 | 11/2007 | Fleming | |
| 2008/0272225 | A1 * | 11/2008 | Hein | B65H 75/182 242/602 |
| 2009/0224091 | A1 * | 9/2009 | Ishikawa | G11B 23/037 242/348 |
| 2009/0283167 | A1 * | 11/2009 | Nakagawa | E04G 21/123 140/111 |
| 2010/0163133 | A1 | 7/2010 | Barnes et al. | |
| 2011/0290931 | A1 * | 12/2011 | Pauwels | B65H 75/14 242/611 |
| 2012/0126047 | A1 | 5/2012 | Skowronski et al. | |
| 2014/0091171 | A1 | 4/2014 | Nakagawa et al. | |
| 2014/0312159 | A1 * | 10/2014 | Troitzsch | B65H 54/543 242/608.2 |
| 2015/0197409 | A1 * | 7/2015 | Caldieri | B65H 75/14 242/613 |
| 2015/0274480 | A1 * | 10/2015 | Troitzsch | B65H 54/103 242/176 |
| 2016/0355371 | A1 * | 12/2016 | Baranov | B65H 75/14 |
| 2016/0376042 | A1 | 12/2016 | Barnes et al. | |
| 2017/0130472 | A1 | 5/2017 | Nakagawa et al. | |
| 2018/0022570 | A1 | 1/2018 | Nilsson | |
| 2018/0148943 | A1 | 5/2018 | Itagaki et al. | |
| 2018/0155940 | A1 | 6/2018 | Nagaoka et al. | |
| 2018/0161848 | A1 | 6/2018 | Itagaki et al. | |
| 2018/0170708 | A1 * | 6/2018 | Kasahara | B65H 75/14 |
| 2019/0218056 | A1 * | 7/2019 | Chen | B65H 75/146 |
| 2020/0255255 | A1 | 8/2020 | Kasahara | |
| 2020/0317465 | A1 | 10/2020 | Kasahara | |

FOREIGN PATENT DOCUMENTS

| | | | |
|---|---|---|---|
| CL | 201703254 | A1 | 12/2017 |
| CN | 1950578 | A | 4/2007 |
| CN | 101161578 | A | 4/2008 |
| CN | 201074145 | Y | 6/2008 |
| CN | 102530656 | A | 7/2012 |
| CN | 104528465 | A | 4/2015 |
| CN | 107709203 | B | 11/2019 |
| DE | 20 2009 011 572 | U1 | 2/2010 |
| EP | 1 900 671 | A1 | 3/2008 |
| GB | 229324 | A | 4/1925 |
| JP | S63-107372 | U | 7/1988 |
| JP | 2000-185876 | A | 7/2000 |
| JP | 2001-180058 | A | 7/2001 |
| JP | 2004-59240 | A | 2/2004 |
| JP | 2008-074509 | A | 4/2008 |
| JP | 2010-1727 | A | 1/2010 |
| JP | 2010-521376 | A | 6/2010 |
| JP | 2010-184781 | A | 8/2010 |
| JP | 2013-177805 | A | 9/2013 |
| RU | 2413671 | C2 | 3/2011 |
| TW | I383943 | B | 2/2013 |
| WO | 2008050143 | A1 | 5/2008 |

OTHER PUBLICATIONS

Notification of First Office Action dated Oct. 9, 2018 in corresponding Chinese Patent Application No. 201680036207.1 (5 pages).
Search Report dated Oct. 12, 2018 in corresponding Russian Patent Application No. 2017144186 (partial English translation) (2 pages).
International Search Report dated Aug. 30, 2016 in PCT/JP2016/071405 (5 pages) and Written Opinion of the International Search Authority (4 pages).
Supplementary European Search Report issued in Application No. 16827825.7, dated Feb. 13, 2019.
Office Action in TW 107137726 dated Jul. 2, 2020, 8 pages.
Office Action for Australian application No. 2020202928 dated Apr. 7, 2021, 4 pages.
Office Action for Taiwanese Application No. 110106264 dated Aug. 20, 2021, 4 pages.
Office Action for Japanese Application No. 2020-135756 dated Aug. 10, 2021, 3 pages (non-English).

* cited by examiner

REEL

CROSS REFERENCE TO RELATED APPLICATION

This application is a continuation of U.S. patent application Ser. No. 15/577,178, filed on Nov. 27, 2017, which is a 35 U.S.C. 371 National Phase Entry Application from PCT/JP2016/071405, filed Jul. 21, 2016, which claims priority to Japanese Patent Application Nos. 2015-145259, filed Jul. 22, 2015 and 2016-135746, filed Jul. 8, 2016, the disclosures of which are incorporated herein in their entirety by reference and priority is claimed to each of the foregoing.

TECHNICAL FIELD

The present invention relates to a reel on which a wire is windable.

BACKGROUND

In Patent Literature 1, there is disclosed a wire reel for a reinforcing bar binding machine. The reinforcing bar binding machine is configured to include a housing chamber provided in a reinforcing bar binding machine body and a wire reel mounted in the housing chamber to wind a wire for binding a reinforcing bar, whereby the wire is fed out with a rotation of the wire reel and the wire is twisted after being wound around the reinforcing bar to bind the the reinforcing bar. The wire reel is made of plastic such as an ABS resin, polyethylene, or polypropylene, in which a cylindrical hub with the wire wound thereon and a pair of flanges provided on both sides in an axis direction of the hub are integrally formed.

As the wire used in the reinforcing bar binding machine, there are various types such as wires different in material, wires different in size such as a diagram, and wires different in shape such as a single wire, a double wire, a strand wire, a bare wire, and a covered wire. These wires are used differently according to its application. Therefore, many kinds of information (a plurality of transmission holes) are provided inside the hub of the wire reel to identify the type of the wire (or the type of the wire reel (meaning which type of a wire reel is wound with which type of a wire)). The type of the wire can be identified through the information. Specifically, the number and the position of the transmission holes are previously set according to the type of the wire. The type of the wire can be identified by confirming the number and the position of these transmission holes.

CITATION LIST

Patent Literature

[Patent Literature 1]: JP-A-2010-001727

SUMMARY

Technical Problem

As described above, in the reinforcing bar binding machine, the information (the transmission hole) for identifying the type of the wire is held in the wire reel. However, as the types of the wire is increased, the amount of information for identifying the wire is also increased. Therefore, when the information for identifying the type of the wire is provided inside the hub, the hub may be increased in size depending on the amount of information. Since the increase in size of the hub leads to a reduction in the amount of winding wire for the wire reel, the entire size of the wire reel would need to be increased in order to retain a certain amount of the winding.

The invention has been made in view of such circumstances, and provides a wire reel (hereinafter, simply referred to as "reel") on which a substantial amount of information for identifying the type of the wire can be provided without requiring an increase in size of the hub.

Solution to Problem

In order to solve the above problem, this invention includes the following configurations. That is, a reel for winding a wire, is characterized by including:

a cylindrical hub that includes a winding part where a wire is windable;

a pair of flanges that are provided on both sides in an axis direction of the hub and that include facing surfaces with the winding part interposed therebetween;

a plurality of first information display portions that are formed on a surface opposite to the facing surface of the flange and that are disposed on a first circumference about a shaft center of the hub; and a second information display portion that is formed on the surface of the flange and that is disposed on a second circumference having a smaller diameter than that of the first circumference about the shaft center of the hub, wherein the second information display portion is disposed in a region surrounded by both inner ends of adjacent first information display portions and the shaft center of the hub.

The reel is characterized in that, a plurality of the second information display portions are disposed on the second circumference, and the first information display portion is disposed in a region interposed by extensions of line segments connecting both inner ends of adjacent second information display portions and the shaft center of the hub.

The reel is characterized in that, a plurality of sets are disposed on the surface of the flange, each set including a pair of the adjacent first information display portions and the second information display portion positioned between the pair of the first information display portions when viewed from a direction orthogonal to the shaft center of the hub.

The reel is characterized in that, a plurality of sets are disposed on the surface of the flange, each set including a pair of the adjacent second information display portions and the first information display portion positioned between the pair of the second information display portions when viewed from a direction orthogonal to the shaft center of the hub.

The reel is characterized in that, the first information display portion is configured by a protrusion which extends in a substantially vertical direction with respect to the surface of the flange.

The reel is characterized in that, the second information display portion is configured by a protrusion which extends in a substantially vertical direction with respect to the surface of the flange.

The reel is characterized in that, a protrusion of the first information display portion includes a shielding body which blocks light.

The reel is characterized in that, a protrusion of the second information display portion includes a shielding body which blocks light.

The reel is characterized in that, the first information display portion includes a plurality of protrusions disposed on the first circumference, and a light-transmitting body is disposed between the protrusions to transmit light.

The reel is characterized in that, the second information display portion includes a plurality of protrusions disposed on the second circumference, and a light-transmitting body is disposed between the protrusions to transmit light.

The reel is characterized in that, the first information display portion is a wall member having a wall surface erected from the surface of the flange, and includes a hole in the wall surface.

The reel is characterized in that, the second information display portion is a wall member having a wall surface erected from the surface of the flange, and includes a hole in the wall surface.

The reel is characterized in that, the first information display portion includes a plurality of holes formed along the first circumference.

The reel is characterized in that, the second information display portion includes a plurality of holes formed along the second circumference.

The reel is characterized in that, a light-transmitting body is disposed in the hole of the first information display portion to transmit light.

The reel is characterized in that, a light-transmitting body is disposed in the hole of the second information display portion to transmit light.

The reel is characterized in that, the first information display portion is a wall member erected from the surface of the flange, and includes a recess and a protrusion at an upper edge.

The reel is characterized in that, the second information display portion is a wall member erected from the surface of the flange, and includes a recess and a protrusion at an upper edge.

The reel is characterized in that, a light-transmitting body is disposed in the recess formed at the upper edge of the first information display portion to transmit light.

The reel is characterized in that, a light-transmitting body is disposed in the recess formed at the upper edge of the second information display portion to transmit light.

The reel is charcterized in that, a wire is wound on the winding part.

According to the invention, the information display portion is provided on a surface of the flange having a wider area (larger circumference) than the inside of the hub, and thus a substantial amount of information can be provided in the reel. The information display portions are provided on different circumferences of the surface of the flange, so that much more information can be provided on the surface of the flange.

BRIEF DESCRIPTION OF DRAWINGS

FIG. 4 is a plan (top) view.

FIG. 11 is a front view.

FIG. 11 is a front view.

FIG. 11 is a front view.

FIG. 11 is a front view.

DETAILED DESCRIPTION

Hereinafter, embodiments of the invention will be described.

Figure 1:
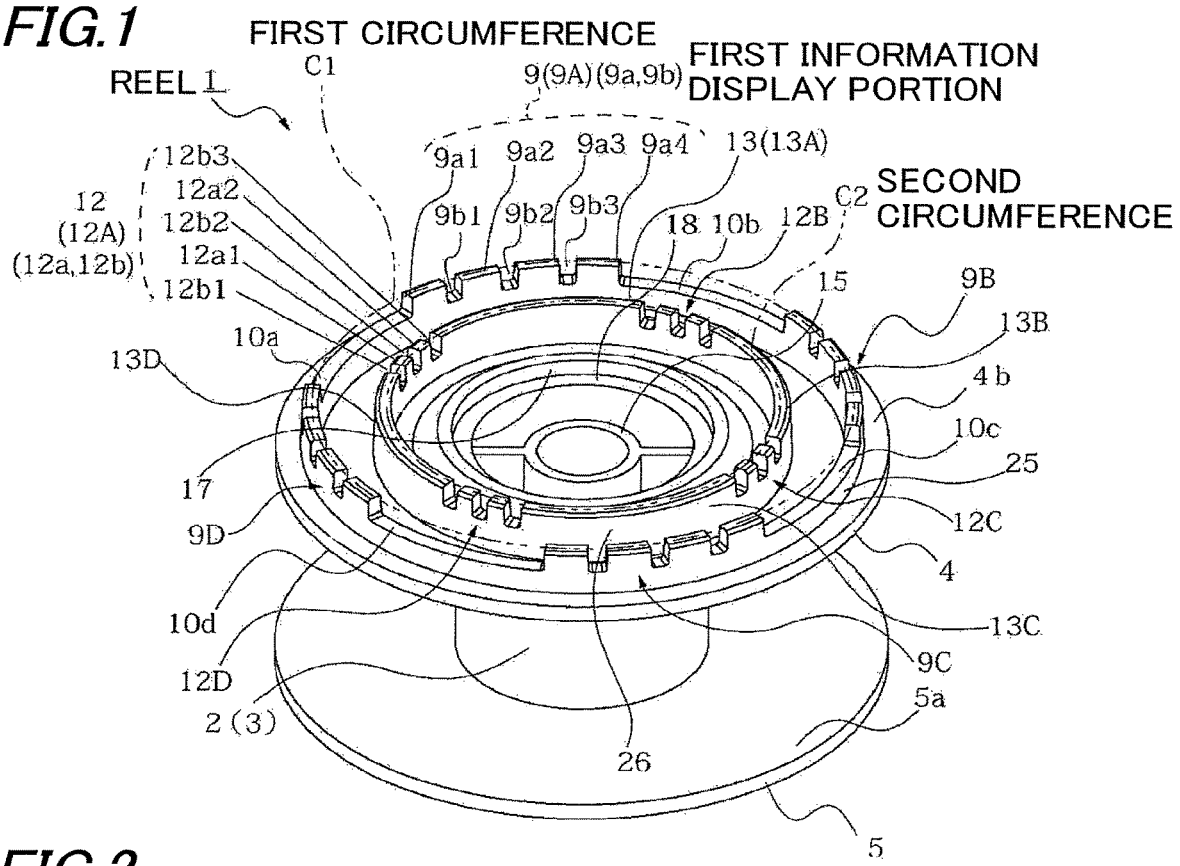
FIG. 1 is a perspective view of an external appearance of a reel when viewed from a flange on one side.
Figure 2:
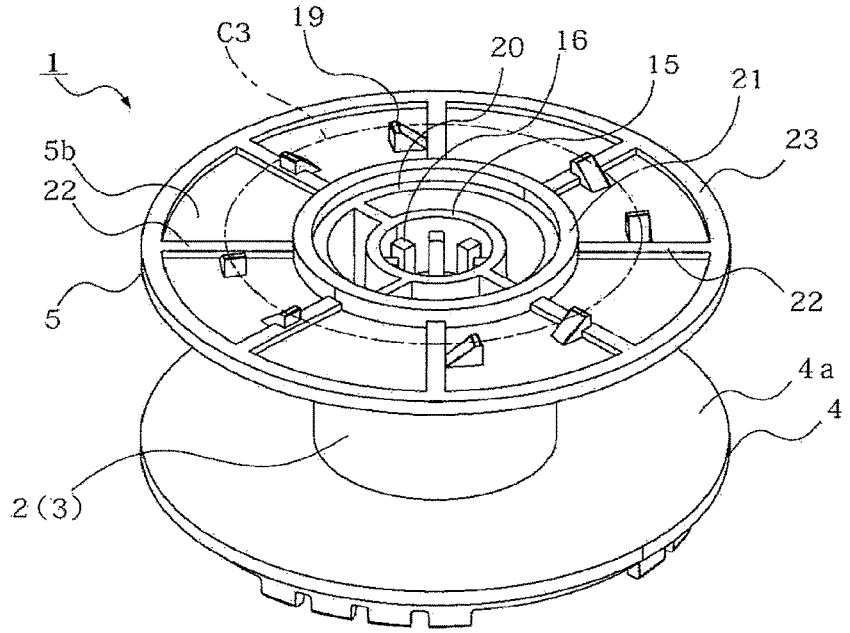
FIG. 2 is a perspective view of an external appearance of the reel when viewed from a flange on the other side.
Figure 3:
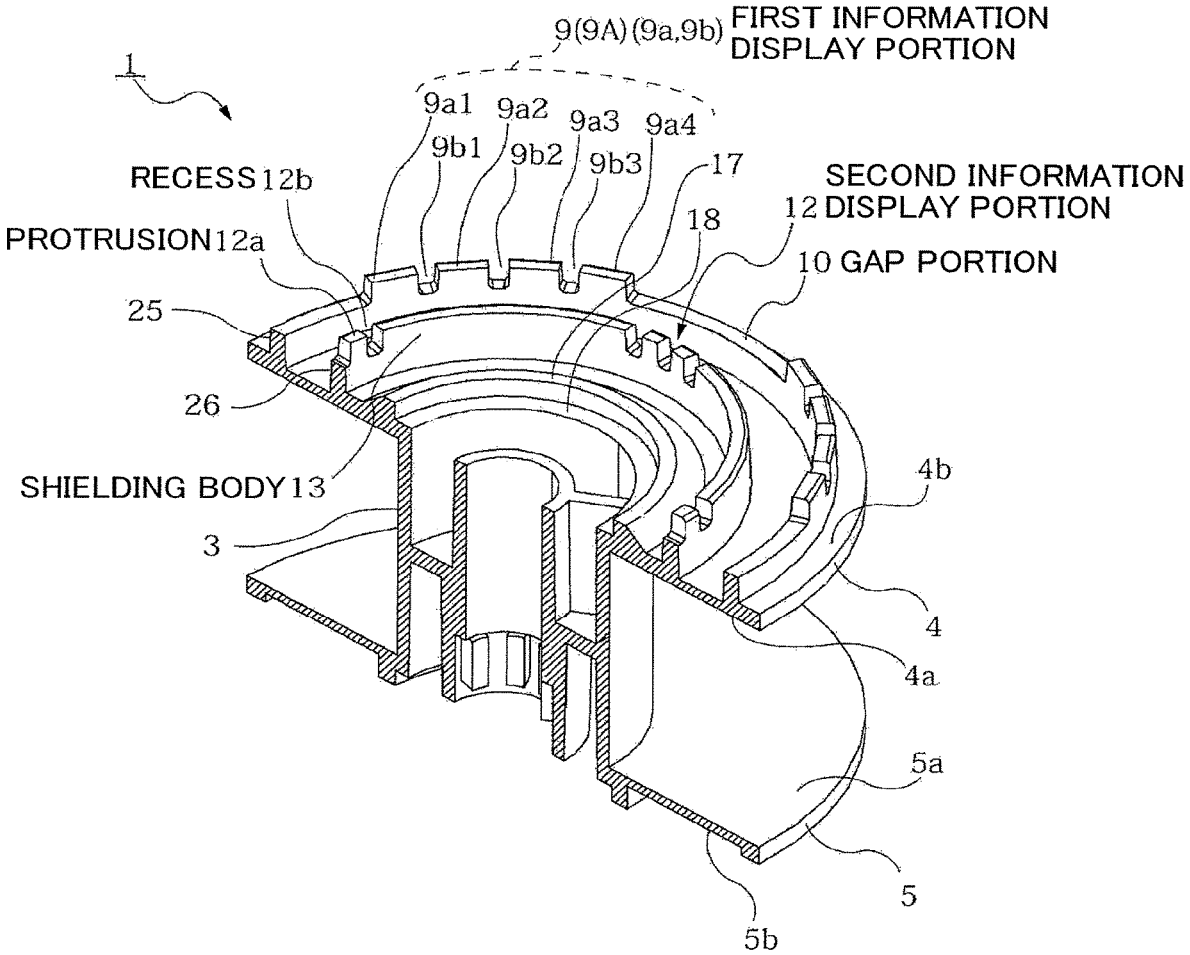
FIG. 3 is a cross-sectional perspective view of the reel.

FIG. 1 is a perspective view of an external appearance of a reel when viewed from a flange on one side. FIG. 2 is a perspective view of an external appearance of the reel when viewed from the flange on the other side. FIG. 3 is a cross-sectional perspective view of the reel. A reel 1 illustrated in each drawing is used to wind and house a wire, and is formed as a portable reel which can supply the wire to a reinforcing bar binding machine body. The reel 1 includes a cylindrical hub 3 which includes a winding part 2 on which the wire is windable, and a pair of flanges 4 and 5 which are provided on both sides of the hub 3 spaced along an axial direction of the hub 3. The flanges include facing surfaces 4*a* and 5*a* facing each other with the winding part 2 interposed therebetween.

Figure 6:
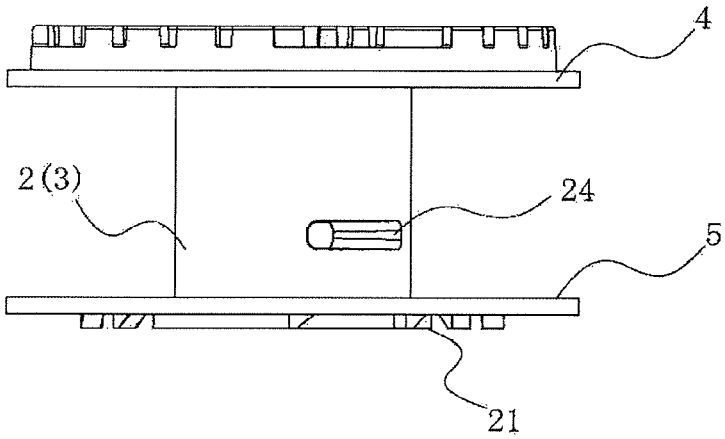
FIG. 6 is a rear view of the reel in a case where

The hub 3 is formed as a cylindrical shaft which includes the winding part 2 on the outer peripheral surface, and serves as a rotation center (shaft center) of the reel 1. In the outer peripheral surface of the winding part 2, there is provided a hole 24 which communicates to the inside of the hub 3 (see FIG. 6). The hole 24 is used to insert and fix the end of the wire when the winding starts. The outer diameter of the winding part 2 is set to an extent such that the wound wire is not locally bent and the wire is not overly strongly wound. The shape of the winding part 2 is not limited to a cylindrical shape, and may be a polygonal shape approximating a circle as long as the local bending is not generated in the wound wire.

The hub 3 has a double cylinder structure, and includes a cylindrical portion 15 formed therein concentrically to the hub 3. In a portion inside the cylindrical portion 15 near the flange 5, there is formed a plurality of teeth 16 which can be engaged with a spline shaft of a wire winding apparatus (not illustrated) provided in the reinforcing bar binding machine body. The shape of the cylindrical portion 15 is not necessarily limited to the cylindrical shape, and may be formed in other shapes such as a shape of protrusions or recesses provided at an equal or unequal interval along a locus of the cylindrical shape.

The flanges 4 and 5 are members radially extending in a disk shape from both sides of the hub 3, spaced in an axial direction along the hub 3. The flanges 4, 5 extend outwardly in the radial direction, and form a storage space of the wire together with the winding part 2. The flanges 4 and 5 are fixed to the hub 3, and rotate together with the hub 3. The hub 3 and the flanges 4 and 5 are formed as an integrated molded body by injection-molding of a resin material (for example, polypropylene). As the resin material, an ABS resin or polycarbonate may be used.

The flanges 4 and 5 have a substantially even or constant thickness in the illustrated example. However, there is no need to have a constant thickness if the wire is smoothly wound, stored, and pulled out with respect to the hub 3. The outer peripheral shapes of the flanges 4 and 5 are not necessarily circular in shape, and any shape may be employed as long as the flange is rotatable in a state of being stored in the reinforcing bar binding machine body. For example, the flange may have a polygonal shape approximating a perfect circle or a shape equipped with teeth in the outer peripheral surface. The flanges 4 and 5 include various shapes of ribs and protrusion/recesses on the surfaces opposite to the facing surfaces 4*a* and 5*a* (that is, surfaces 4*b* and 5*b* facing the outside) from a viewpoint of strength, support and identification of the type of the wire.

On the surface 4*b* of a first flange 4, which is one of the first and second flanges 4 and 5 disposed to face each other, information display portions 9 and 12 are formed to identify the type of the wire (or a reel type, meaning which type of a wire reel is wound with which type of a wire). In the description herein, it is to be understood that the meaning of "the type of the wire" can include "the type of wire" and/or "the type of the reel." The information display portions 9 and 12 include the first information display portions 9 (9A, 9B, 9C, and 9D) which are disposed on a first circumference C1 about the shaft center of the hub 3, (radially spaced from the shaft center of the hub 3) and the second information display portions 12 (12A, 12B, 12C, and 12D) which are disposed (positioned on the inner side) on a second circumference C2 having a diameter smaller than that of the first circumference C1 about the shaft center of the hub 3.

The information provided by the first and/or second information display portions can include one or more information as to the wire such as the size or gauge of the wire, the material of the wire or wire configuration (e.g., single strand, two strand twisted, etc.), and/or relating to the reel and whether the reel is usable or compatible with a particular type of tool.

In the illustrated example, the first information display portion 9 includes a plurality of protrusions 9*a* (9*a*1, 9*a*2, 9*a*3, and 9*a*4) which extend in the substantially vertical direction with respect to the surface 4*b* of the flange 4, and recesses (slits or apertures) 9*b* (9*b*1, 9*b*2, and 9*b*3) which are formed between the protrusions 9*a*. In this embodiment, the annular rib 25 made of a wall-shaped member is erected on the first circumference C1. The first information display portion 9 is formed on (the upper surface of) the annular rib or wall 25. Specifically, the first information display portion 9 is configured by four protrusions 9*a*1, 9*a*2, 9*a*3, and 9*a*4 (or first projections) which protrude from the upper surface (an upper edge) of the annular rib 25, and three recesses (or apertures) 9*b*1, 9*b*2, and 9*b*3 or light transmissive portions (first recesses) which are formed between these protrusions 9*a*1, 9*a*2, 9*a*3, and 9*a*4 (between the protrusion 9*a*1 and the protrusion 9*a*2, between the protrusion 9*a*2 and the protrusion 9*a*3, and between the protrusion 9*a*3 and the protrusion 9*a*4). The protrusion 9*a* is made of a shielding body (plate) of a substantially rectangular shape which is not transmissive (i.e., not transmissive to light or light blocking), and has a height (a height from the upper surface of the annular rib or wall 25 to the apex of the protrusion 9*a*) and a thickness of several mm. The four protrusions or projections 9*a*1, 9*a*2, 9*a*3, and 9*a*4 are formed in substantially the same shape, disposed at an equal interval, and provided integrally with the annular rib 25.

Between one first information display portion 9 and the adjacent first information display portion 9, there is provided gap portions 10 (10*a*, 10*b*, 10*c*, and 10*d*) serving as an opening (or elongated aperture) when the flange 4 is viewed from a lateral direction (side), that is, when viewed from a direction orthogonal to the shaft center of the hub 3. The depth of the gap portion 10 is formed substantially to be equal to the height of the protrusion 9*a*. In this embodiment, the protrusions 9*a* and the recesses 9*b* are respectively formed in the same shape. However, the protrusions 9*a* and the recesses 9*b* all are not necessary to be formed in the same shape. For example, the widths of the protrusion 9*a* and the recess 9*b* in the circumferential direction may be different from each other. The heights of the protrusions 9*a* and the depths of the recesses 9*b* may be different from each other.

The protrusion 9*a* need not protrude from the upper surface of the annular rib 25. For example, the protrusion 9*a* may protrude directly from the surface of the flange 4 without providing the annular rib 25 (without using the annular rib 25). In the illustrated example, the annular rib 25 provides an annular plate configured by a continuous wall surface integrally formed to the flange 4. Therefore, with the annular rib 25, the flange 4 is increased in strength, and the deformation of the flange 4 can be prevented or reduced.

The second information display portion 12 is configured by a plurality of protrusions 12*a* (12*a*1 and 12*a*2), or second projections, which extend substantially in the vertical direction with respect to the surface 4*b* of the flange 4, and a plurality of recesses or second recesses (slits or apertures) 12*b* (12*b*1, 12*b*2, and 12*b*3) which are formed on both sides of the protrusion 12*a*. In this embodiment, an annular rib 26 made of a wall-shaped member is erected on the second circumference C2. The second information display portion 12 is integrally formed in the upper surface of the annular rib or wall 26. Specifically, the second information display portion 12 is configured by three recesses 12*b*1, 12*b*2, and 12*b*3 or light transmissive portions which are formed in the upper surface (an upper edge) of the annular rib or wall 26, and two protrusions or projections 12*a*1 and 12*a*2 (second projections) which are interposed between these recesses 12*b*1, 12*b*2, and 12*b*3 (second recesses). The protrusion 12*a* is made of a shielding body (plate) of a substantially rectangular shape which is not transmissive or light blocking, and has a height (a height from the bottom surface of the recess 12*b* to the apex (the upper surface of the annular rib 26)) and a thickness of several mm. The two protrusions 12*a*1 and 12*a*2 are formed in almost the same shape, and disposed at a predetermined interval. The portions other than the second information display portions 12A, 12B, 12C, and 12D of the annular rib (or wall) 26 form shielding bodies 13 (13A, 13B, 13C, and 13D) which are not transmissive (or light blocking) by the wall surface of the remaining annular rib 26.

In the first information display portion 9, the protrusion 9*a* is configured to protrude from the upper surface of the annular rib 25. Therefore, the bottom surface of the recess 9*b* continuing to the bottom surface of the protrusion 9*a* is substantially flush with the upper surface of the annular rib 25. However, in the second information display portion 12, the recess 12*b* is formed in the upper surface of the annular rib 26. Therefore, the bottom surface of the recess 12*b* is positioned lower than the upper surface of the annular rib 26. Accordingly, the upper surface of the protrusion 12*a* in the second information display portion 12 is configured to be substantially flush with the upper surface of the annular rib 26. The upper surface of the protrusion 9*a* formed in the upper surface of the annular rib 25 and the upper surface of the annular rib 26 are configured to be substantially flush with the surface 4*b* of the flange 4. Therefore, the heights of the protrusion 9*a* and the protrusion 12*a* are substantially equal. The shapes of the annular ribs 25 and 26 are not limited to that in the embodiment.

The annular rib 26 also provides an annular plate configured by a continuous wall surface similar to the annular rib 25, and is formed integrally with the flange 4. Therefore, the annular rib 26 is formed together with the annular rib 25, so that the strength of the flange 4 can be increased still further.

On the surface 4*b* of the flange 4, an annular recess 18 is formed concentrically to the hub 3 in a portion corresponding to an outer circumferential portion (cross section) of the hub 3. An annular boss portion 17 is formed to surround the annular recess 18. The annular recess 18 and the boss portion 17 are rotatably supported to the reinforcing bar binding machine body, and also serve as a reinforcing material of the flange 4. Therefore, the strength of the flange 4 can be increased still further by providing the annular recess 18 and the boss portion 17 (along with the annular ribs 25 and 26).

Figure 4:
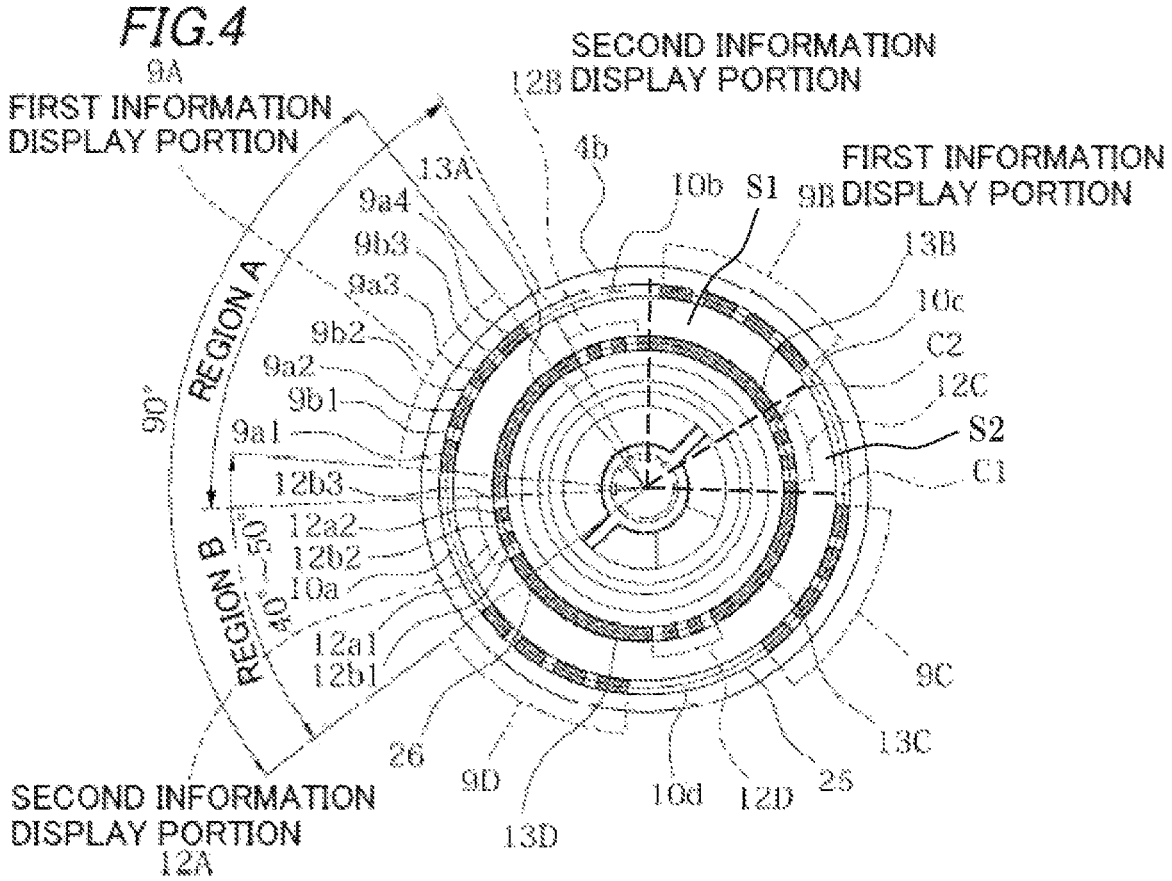
FIG. 4 is an explanatory diagram for describing an arrangement of a first information display portion and a second information display portion in a surface of the flange.

FIG. 4 is an explanatory diagram for describing an arrangement of the first information display portion 9 and the second information display portion 12 on the surface 4*b* of the flange 4. In FIG. 4, the protrusions 9*a* and 12*a* are illustrated by hatching for the sake of clarity in arrangement of the protrusion 9*a* and the recess 9*b* of the first information display portion 9, and the protrusion 12*a* and the recess 12*b* of the second information display portion 12. As illustrated in FIG. 4, four first information display portions 9 are disposed at an equal interval on the first circumference C1.

Four second information display portions 12 are disposed at an equal interval on the second circumference C2. However, there is no need to dispose the first and second information display portions 9 and 12 at an equal interval. The first and second information display portions 9 and 12 may be disposed roughly along the first circumference C1 and the second circumference C2, and not necessarily exactly matched with the respective circumferences C1 and C2.

The first information display portions 9 are disposed one by one about the shaft center of the hub 3 in regions (an angular range of 90 degrees about the shaft center of the hub 3) obtained by dividing the surface 4*b* of the flange 4 into quarters in the illustrated example. In other words, the first information display portion 9 is disposed in a region (for example, region A) interposed between an extension of a line segment connecting the end of one second information display portion 12 in the adjacent two second information display portions 12 and the shaft center of the hub 3 and an extension of a line segment connecting the end of the other second information display portion 12 and the shaft center of the hub 3. Therefore, four first information display portions 9 are disposed on the first circumference C1, and not overlapped at all with the second information display portion 12 in the radial direction of the surface 4*b* of the flange 4. Stated alternately, an information portion of the first information portions 9 is offset in a circumferential direction from its nearest information portion of the second information display portions 12.

In other words, the first information display portion 9 and the second information display portion 12 are not disposed on the same diameter (or same radial line) in the surface 4*b* of the flange 4. The expression "the end of the second information display portion 12" means an outer side wall or a side surface (side edge) of the recess 12*b* (12*b*1 or 12*b*3) positioned at the outermost end of the second information display portion 12.

On the other hand, the second information display portions 12 are disposed one by one in the quartered region (in this case, the second information display portion 12 may be positioned on the boundary of the quartered region according to where the surface 4*b* of the flange 4 is divided into quarters). In other words, the second information display portion 12 is disposed in a region (for example, region B) surrounded by both inner ends of the adjacent two first information display portions 9 (the ends on sides where the adjacent first information display portions 9 face each other) and the shaft center of the hub 3. Therefore, four second information display portions 12 are disposed on the second circumference C2 in order not to be exactly overlapped with the first information display portion 9 in the radial direction of the surface 4*b* of the flange 4. The expression "both inner ends of the adjacent first information display portions 9" means the outer side walls or the side surfaces of the protrusions 9*a* on sides where the adjacent first information display portions 9 face each other among the outer side walls or the side surfaces (side edges) of the protrusions 9*a* positioned at the outermost ends of the first information display portion 9. In this embodiment, when the end of one first information display portion 9 in the adjacent first information display portions 9 is, for example, the protrusion 9*a*1, "both inner ends of the adjacent first information display portions 9" means the outer side walls of the protrusion 9*a*1 and the protrusion 9*a*4 of the end of the other first information display portion 9. When the end of one first information display portion 9 is, for example, the protrusion 9*a*4, "both inner ends of the adjacent first information display portions 9" means the outer side walls of the protrusion 9*a*4 and the protrusion 9*a*1 of the end of the other first information display portion 9.

On the surface 4*b* of the flange 4, there are provided with plural sets of pairs of adjacent first information display portions 9 and the second information display portion 12 positioned between a pair of first information display portions 9 (that is, in the gap portion 10) when viewed from the lateral direction of the flange 4 (a set of two first information display portions 9 and one second information display portion 12) in the circumferential direction (in this embodiment, four sets in total: a set of the first information display portions 9A and 9B and the second information display portion 12B; a set of the first information display portions 9B and 9C and the second information display portion 12C; a set of the first information display portions 9C and 9D and the second information display portion 12D; and a set of the first information display portions 9D and 9A and the second information display portion 12A). In other words, on the surface 4*b* of the flange 4, there are provided plural sets of pairs of adjacent second information display portions 12 and the first information display portion 9 positioned between the pair of second information display portions 12 when viewed from the lateral direction of the flange 4 (a set of one first information display portion 9 and two second information display portions 12) in the circumferential direction (in this embodiment, four sets in total: a set of the second information display portions 12A and 12B and the first information display portion 9A; a set of the second information display portions 12B and 12C and the first information display portion 9B; a set of the second information display portions 12C and 12D and the first information display portion 9C; and a set of the second information display portions 12D and 12A and the first information display portion 9D). Therefore, the first and second information display portions 9 and 12 are visible from any lateral direction of the flange 4.

Figure 34:
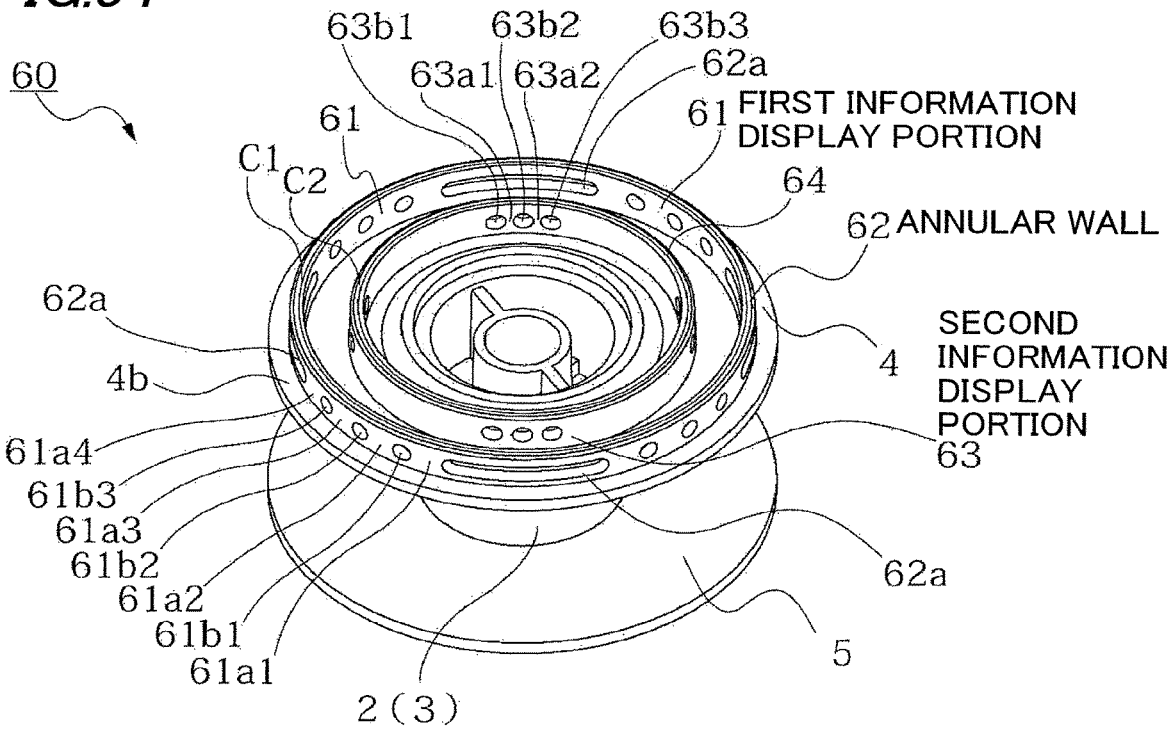
FIG. 34 is a perspective view of an external appearance of a reel according to a fifth embodiment.

Stated alternately with reference to FIG. 4, considering a circle defined by the outer circumference C1, the first display portions 9 are disposed at different sectors of the circle, while the second display portions are partially, or preferably entirely, positioned so as to be in sectors other than those occupied by the first information display portions. Thus, a first information display portion 9B is positioned within a first sector S1 of the circle C1, while a second information display portion 12C is at least partially positioned in a second sector S2 which is not occupied by the first information display portion. For example, the first and second sectors S1, S2 are demarcated by broken lines in FIG. 4. In FIG. 4, first sector S1 corresponds to first information display portion 9B, and additional first sectors S1 would thus correspond to first information display portions 9A, 9C, and 9D. In addition, second sector S2 corresponds to second information display portion 12C, and additional second sectors S2 would correspond to second information display portions 12A, 12B, and 12D, such that plural first and second sectors S1, S2 are present. Element identifiers for the other sectors are omitted to simplify the drawing. Further, at the outer circumference position C1 of the second sector, an opening is provided (e.g., as a gap 10*c* or 10*d* between adjacent first information display portions as shown in FIG. 1 or as an aperture 62*a* in a wall section or wall portion between first information display portions in which the first information display portions 61 are defined in other wall sections or wall portions as shown in FIG. 34 discussed hereinafter) so that the second information display portion can be viewed from a side or lateral position through the opening.

As described above, in the reel 1 according to this embodiment, the information display portions 9 and 12 are disposed on the surface 4*b* of the flange 4. Therefore, for example, much more information can be provided compared to a case where the information display portions are disposed inside the narrow hub 3. The information display portions 9 and 12 are disposed on different circumferences C1 and C2 of the surface 4*b* of the flange 4. Therefore, the surface 4*b* of the flange 4 is effectively used, and much more information can be provided. Furthermore, the first information display portion 9 and the second information display portion 12 are disposed not to be overlapped in the radial direction of the surface 4*b* of the flange 4. Therefore, for example, the first information display portion 9 and the second information display portion 12 are visible at the same time when the flange 4 is viewed from the lateral direction. Furthermore, the information display portions 9 and 12 are formed to protrude from the surface 4*b* of the flange 4. Therefore, for example, it is easy for an operator who handling the reel 1 to visually confirm the information display portions 9 and 12. The information display portions 9 and 12 are configured by the protrusions 9*a* and 12*a* and the recesses 9*b* and 12*b*. Therefore, it is easy for the operator to visually confirm the shapes of the information display portions 9 and 12 (for example, the numbers and the positions of the protrusions 9*a* and 12*a* and the recess 9*b* and 12*b*). Specifically, the shapes of the information display portions 9 and 12 (that is, the numbers and the shapes of the protrusions 9*a* and 12*a* and the recesses 9*b* and 12*b*) are information for identifying the type of wire, which will be described below.

In the reel 1 according to this embodiment, the information display portions 9 and 12 are disposed on two circumferences C1 and C2. However, such a circumference where the information display portions 9 and 12 are disposed may be provided two or more. In this case, much more information can be provided on the surface 4*b* of the flange 4. When the information display portions 9 and 12 are increased in the radial direction of the surface 4*b* of the flange 4, the entire strength of the flange 4 can be increased in proportion thereto. In other words, the increased information display portions (the information display portions other than the information display portions 9 and 12) also effectively serve as the reinforcing member of the flange 4.

In the reel 1 according to this embodiment, the first information display portion 9 and the second information display portion 12 have been disposed on the different diameters not to be overlapped in the radial direction. In other words the first and second information display portions are offset from each other in a circumferential direction. However, the first information display portion 9 and the second information display portion 12 may be partially overlapped as long as the protrusions 9*a* and 12*a* and the recesses 9*b* and 12*b* of the first and second information display portions 9 and 12 can be identified at the same time. Therefore, there is a case where the entire first information display portion 9 is disposed in the region A (see FIG. 4) so as not to be overlapped at all with the second information display portions 12, and a case where the most of the first information display portion 9 is disposed in the region A, but a part thereof may be overlapped with the second information display portion 12 by protrusion from the region A. Similarly, there is a case where the entire second information display portion 12 is disposed in the region B (see FIG. 4) so as not to be overlapped at all with the first information display portions 9, and a case where the most of the second information display portion 12 is disposed in the region B, and a part thereof may be overlapped with the first information display portions 9 by protrusion from the region B.

The first circumference or circle C1 is positioned on the inner side by several mm from the outer peripheral edge of the flange 4 (the inner side in the radial direction toward the shaft center), but not necessarily limited thereto. For example, the first circumference may be positioned substantially on the outer peripheral edge of the flange 4. In this case, the first information display portion 9 comes to be disposed substantially along the outer peripheral edge of the surface 4*b* of the flange 4. However, when the first information display portion 9 is positioned on the inside from the outer peripheral edge of the flange 4 as described in this embodiment, the first information display portion 9 can be protected by the outer peripheral edge of the flange 4 even in a case where an impact is applied on the reel 1 during transportation or due to dropping for example.

Returning to the explanation of FIG. 2, the other flange 5 in the facing flanges 4 and 5 is provided with an annular recess 20 which is formed on the surface 5*b* concentrically to the hub 3 in a portion corresponding to an outer circumferential portion (cross section) of the hub 3, an annular first protrusion rib 21 which is formed to surround the annular recess 20, a plurality of second protrusion ribs 22 which radially extend to the outside in the radial direction from the first protrusion rib 21, and an annular third protrusion rib 23 which is connected to the second protrusion rib 22 and formed along the outer peripheral edge of the surface of the flange 5. The annular recess 20 and the first protrusion rib 21 are portions which are rotatably supported to the reinforcing bar binding machine body. Since the first, second, and third protrusion ribs 21, 22, and 23 are provided, the strength of the flange 5 can be increased and the deformation of the flange 5 can be prevented.

In this embodiment and the other embodiments subsequent to the second embodiment, the description will be made about an example in which two annular protrusion ribs are provided as described above. However, the number of annular protrusion ribs is not limited to two, and may be three or more. The annular protrusion rib may be formed in other shapes as long as the similar function is exerted including the radiclly-disposed protrusion rib.

Figure 5:
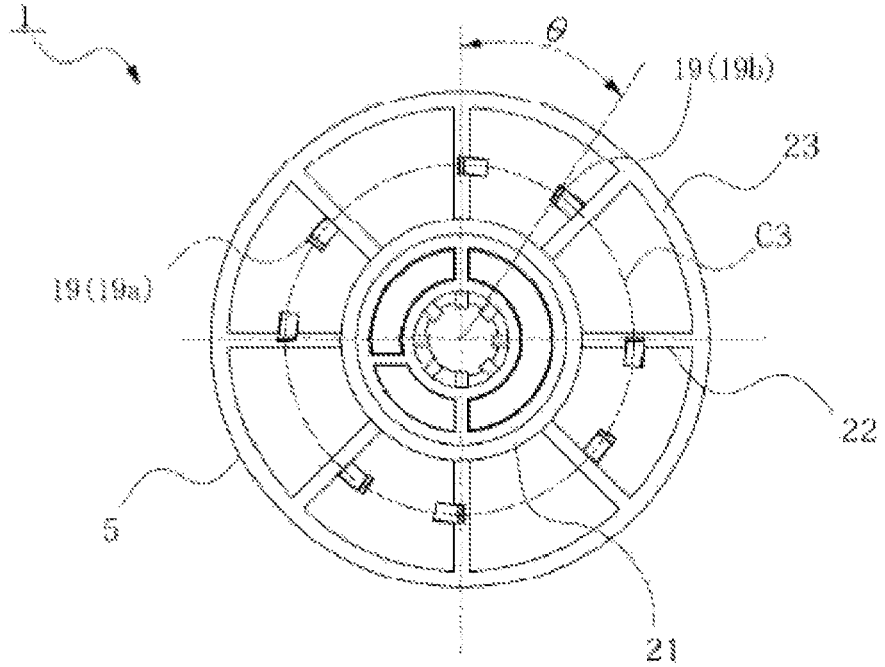
FIG. 5 is an explanatory diagram for describing an arrangement of small projections on the surface of the flange.

On the surface 5*b* of the flange 5, a plurality of small projections 19 (19*a*, 19*b*, . . . ) are provided on a third circumference C3 concentrically to the hub 3 and have a saw-toothed shape formed in almost the right-angled triangle when the Hanger 5 is viewed from the lateral direction. FIG. 5 is an explanatory diagram for describing an arrangement of the small projections 19 on the surface 5*b* of the flange 5. As illustrated in FIG. 5, four sets of the small projections 19 are provided for every 90 degrees in which two small projections 19*a* and 19*b* disposed with an interval therebetween by an angle θ with respect to the shaft center of the hub 3 are paired as a set.

The small projection 19 is used to prevent the reel 1 from being reversely rotated. Specifically, when the reel 1 is housed in a mounting chamber 106 of the reinforcing bar binding machine body described below, a claw (a ratchet mechanism) provided in the mounting chamber is engaged to a portion corresponding to the opposite side of the small projection 19. Since the small projection 19 is formed in almost the right-angled triangle, the reel 1 is rotated in a direction indicated by the angle formed between the inclined side and the adjacent side of the small projection 19. However, the rotation of the reel is regulated against a direction corresponding to the opposite side where the claw is engaged to the small projection 19.

In this embodiment, the direction indicated by the angle formed between the inclined side and the adjacent side of the small projection 19 formed in almost the right-angled triangle is configured to be matched to a direction to which the wire wound on the reel 1 is pulled out (a direction of the leading end of the wire), that is, a rotation direction of the reel 1. Therefore, when viewing the small projection 19, the direction of pulling the wire out (that is, the rotation direction of the reel 1) can be confirmed.

As described above, the operator can identify the type of the wire through a visual confirmation on the first and second information display portions 9 and 12. On the other hand, the wire reel according to the related art described above can also be confirmed by visually confirming the transmission hole corresponding to the first and second information display portions 9 and 12. However, in the wire reel according to the related art, the transmission hole is provided inside the hub. Therefore, for example, in a case where a plurality of wire reels are arranged in a stacked state, it is extremely hard to visually confirm the transmission hole (for example, in the case of the wire reel positioned in the center among the stacked wire reels, it is substantially impossible to visually confirm the transmission hole, and even the wire reel positioned on the top is scarcely confirmed by looking into the inside the hub from the center). On the contrary, in the invention, even in a state where the reels 1 are stacked, the reel can be easily confirmed by visually confirming the first and second information display portions 9 and 12. Hereinafter, the description will be made about such a point.

Figure 7:
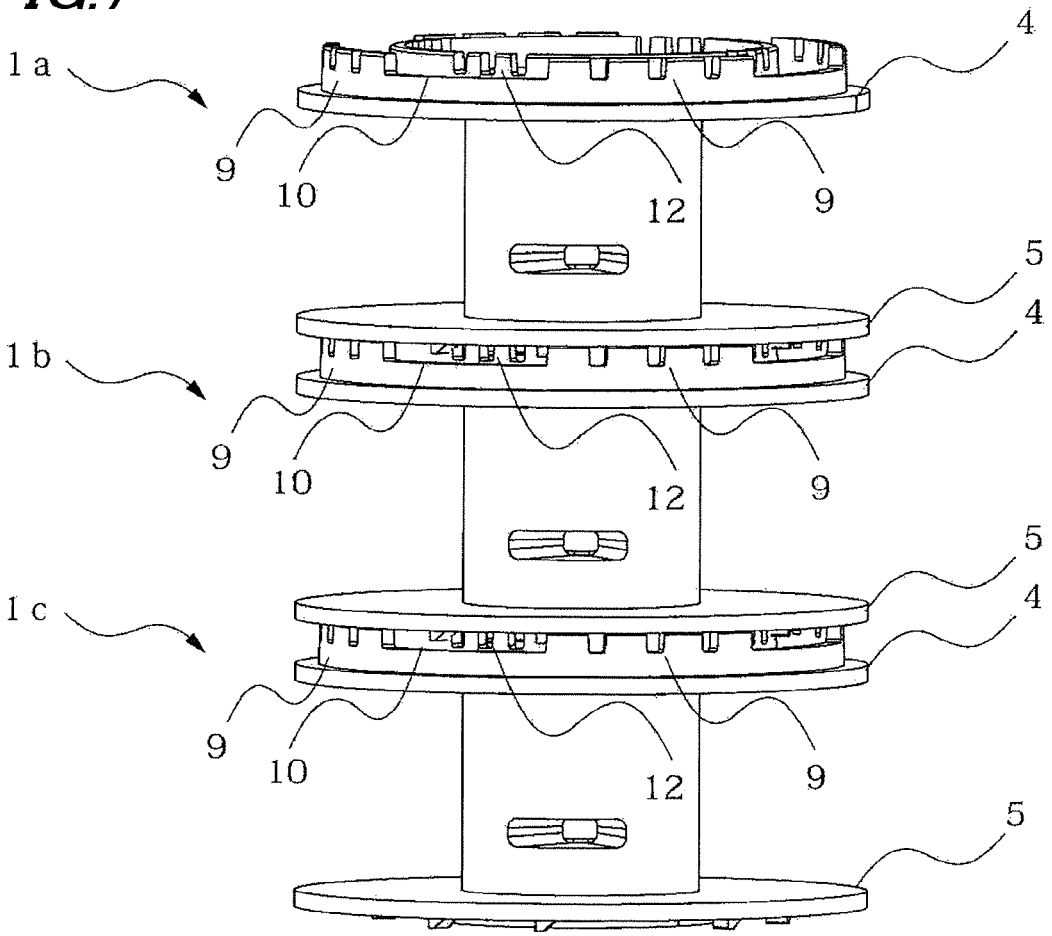
FIG. 7 is a perspective view illustrating a state where a plurality of reels are stacked.
Figure 8:
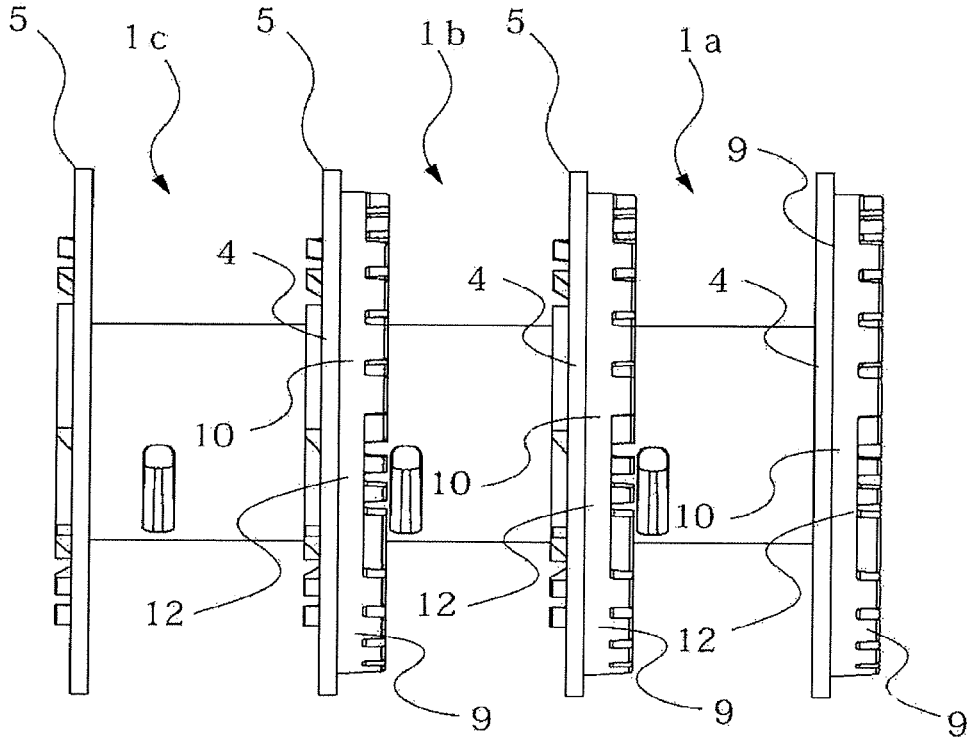
FIG. 8 is a side view illustrating a state where a plurality of reels are horizontally arranged in an overlapping manner.

FIG. 7 is a perspective view illustrating a state where a plurality of reels 1 (1*a*, 1*b*, and 1*c*) are arranged in a direction and stacked vertically. FIG. 8 is a side view illustrating a state where a plurality of reels are arranged in a horizontal direction (or in other words, as a horizontal stack). FIGS. 7 and 8 illustrate, for example, a state where three reels 1 are placed in a storage shelf or a state of being housed in a housing box. FIGS. 7 and 8 also illustrate a state where three reels 1 are arranged as an example, and four or more reels may be naturally arranged.

As illustrated in FIGS. 7 and 8, when the reels 1 are arranged, the flange 5 of the reel 1*a* and the flange 4 of the reel 1*b*, and the flange 5 of the reel 1*b* and the flange 4 of the reel 1*c* become close. In this way, when the reels 1 are stacked or arranged to be close to be each other, the surfaces 4*b* of the flanges 4 of the reels 1*b* and 1*c* are not possible to be visually confirmed. Therefore, the second information display portion 12 is not possible to be visually confirmed from the direction of the surfaces 4*b* of the flanges 4 of the reels 1*b* and 1*c*.

However, since the second information display portion 12 is disposed between the first information display portions 9, the second information display portion 12 can be confirmed when the flange 4 is viewed from the lateral direction even in a case where a plurality of reels 1 are stacked. In other words, the second information display portion 12 can be visually identified from between the first information display portions 9 (the gap portion 10). Naturally, since the first information display portion 9 is disposed on the first circumference C1 near the outer peripheral side of the surface 4*b* of the flange 4, the first information display portion is not concealed even when the reels 1 are stacked. Therefore, in a case where the second information display portion 12 is visually identified, the first information display portion 9 can also be identified at the same time. The expression "the first information display portion 9 or the second information display portion 12 is visually identified" means that the configuration and the number of the protrusions 9*a* and the recesses 9*b* of the first information display portion 9 or the protrusions 12*a* and the recesses 12*b* of the second information display portion 12 are visually identified.

For example, the shapes and/or the colors of the plurality of protrusions 9*a* and 12*a* can be also made different. In this case, the shape and the color are also the information for identifying the type of the wire in addition to, or as an alternative to, the number and the position of the protrusions 9*a* and 12*a* and the recesses 9*b* and 12*b*.

As described above, there are a lot of types in the wire that can be wound on the reel 1. Therefore, since the information from the first information display portion 9 and the second information display portion 12 provided in the reel 1 (the flange 4) is used in combination, a lot of types of the wires can be handled and readily identified. In other words, since a plurality of combinations can be created by combining the information held in the first information display portion 9 and the information held in the second information display portion 12, a lot of types of the wires can be identified by assigning these combinations to the types of the wires.

In this embodiment, the first information display portion 9 is configured by four protrusions 9*a*. However, the number of protrusions 9*a* can vary in a range from 0 to 4, for example. The number of protrusions 12*a* of the second information display portion 12 can vary in a range from 0 to 2, for example. Naturally, the number of protrusions 9*a* may be set to 5 or more, or the number of protrusions 12*a* may be set to 3 or more. In this way, the holding information may be changed by changing the number of protrusions 9*a* and 12*a*. The amount of holding information may be changed by changing an upper limit of the number of protrusions 9*a* and 12*a*.

In a case where the number of protrusions 9*a* can vary in a range from 0 to 4 and the number of protrusions 12*a* can vary in a range from 0 to 2, the reel 1 can hold fifteen pieces of visually identifiable information by combining the first information display portion 9 capable of storing five pieces of information and the second information display portion 12 capable of storing three pieces of information. Therefore, since the types of the wires with fifteen pieces of information configured by the first information display portion 9 and the second information display portion 12 are associated, the types of the wires wound on the reel 1 (a wire of any one of a maximum fifteen types) can be identified only by confirming the first information display portion 9 and the second information display portion 12. Furthermore, the first information display portion 9 and the second information display portion 12 are disposed not to be overlapped in the radial direction of the surface 4*b* of the flange 4, and plural sets of pairs of adjacent first information display portions 9 and the second information display portion 12 positioned between a pair of first information display portions 9 when the flange 4 is viewed from the lateral direction are provided in the circumferential direction of the surface 4*b* of the flange 4. Therefore, the first and second information display portions 9 and 12 can be always visually confirmed even when the flange 4 is viewed from any direction.

In the reel 1 according to this embodiment, the first and second information display portions 9 and 12 are formed in the protrusion and recess shape on the annular ribs 25 and 26 which protrude from the surface 4*b* of the flange 4. Therefore, the operator can identify the shapes of the first and second information display portions 9 and 12 not only by visually confirming but also by touching the reel 1 with their hands. Therefore, for example, even in a situation where a work place is so dark that it is difficult to visually determine the reel, or in a situation where a specific reel (the reel 1) has to be identified among the mixed reels having shapes different from that of the reel 1 according to this embodiment, the reel 1 and the information provided in the reel 1 can be identified by touching the reel with the hands.

Figure 9:
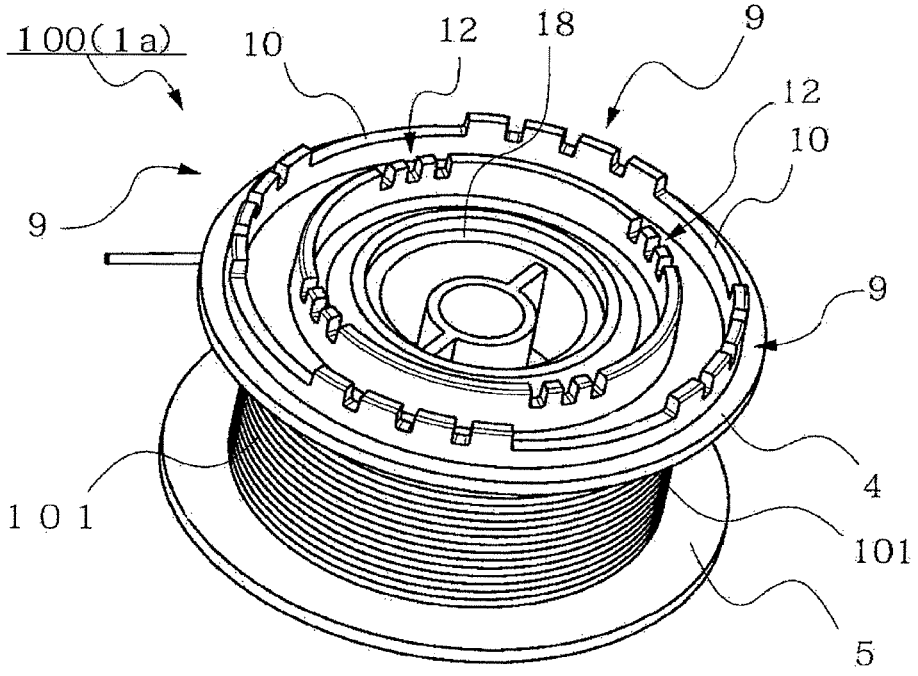
FIG. 9 is a perspective view of an external appearance of a wire supply body when viewed from the flange on one side.
Figure 10:
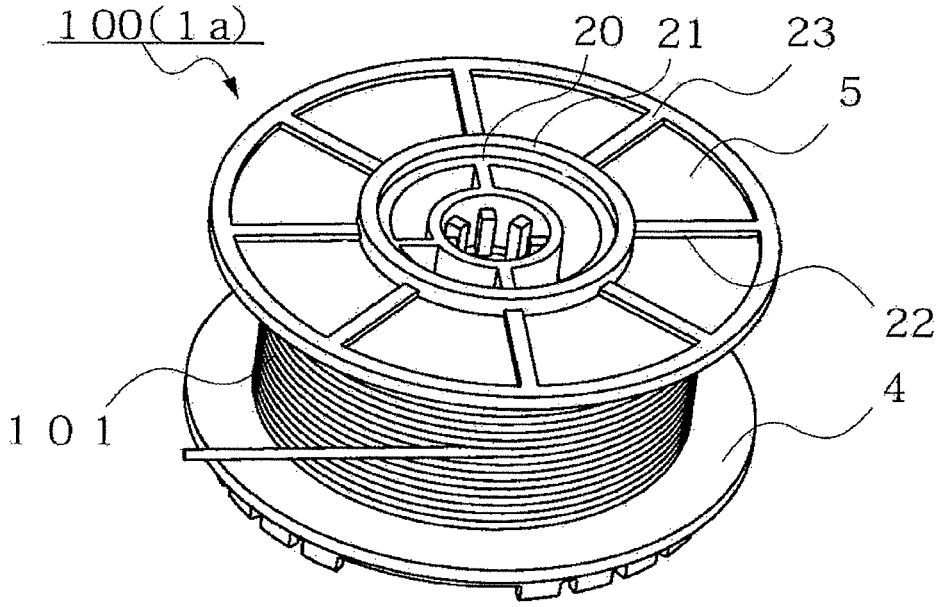
FIG. 10 is a perspective view of an external appearance of a wire supply body when viewed from the flange on the other side.
Figure 11:
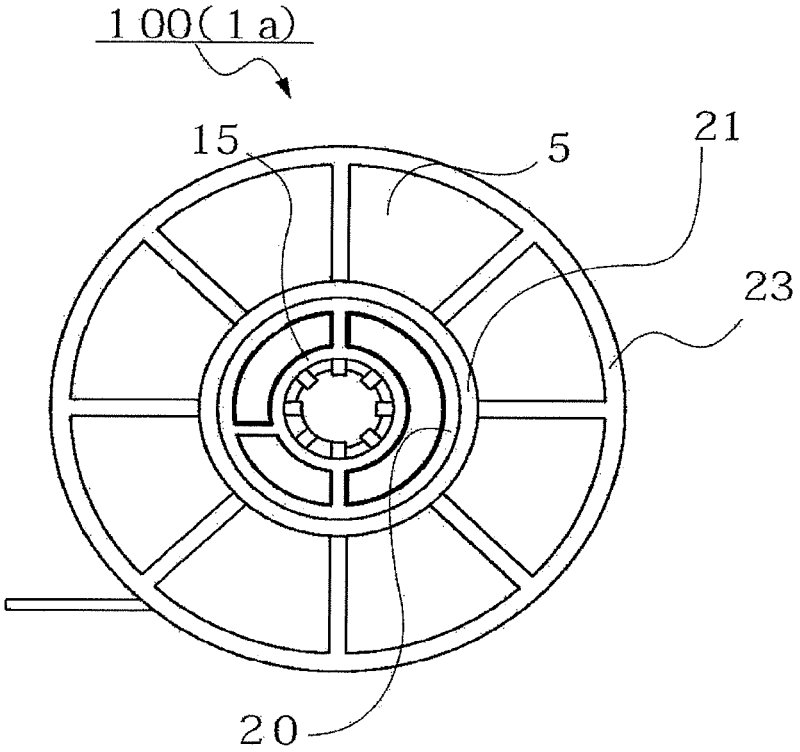
FIG. 11 is a diagram of an external appearance of the wire supply body when viewed from the flange on the other side.
Figure 12:
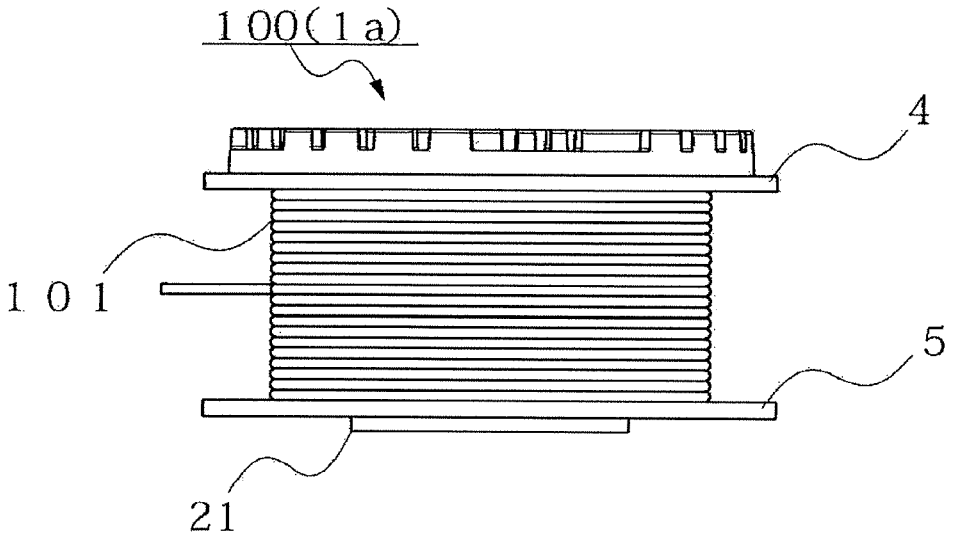
FIG. 12 is a plan view of the wire supply body in a case where
Figure 13:
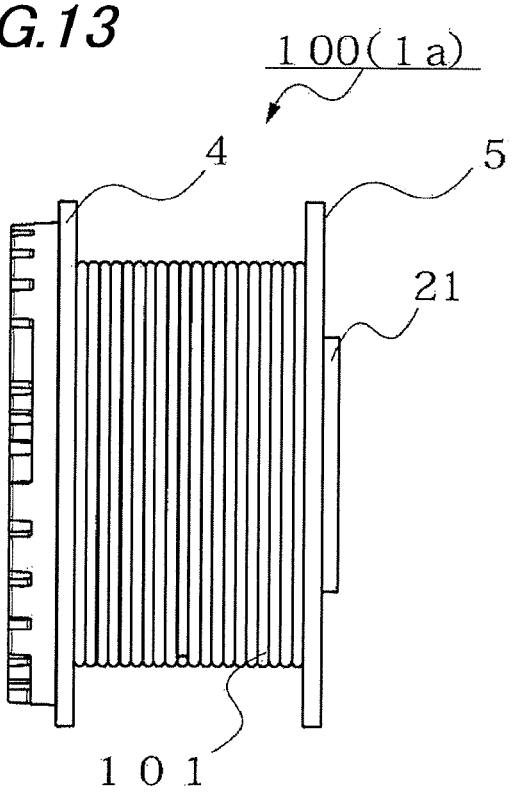
FIG. 13 is a left side view of the wire supply body in a case where
Figure 14:
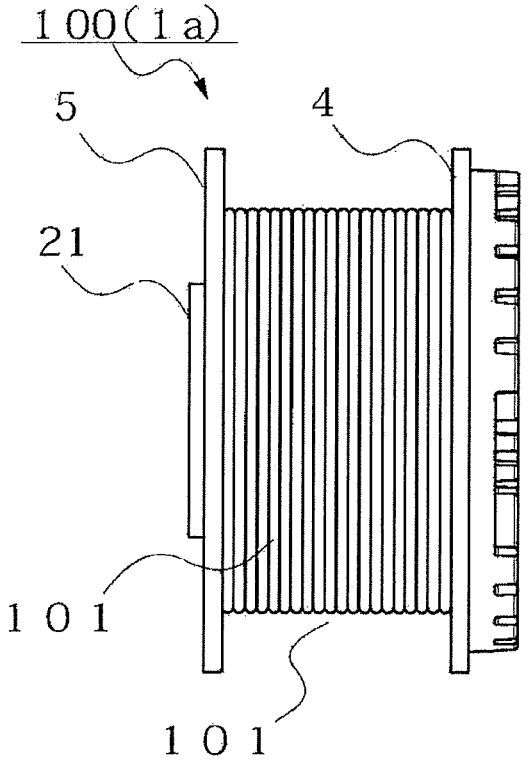
FIG. 14 is a right side view of the wire supply body in a case where
Figure 15:
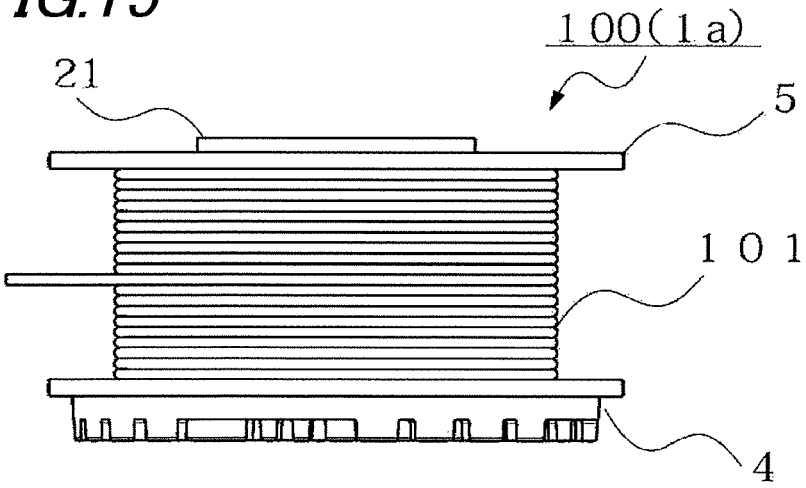
FIG. 15 is a bottom view of the wire supply body in a case where
Figure 16:
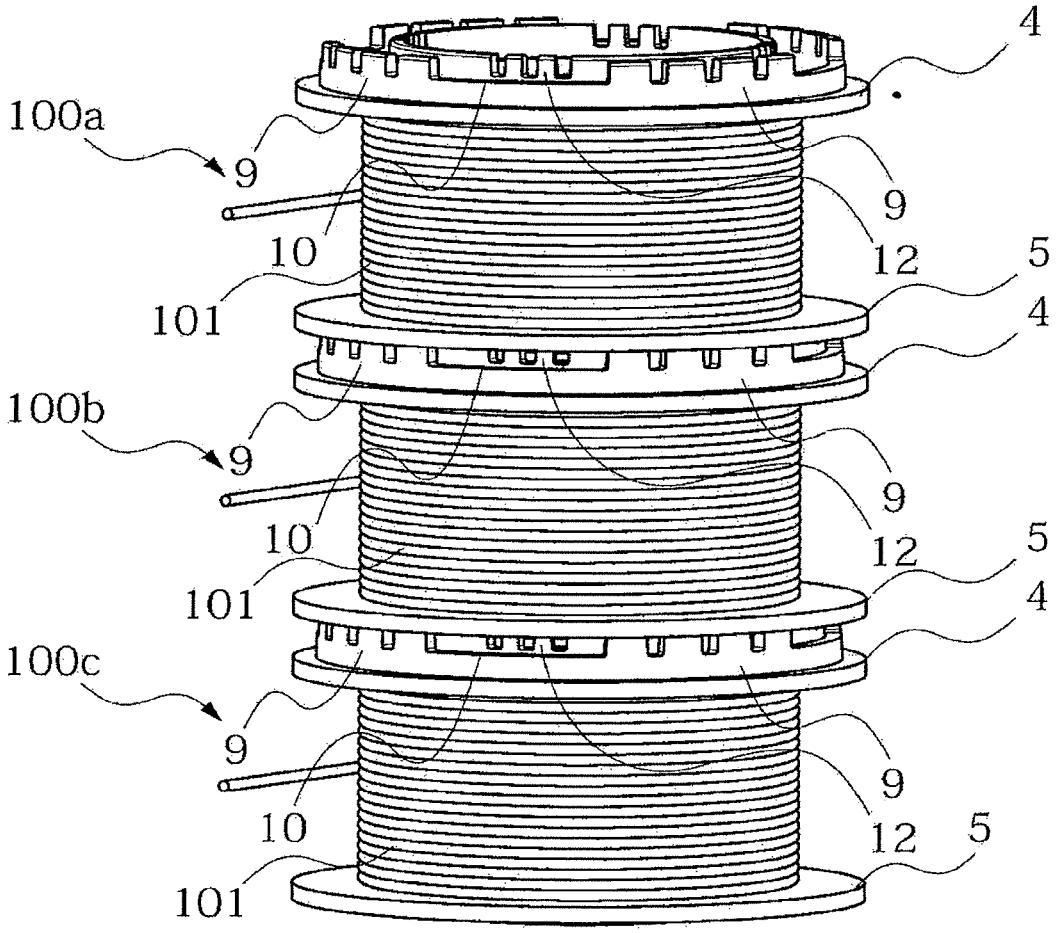
FIG. 16 is a perspective view of a state where a plurality of wire supply bodies are stacked.
Figure 17:
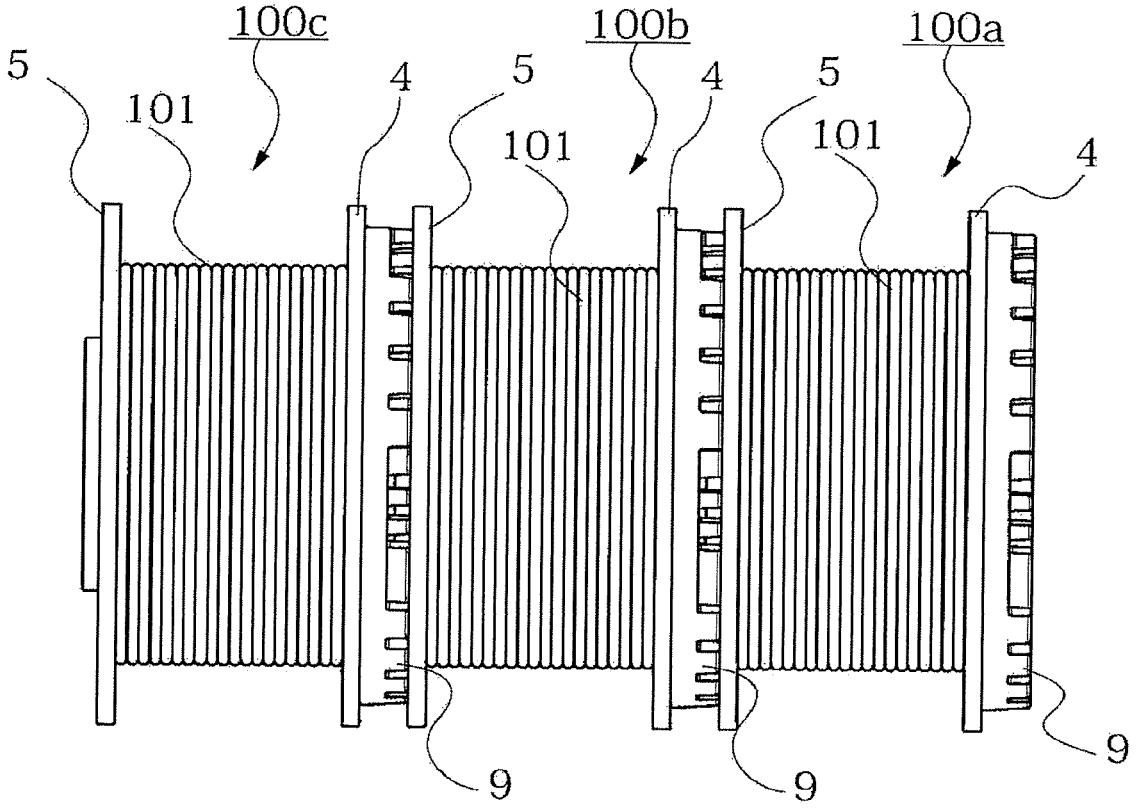
FIG. 17 is a side view of a state where a plurality of wire supply bodies are horizontally arranged.

FIGS. 9 to 17 illustrate the reel 1 (a wire supply body 100) in a state where the wire is wound. FIG. 9 is a perspective view of an external appearance of the wire supply body 100 when viewed from the flange 4. FIG. 10 is a perspective view of an external appearance of the wire supply body 100 when viewed from the flange 5. FIG. 11 is a diagram of an external appearance of the wire supply body 100 when viewed from the flange 5. FIG. 12 is a plan view in a case where FIG. 11 is a front view. FIG. 13 is a left side view in a case where FIG. 11 is a front view. FIG. 14 is a right side view in a case where FIG. 11 is a front view. FIG. 15 is a bottom view in a case where FIG. 11 is a front view. FIG. 16 is a perspective view illustrating a state where a plurality (three in the example of the drawing) of wire supply bodies 100 (100*a*, 100*b*, and 100*c*) are arranged in a direction and stacked upwardly. FIG. 17 is a side view illustrating a state where a plurality (three in the example of the drawing) of wire supply bodies 100 are arrange in a horizontal direction. The wire supply body 100 is a portable replacement which is detachably attached to the reinforcing bar binding machine body, and is configured by the above-described reel 1 wound with a wire 101.

As illustrated in the respective drawings, the information of the wire wound on the reel 1 is provided in the first and second information display portions 9 and 12 formed on the surface 4*b* of the flange 4. Therefore, the operator can identify the type of the wound wire by confirming the first and second information display portions 9 and 12.

As illustrated in FIGS. 16 and 17, when the wire supply bodies 100 are arranged, the flange 5 of the wire supply body 100*a* and the flange 4 of the wire supply body 100*b*, and the flange 5 of the wire supply body 100*b* and the flange 4 of the wire supply body 100*c* come close. When the wire supply bodies 100 come close, the surfaces 4*b* of the flanges 4 of the wire supply body 100*b* and 100*c* are concealed similarly to the example illustrated in FIGS. 7 and 8. Thus, the first information display portion 9 and the second information display portion 12 are not possible to be visually confirmed from the surface 4*b* of the flange 4. However, since the gap portion 10 serving as an opening is formed in the annular rib 25, the second information display portion 12 disposed on the second circumference C2 can be visually confirmed through the gap portion 10. Naturally, the first information display portion 9 provided on the circumference C1 near the outer peripheral side of the flange 4 is not concealed even when the wire supply bodies 100 are stacked. Therefore, in a case where the second information display portion 12 is visually identified, the first information display portion 9 can also be visually identified. While various types of the wires can be wound in the wire supply body 100, the operator can confirm the type of the wound wire by confirming the information held in the first information display portion 9 and the information held in the second information display portion 12 (specifically, a combination of information).

Figure 18:
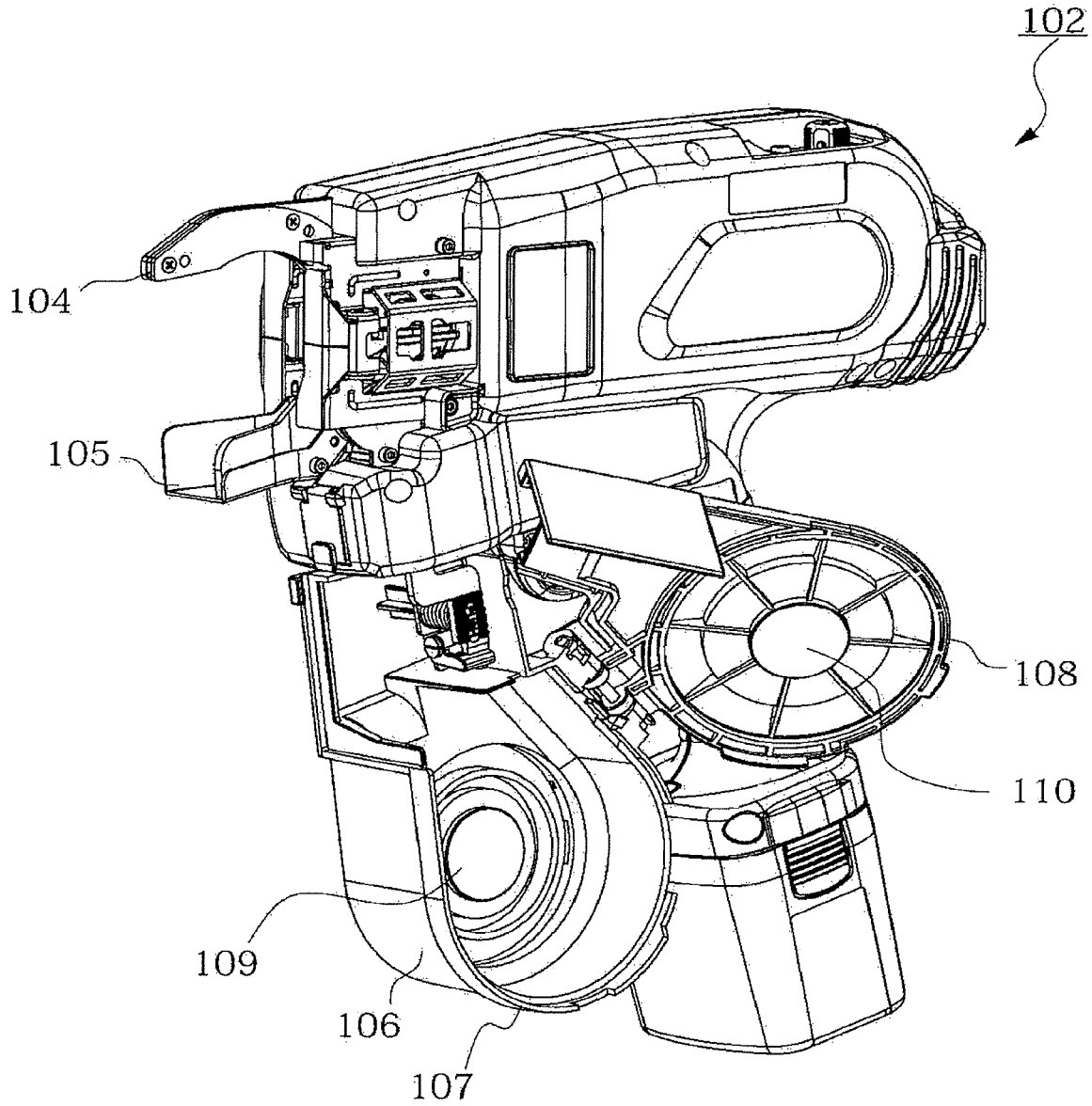
FIG. 18 is an explanatory diagram illustrating an example of a reinforcing bar binding machine which uses the wire supply body.
Figure 19:
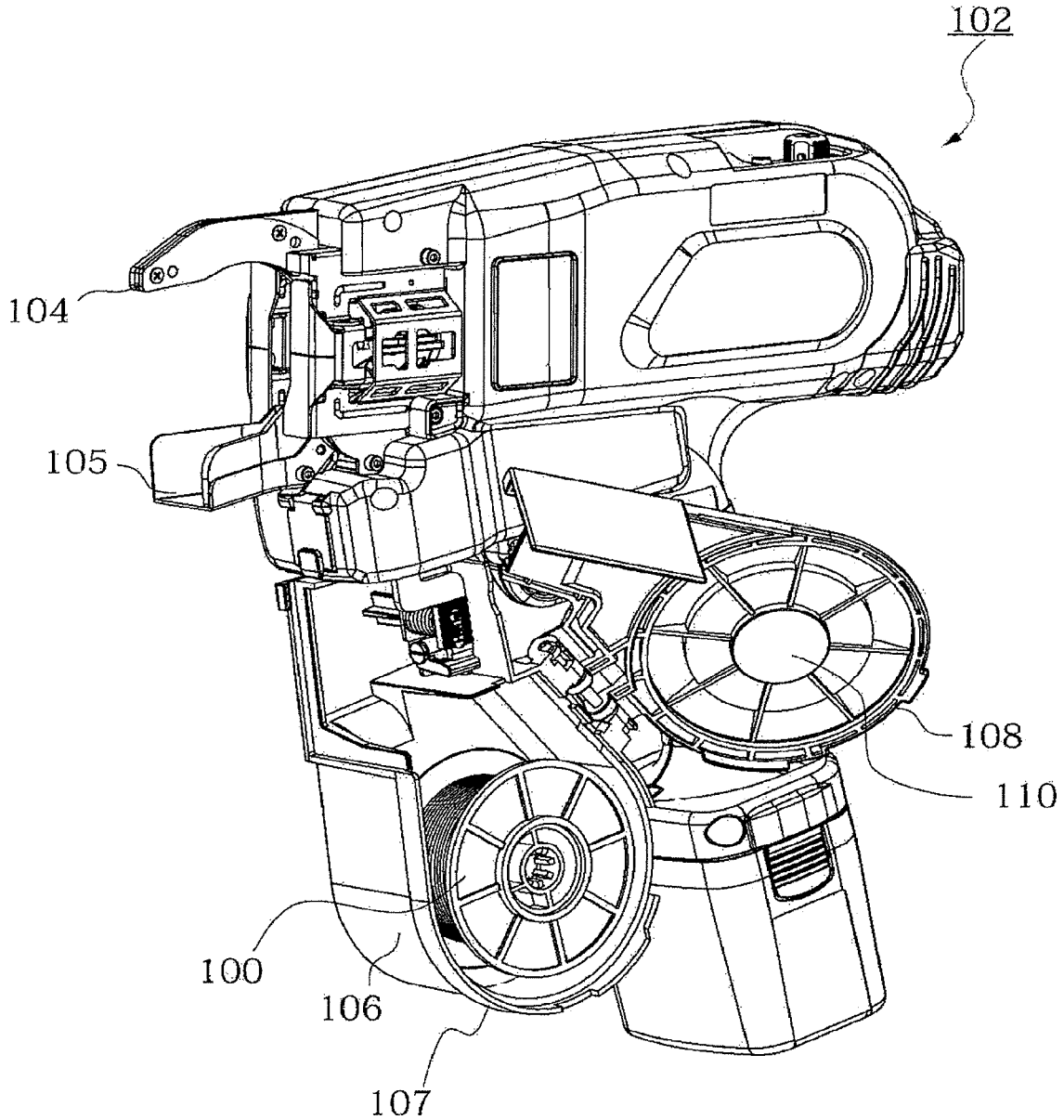
FIG. 19 is an explanatory diagram illustrating an example of the reinforcing bar binding machine which uses the wire supply body.
Figure 20:
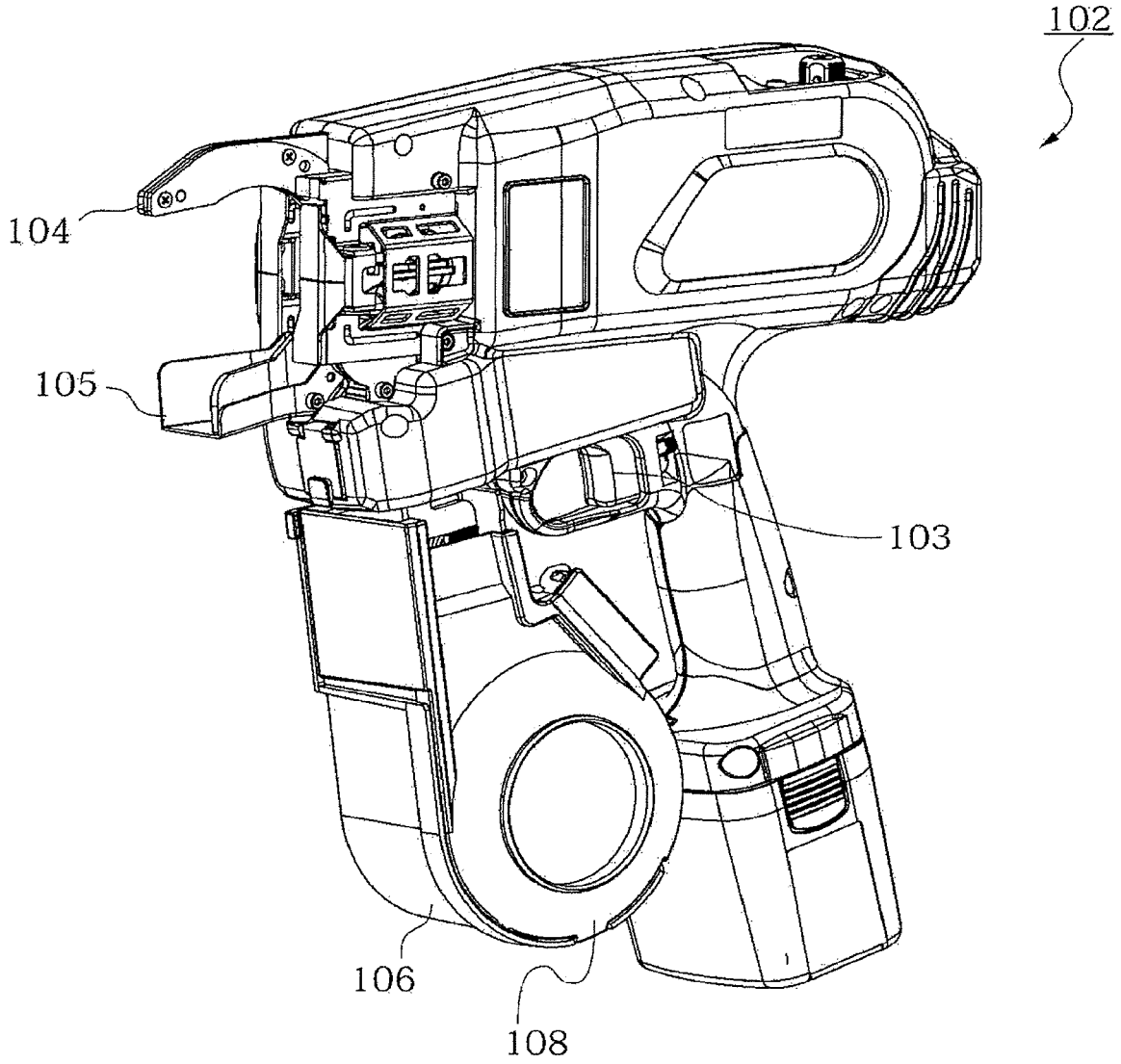
FIG. 20 is an explanatory diagram illustrating an example of the reinforcing bar binding machine which uses the wire supply body.

FIGS. 18 to 20 are explanatory diagrams illustrating an example of the reinforcing bar binding machine which uses the wire supply body 100. A reinforcing bar binding machine 102 is used to feed the wire from the leading end of an upper guide 104 by an operation of a trigger 103, guides the fed wire to a lower guide 105 to form a loop, and winds the loop around the outer periphery of reinforcement bar for binding. The reinforcing bar binding machine 102 includes the mounting chamber 106 which is used to house and mounts the wire supply body 100 in the reinforcing bar binding machine body. The reinforcing bar binding machine 102 is configured to lead out the wire from the wire supply body 100 housed in the mounting chamber 106, and performs a binding operation while taking the wire into the mounting chamber 106 according to a specification or an operation mode of the reinforcing bar binding machine 102.

The mounting chamber 106 includes a housing space 107 where the wire supply body 100 is housed, and a lid body 108 which closes the housing space 107. In the substantial center of the housing space 107 and the substantial center of the lid body 108, there are provided with holding portions 109 and 110 which rotatably hold the shaft of the reel 1. In the reinforcing bar binding machine body, there is provided a photointerrupter (not illustrated) in which a light emitting portion and a light receiving portion are outstretched to interpose the annular locus drawn by the first information display portion 9 rotating along the rotation of the wire supply body 100 in the housing space 107. Similarly, there is provided a photointerrupter (not illustrated) in which a light emitting portion and a light receiving portion are outstretched to interpose the annular locus drawn by the second information display portion 12. The photointerrupter is a type of optical sensor in which aninfrared-ray emitting portion and an infrared-ray receiving portion are integrally formed, but the type of the photointerrupter is not limited thereto and other types of sensor may be used.

The reel 1, and the first information display portion 9 and the second information display portion 12 of the wire supply body 100 formed by the reel wound with the wire according to this embodiment are identified (detected) visually and tactually by a person, and besides be also detectable even by an optical sensor provided in the reinforcing bar binding machine body. When the wire supply body 100 (the reel 1) is rotated in the reinforcing bar binding machine 102, the first information display portion 9 (the protrusion 9*a* and the recessrecess 9*b*) accordingly passes through between the light emitting portion and the light receiving portion of the photointerrupter. At this time, the infrared is intermittently input to the light receiving portion, and the intermittent light signal is output to a control unit of the reinforcing bar binding machine 102. With the rotation of the wire supply body 100, the second information display portion 12 (the protrusion 12*a* and the recessrecess 12*b*) passes through between the light emitting portion and the light receiving portion of the photointerrupter other than the photointerrupter detecting the first information display portion 9. At this time, the infrared is intermittently input to the light receiving portion, and the intermittent light signal is output to a control unit of the reinforcing bar binding machine 102.

Figure 21:
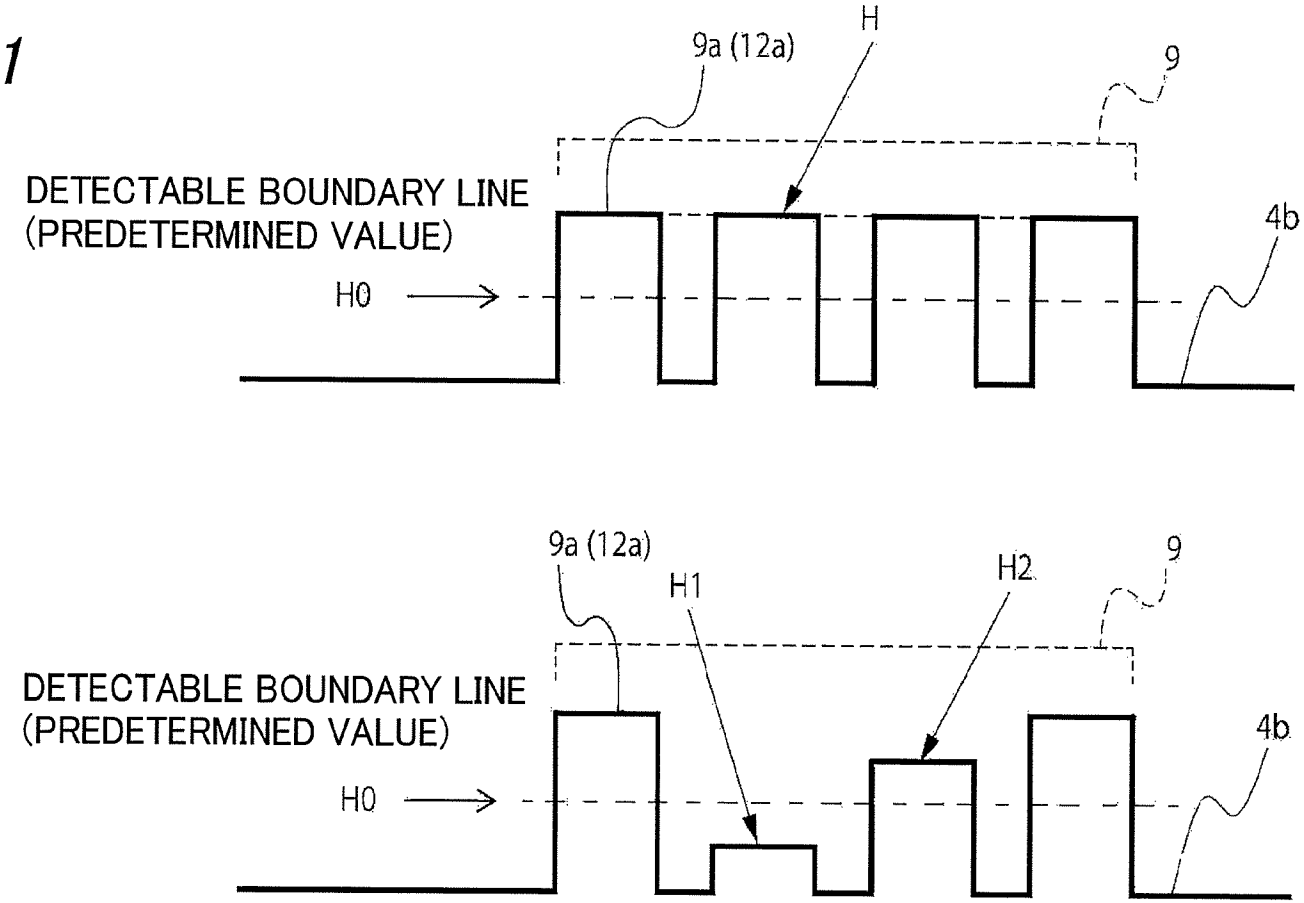
FIG. 21 is an explanatory diagram for describing a case where the information display portion is detected using an optical sensor.

FIG. 21 is an explanatory diagram for describing a case where the protrusions 9*a* and 12*a* of the first and second information display portions 9 and 12 are detected by the photointerrupter (an optical sensor). As illustrated in FIG. 21, the photointerrupter detects the protrusions 9*a* and 12*a*, and is configured such that the protrusions 9*a* and 12*a* having no height equal to or more than a predetermined value (H0) is not detected in order to prevent an erroneous detection. Therefore, in a case where the height of the protrusions 9*a* and 12*a* is less than a predetermined value (for example, H1) even when the protrusions are in a detecting region, the height is not detected. In a case where the height is equal to or more than a predetermined value (for example, H2), the detection is performed. In this embodiment, the predetermined value (H0) is about a half (½) of the height of the protrusions 9*a* and 12*a*. In a case where the height of the protrusion is less than the half (½), the subject protrusion is not detected. However, the half (½) is described as merely exemplary, and the reference value is not limited thereto.

The type of the wire is specified and identified by processing the output signals of the two photointerrupters (for example, by combining the output signal of the first information display portion 9 and the output signal of the second information display portion 12). An appropriate drive control can be performed according to the type of the wire.

In the reel 1 and the wire supply body 100 according to this embodiment, the visual identification of the first and second information display portions 9 and 12 is a main object. However, as described above, another object is to use the first information display portion 9 and the second information display portion 12 in the control of the reinforcing bar binding machine 102. In this way, since the reinforcing bar binding machine is configured to detect the first information display portion 9 and the second information display portion 12, which are visual identification information, there is no need to provide separate information dedicated for the detection.

Second Embodiment

Figure 22:
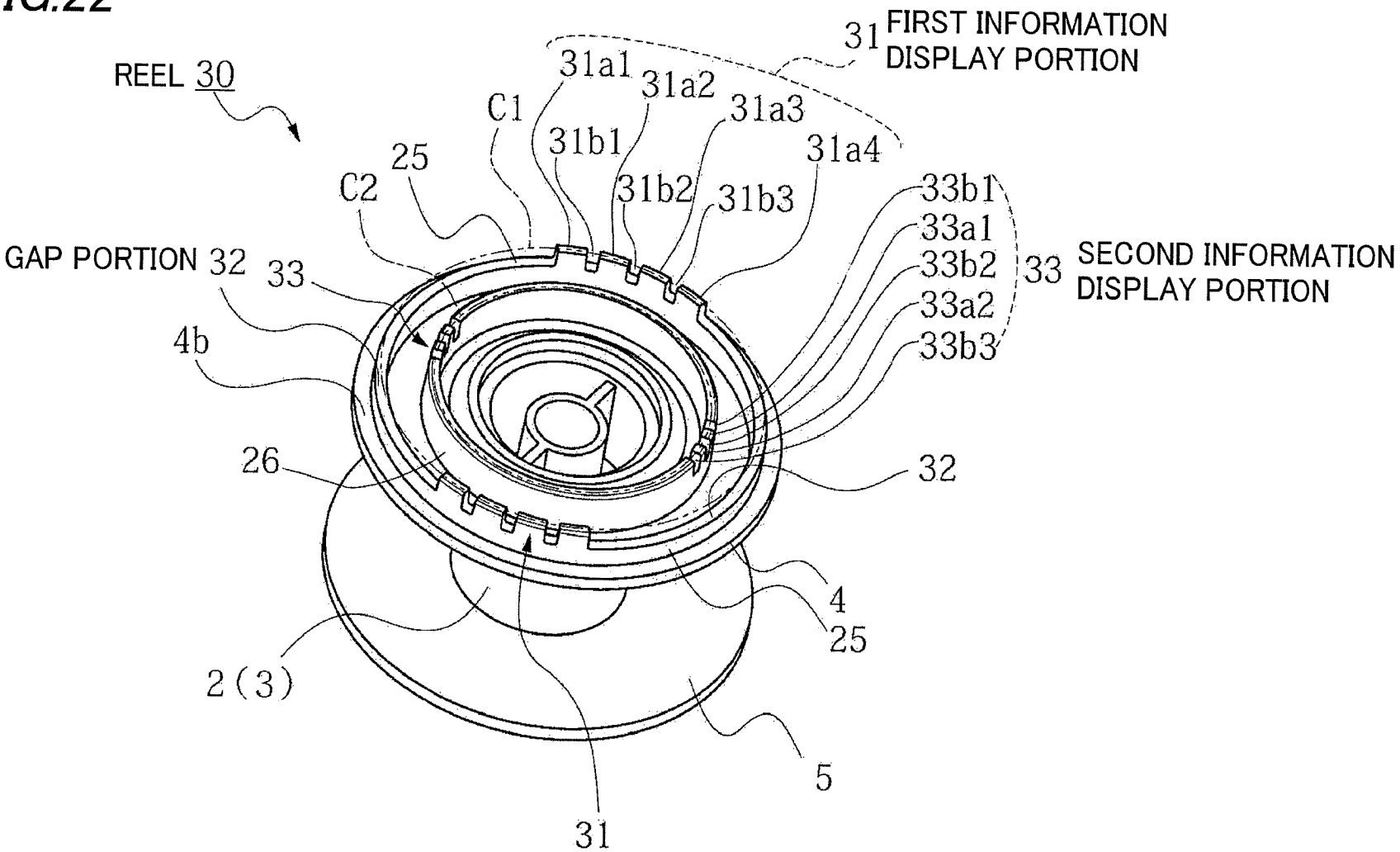
FIG. 22 is a perspective view of an external appearance of a reel according to a second embodiment.
Figure 23:
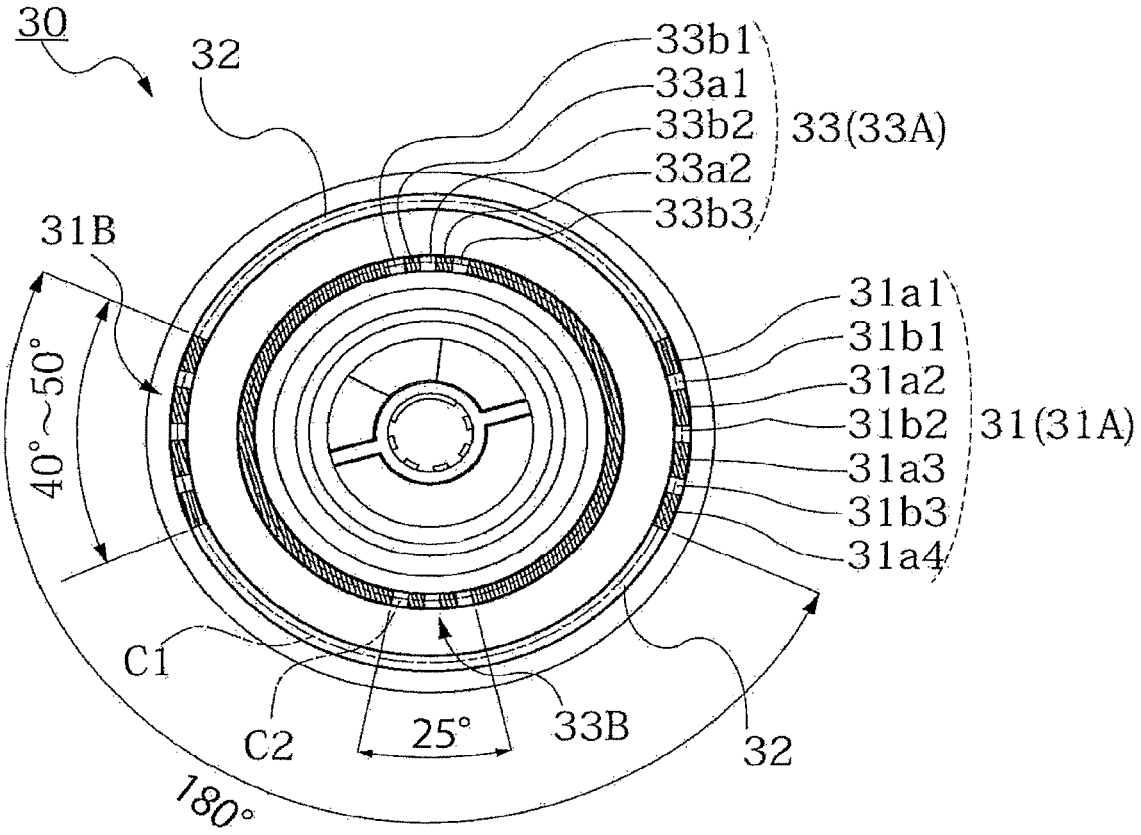
FIG. 23 is a plan view of the reel according to the second embodiment.
Figure 24:
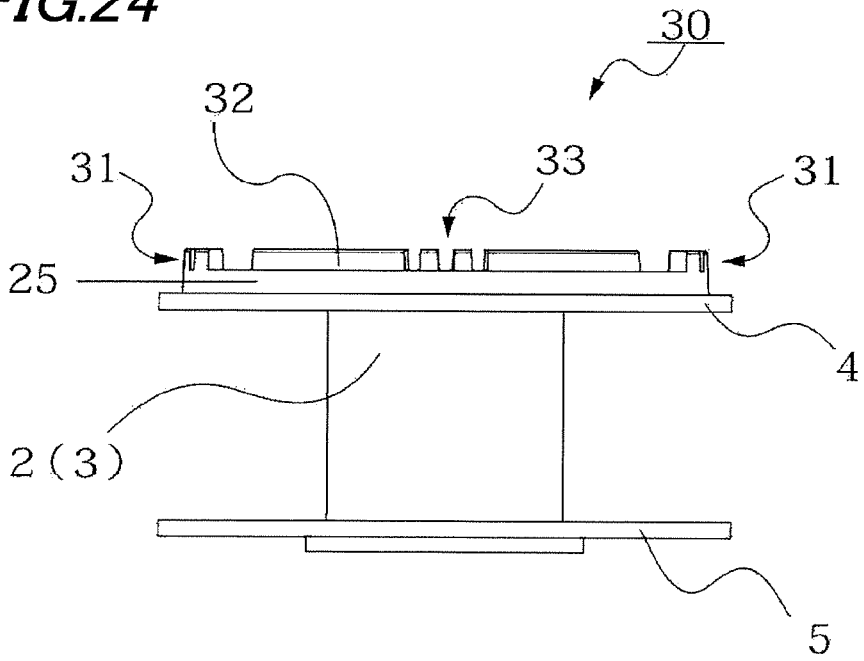
FIG. 24 is a front view the reel according to the second embodiment.
Figure 25:
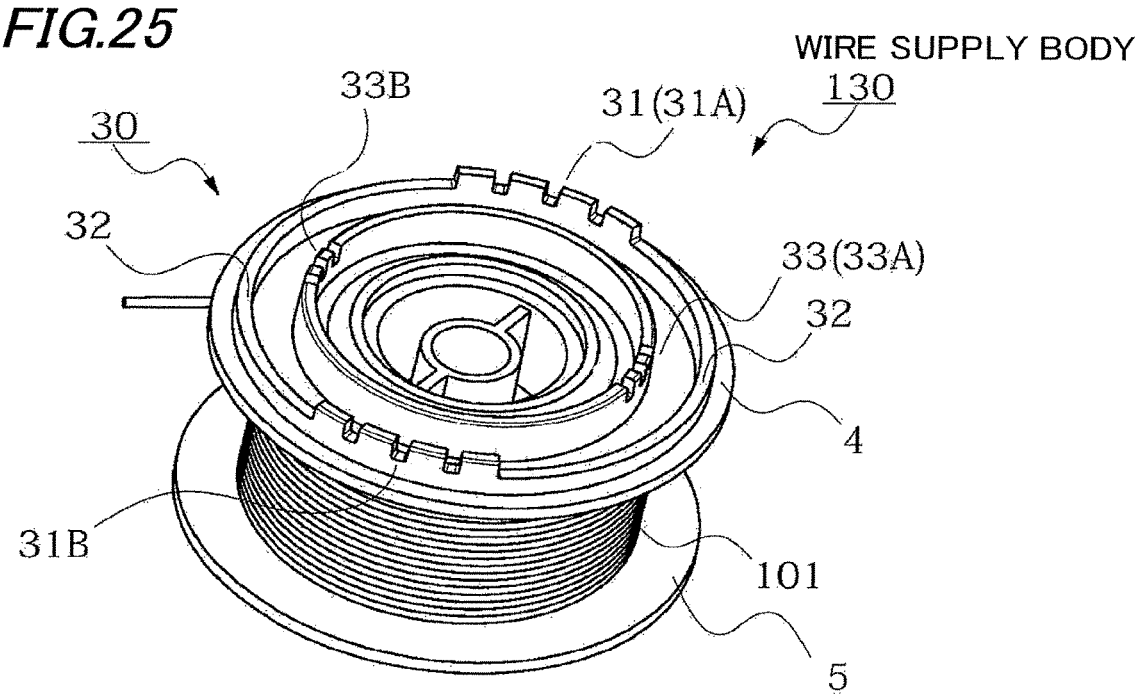
FIG. 25 is a perspective view of an external appearance of a wire supply body according to the second embodiment.

FIGS. 22 to 25 are explanatory diagrams for describing a reel (a reel 30) according to the second embodiment. FIG. 22 is a perspective view of an external appearance of the reel 30 when viewed from the flange 4. FIG. 23 is a plan view of the reel 30 when viewed from the flange 4. FIG. 24 is a front view of the reel 30. FIG. 25 is a perspective view of an external appearance of a wire supply body (a wire supply body 130) according to the second embodiment. In the explanation using FIGS. 22 to 25, the same components as those of the reel 1 and the wire supply body 100 will be denoted with the same symbols, and the description thereof will be omitted.

The reel 30 includes the hub 3 which is a cylindrical shaft having the winding part 2 of the wire in the outer peripheral surface similarly to the reel 1, and a pair of flanges 4 and 5 facing each other with the winding part 2 of the hub 3 interposed therebetween. The reel 30 is different from the reel 1 in the number and the position of first information display portions and second information display portions provided on the surface 4*b* of the flange 4, and the other structures are almost the same.

The reel 30 includes two first information display portions 31 (31A and 31B) configured by four protrusions (shielding bodies) 31*a* (31*a*1, 31*a*2, 31*a*3, and 31*a*4) and three recesses (slits) 31*b* (31*b*1, 31*b*2, and 31*b*3) on the first circumference C1 of the surface 4*b* of the flange 4. The first information display portions 31 are disposed on the first circumference C1 to substantially face each other about the shaft center of the hub 3 interposed therebetween on the first circumference C1. In other words, the first information display portions 31 are disposed about the shaft center of the hub 3 at an about 180-degree interval. The angular range of the first information display portion 31 occupied on the first circumference C1 is from 40 to 50 degrees about the shaft center of the hub 3. The left portion on the first circumference C1 having no first information display portion 31 is a gap portion 32 having no recess and no protrusion. The first information display portion 31 is configured on the annular rib 25 formed integrally with the flange 4. The gap portion 32 is configured only in a portion having no first information display portion 31 in the annular rib 25.

The reel 30 includes two second information display portions 33 (33A and 33B) configured by two protrusions (shielding bodies) 33*a* (33*a*1 and 33*a*2) and three recesses (slits) 33*b* (33*b*1, 33*b*2, and 33*b*3) at 180-degree interval on the second circumference C2 having a diameter smaller than that of the first circumference C1. The angular range of the second information display portion 33 occupied on the second circumference C2 is from 20 to 30 degrees (25 degrees in the example in the drawing) about the shaft center of the hub 3. The left portion on the second circumference C2 having no second information display portion 33 is an annular wall surface having no recess and no protrusion.

The first information display portion 31 and the second information display portion 33 are disposed while the center position is shifted by 90 degrees about the shaft center of the hub 3. The second information display portion 33 is provided in the angular range (130 to 140 degrees as an example) where the gap portion 32 neighboring the first information display portion 31 is provided. With such a configuration, the second information display portion 33 can be visually confirmed through the gap portion 32. In a base portion of the first information display portion 31 and the second information display portion 33, the annular rib 25 and the annular rib 26 are formed integrally to the flange 4 in a continuous annular shape. With this configuration, the strength of the flange 4 can be increased, and the strength against the deformation caused by the winding of the wire and an impact such as dropping is increased.

Third Embodiment

Figure 26:
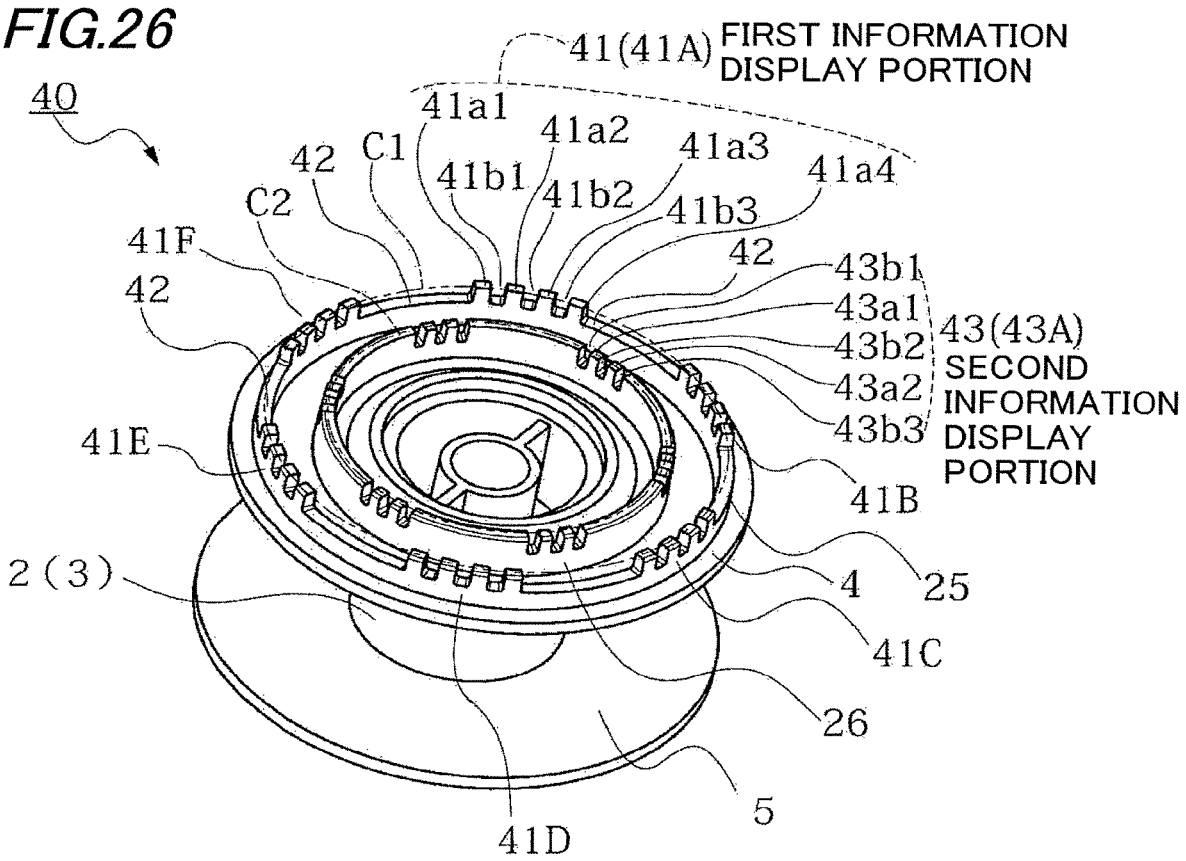
FIG. 26 is a perspective view of an external appearance of a reel according to a third embodiment.
Figure 27:
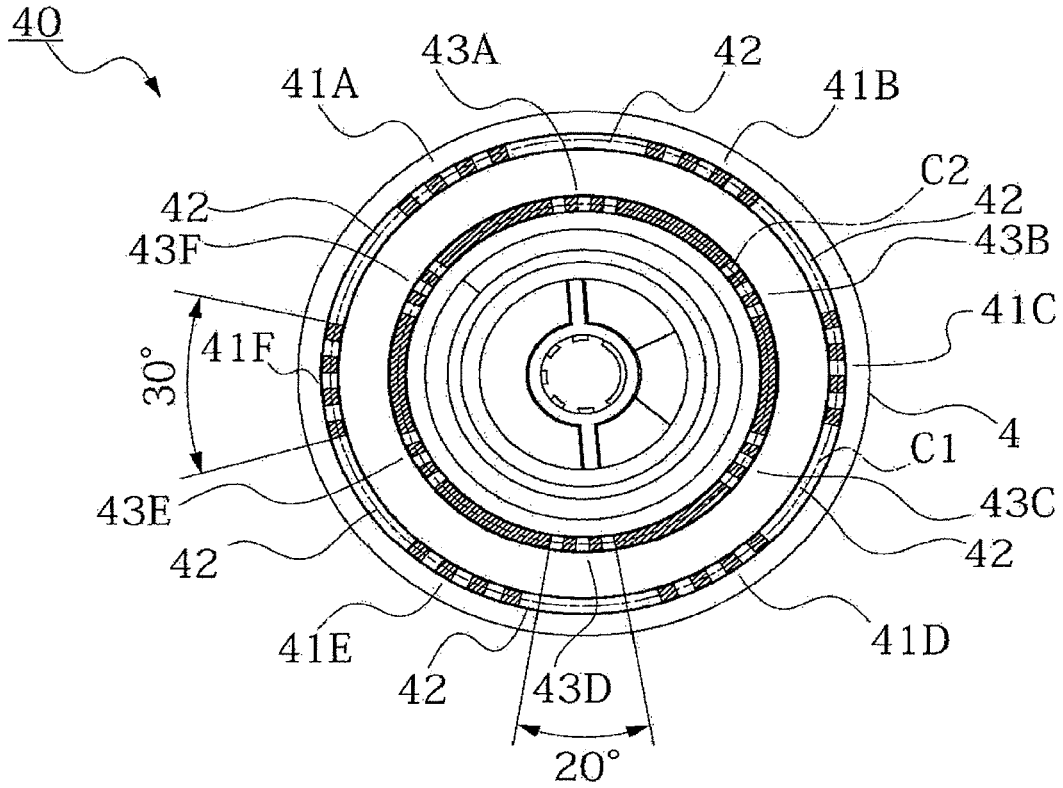
FIG. 27 is a plan view of the reel according to the third embodiment.
Figure 28:
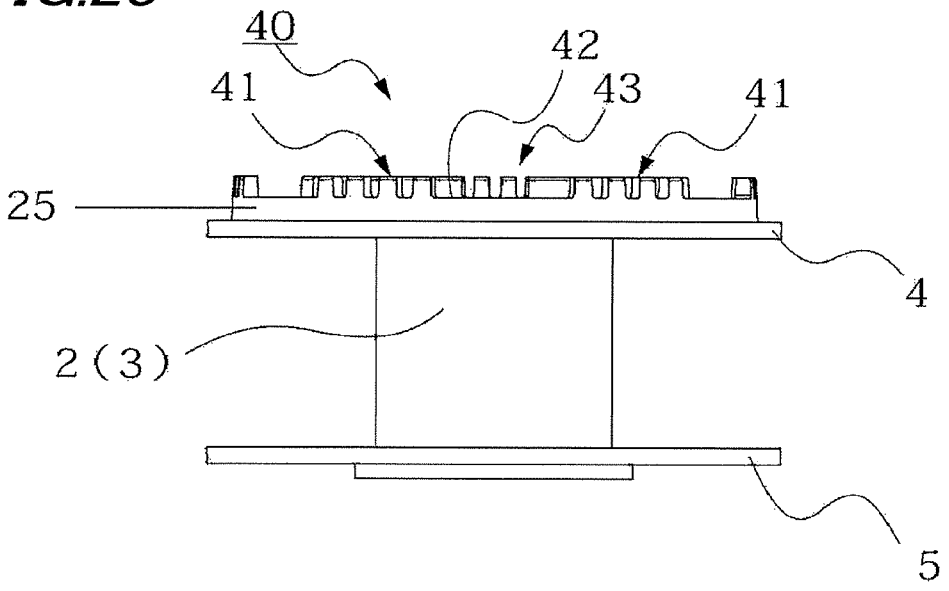
FIG. 28 is a front view of the reel according to the third embodiment.
Figure 29:
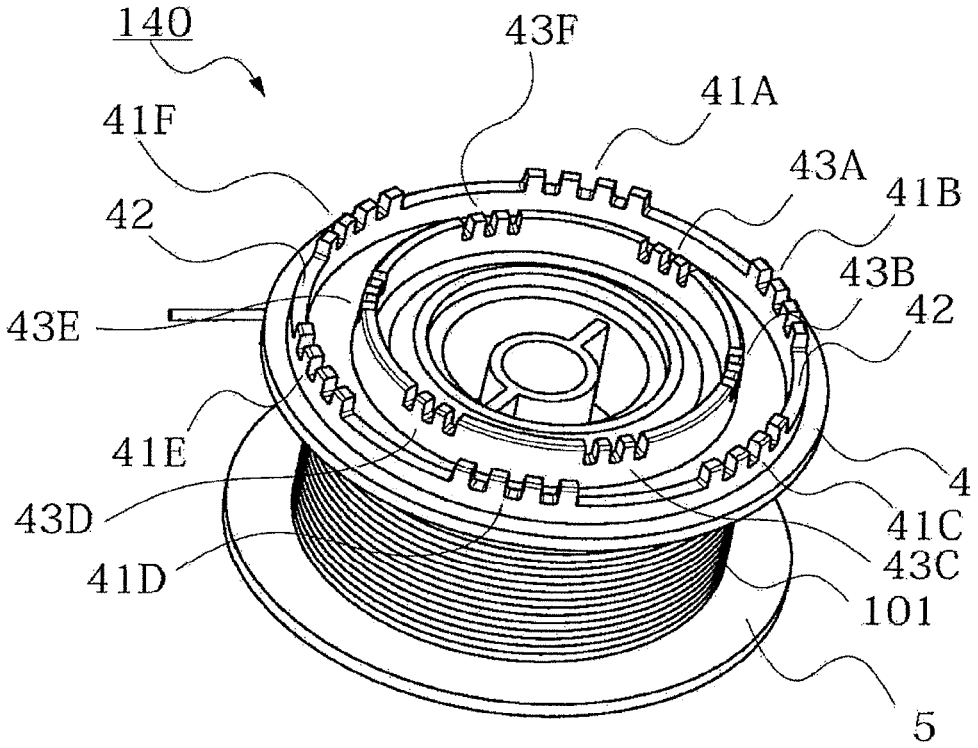
FIG. 29 is a perspective view of an external appearance of a wire supply body according to the third embodiment.

FIGS. 26 to 29 are explanatory diagrams for illustrating a reel (a reel 40) according to the third embodiment. FIG. 26 is a perspective view of an external appearance of the reel 40 when viewed from the flange 4. FIG. 27 is a plan view of the reel 40 when viewed from the flange 4. FIG. 28 is a front view of the reel 40. FIG. 29 is a perspective view of an external appearance of a wire supply body (a wire supply body 140) according to the third embodiment. In the explanation using FIGS. 26 to 29, the same components as those of the reel 1 and the wire supply body 100 will be denoted with the same symbols, and the description thereof will be omitted.

The reel 40 includes the hub 3 which is a cylindrical shaft having the winding part 2 of the wire in the outer peripheral surface similarly to the reel 1, and a pair of flanges 4 and 5 facing each other with the winding part 2 of the hub 3 interposed therebetween. The reel 40 is different from the reel 1 in the number and the position of first information display portions and second information display portions provided on the surface 4*b* of the flange 4, and the other structures are almost the same.

The reel 40 includes six first information display portions 41 (41A, 41B, 41C, 41D, 41E, and 41F) configured by four protrusions (shielding bodies) 41*a* (41*a*1, 41*a*2, 41*a*3, and 41*a*4) and three recesses (slits) 41*b* (41*b*1, 41*b*2, and 41*b*3) at a 60-degree interval on the first circumference C1. The angular range of the first information display portion 41 occupied on the first circumference C1 is substantially about 30 degrees obtained by dividing the circumference into twelve equal parts. The left portion on the first circumference C1 is a gap portion 42 having no recess and no protrusion. The first information display portion 41 is configured on the annular rib 25 formed integrally with the flange 4. The gap portion 42 is configured only in a portion having no first information display portion 41 in the annular rib 25.

The reel 40 includes six second information display portions 43 (43A, 43B, 43C, 43D, 43E, and 43F) configured by two protrusions (shielding bodies) 43*a* (43*a*1 and 43*a*2) and three recesses (slits) 43*b* (43*b*1, 43*b*2, and 43*b*3) at an 60-degree interval on the second circumference C2 having a diameter smaller than that of the first circumference C1.

The angular range of the second information display portion 43 occupied on the second circumference C2 is from 15 to 25 degrees (20 degrees in the example in the drawing) about the shaft center of the hub 3. The left portion on the second circumference C2 having no second information display portion 43 is an annular wall surface having no recess and no protrusion.

The first information display portion 41 and the second information display portion 43 are disposed while the phase is shifted by 30 degrees. The second information display portion 43 is provided in the angular range (30 degrees as an example) where the gap portion 42 neighboring the first information display portion 41 is provided. With such a configuration, the second information display portion 43 can be visually confirmed by the gap portion 42 neighboring the first information display portion 41. In a base portion of the first information display portion 41 and the second information display portion 43, there are provided the annular rib 25 and the annular rib 26 formed in a continuous annular shape. With this configuration, the strength of the flange 4 can be increased, and the strength against the deformation caused by the winding of the wire and an impact such as dropping is increased.

Fourth Embodiment

Figure 30:
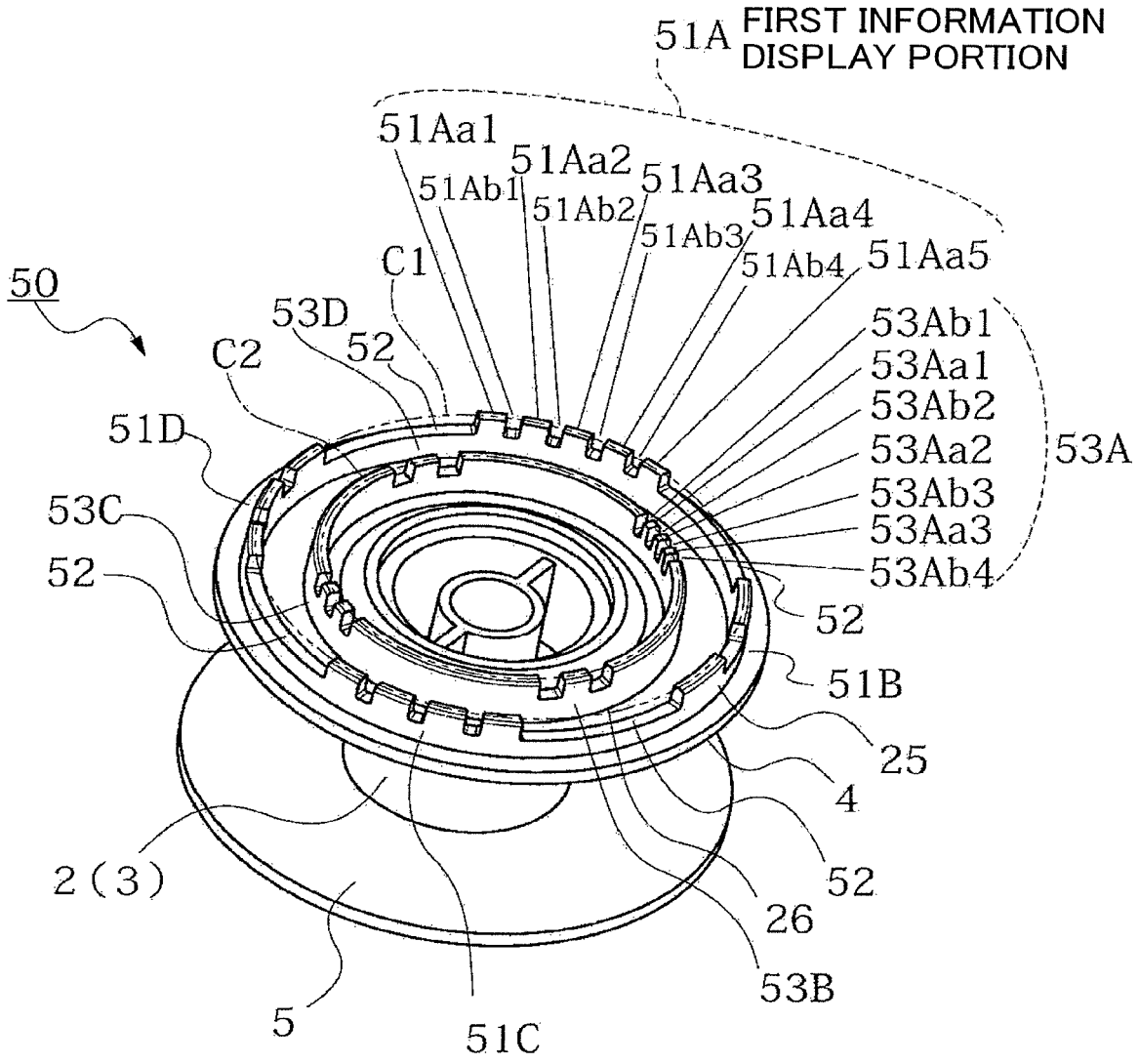
FIG. 30 is a perspective view of an external appearance of a reel according to a fourth embodiment.
Figure 31:
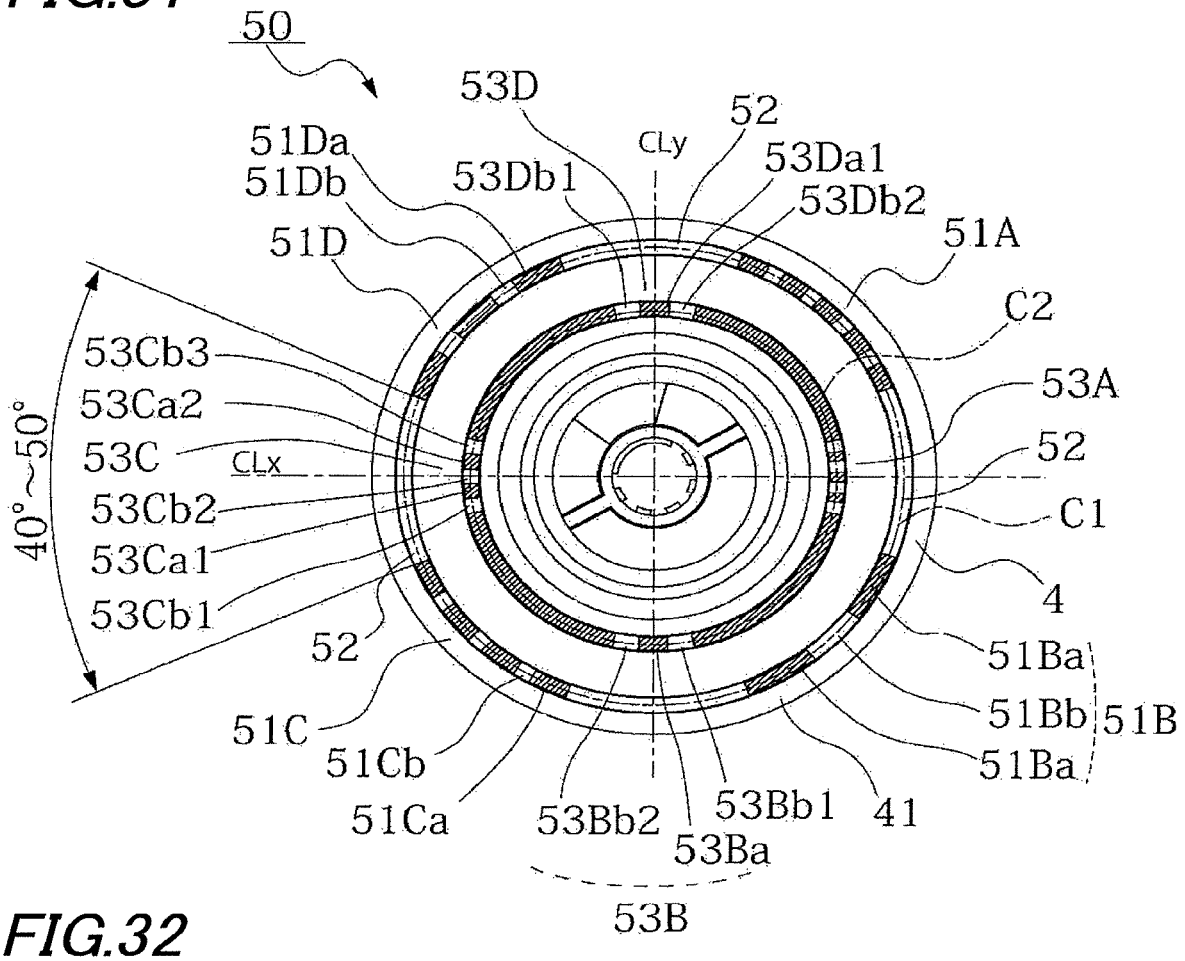
FIG. 31 is a plan view of the reel according to the fourth embodiment.
Figure 32:
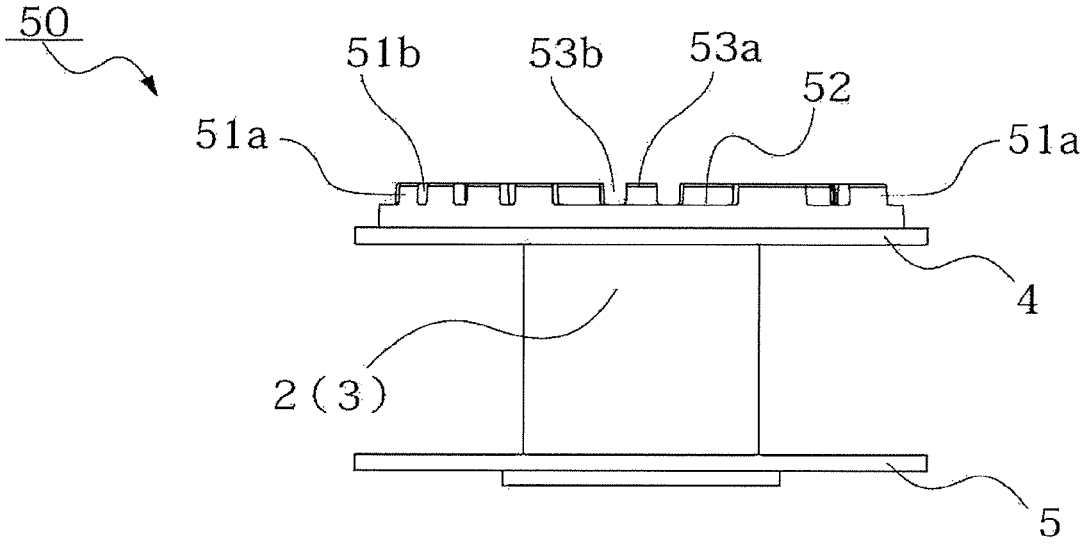
FIG. 32 is a front view of the reel according to the fourth embodiment.
Figure 33:
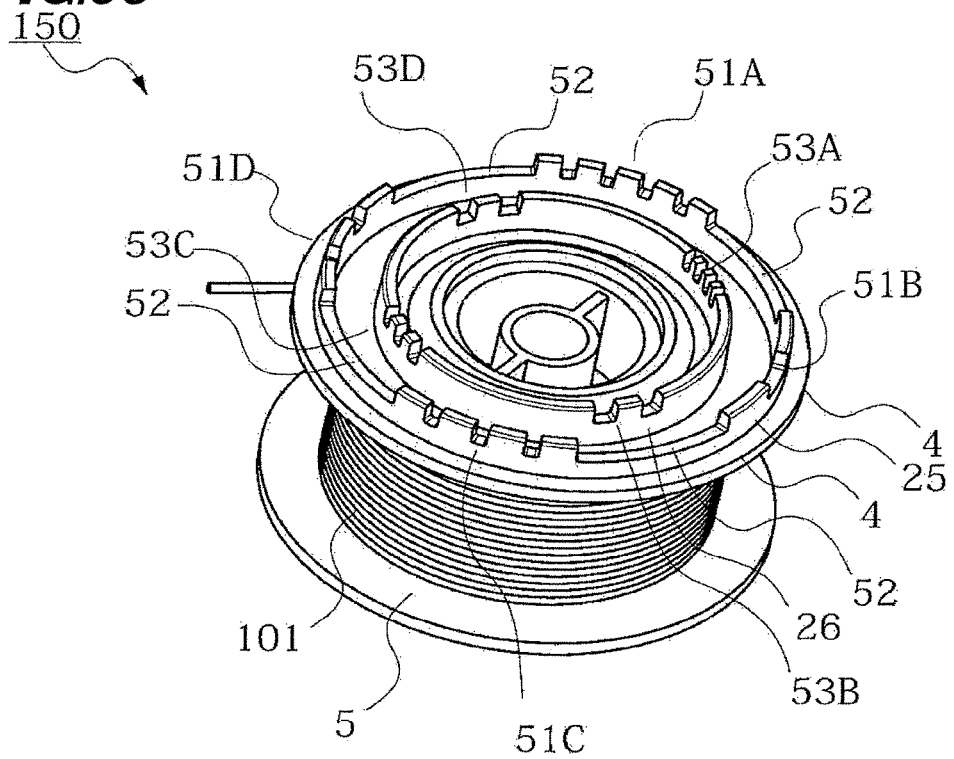
FIG. 33 is a perspective view of an external appearance of a wire supply body according to the fourth embodiment.

FIGS. 30 to 33 are explanatory diagrams for describing a reel (a reel 50) according to the fourth embodiment. FIG. 30 is a perspective view of an external appearance of the reel 50 when viewed from the flange 4. FIG. 31 is a plan view of the reel 50 when viewed from the flange 4. FIG. 32 is a front view of the reel 50. FIG. 33 is a perspective view of an external appearance of a wire supply body (a wire supply body 150) according to the fourth embodiment. In the explanation using FIGS. 30 to 33, the same components as those of the reel 1 and the wire supply body 100 will be denoted with the same symbols, and the description thereof will be omitted.

The reel 50 includes the hub 3 which is a cylindrical shaft having the winding part 2 of the wire in the outer peripheral surface similarly to the reel 1, and a pair of flanges 4 and 5 facing each other with the winding part 2 of the hub 3 interposed therebetween. The reel 50 is different from the reel 1 in the shape of the first information display portion and the second information display portion provided in the side surface of the flange 4.

The reel 50 includes four first information display portions 51 (51A, 51B, 51C, and 51D) on the first circumference C1 of the surface 4*b* of the flange 4. These four first information display portions 51 (51A, 51B, 51C, and 51D) are provided in a different shape. Specifically, a protrusion (shielding body) 51*a* and a recess (slit) 51*b* are differently set in number and width for every first information display portion 51. In this embodiment, for example, the first information display portion 51A is configured by five protrusions 51Aa (51Aa1 to 51Aa5) and four recesses 51Ab (51Ab1 to 51Ab4) provided between the protrusions 51Aa. The first information display portion 51B is configured by two protrusions 51Ba and one recess 51Bb provided between the protrusions 51Ba. The first information display portion 51C is configured by four protrusions 51Ca and three recesses 51Cb provided between the protrusions 51Ca. The first information display portion 51D is configured by three protrusions 51Da and two recesses 51Db provided between the protrusions 51Da.

The respective first information display portions 51 are integrally configured on the annular rib 25 which is integrally formed with the flange 4. A gap portion 52 is configured only in a portion having no first information display portion 51 in the annular rib 25. The angular range of the gap portion 52 occupied on the first circumference C1 (an opening angle about the shaft center of the hub 3) is from 40 to 50 degrees, similar to the reel 1. In a case where the gap portion 52 and the respective first information display portions 51 are disposed by an equal length, 45 degrees about the shaft center of the hub 3 is optimal as an angle occupied by the length of each portion.

The reel 50 includes second information display portions 53 (53A, 53B, 53C, and 53D) which are configured by a protrusion (shielding body) 53*a* and a recess (slit) 53*b* disposed along the second circumference C2 having a diameter smaller than that of the first circumference C1. Each second information display portion 53 includes a different number of protrusions 53*a* and recesses 53*b*. The second information display portion 53A includes three protrusions 53Aa (53Aa1, 53Aa2, and 53Aa3) and four recesses 53Ab (53Ab1, 53Ab2, 53Ab3, and 53Ab4) provided on both sides of each protrusion 53Aa. The second information display portion 53B includes one protrusion 53Ba (53Ba1) and two recesses 53Bb (53Bb1 and 53Bb2) provided on both sides of the protrusion 53Ba. The second information display portion 53C includes two protrusions 53Ca (53Ca1 and 53Ca2) and three recesses 53Cb (53Cb1, 53Cb2, and 53Cb3) provided on both sides of the protrusion 53Ca. The second information display portion 53D includes one protrusion 53Da (53Da1) and two recesses 53Db (53Db1 and 53Db2) provided on both sides of the protrusion 53Da. The widths of the protrusion 53*a* and the recess 53*b* of each second information display portion 53 are adjusted according to the number of protrusions 53*a* and recesses 53*b* such that the length of each second information display portion 53 is roughly uniform. The angular range of the second information display portion 53 occupied on the second circumference C2 about the shaft center of the hub 3 is formed smaller than about 45 degrees obtained by dividing the second circumference C2 into eight equal parts. The left portion of the second information display portion 53 is a continuous shielding portion formed integrally with the annular rib 26 as a continuous wall having the same height as that of the other shielding body.

The first information display portion 51 and the second information display portion 53 are disposed while the phase is shifted by about 45 degrees. The gap portion 52 neighboring the first information display portion 51 and the angular range where the second information display portion 53 is provided are substantially matched. With such a configuration, the second information display portion 53 disposed on the inside can be visually confirmed through the gap portion 52 disposed on the outside. In a base portion of the first information display portion 51 and the second information display portion 53, there are provided the annular rib 25 and the annular rib 26 formed integrally to the flange 4 in a continuous annular shape. With this configuration, the strength of the flange 4 can be increased, and the strength against the deformation caused by the winding of the wire and an impact such as dropping is increased.

Fifth Embodiment

Figure 35:
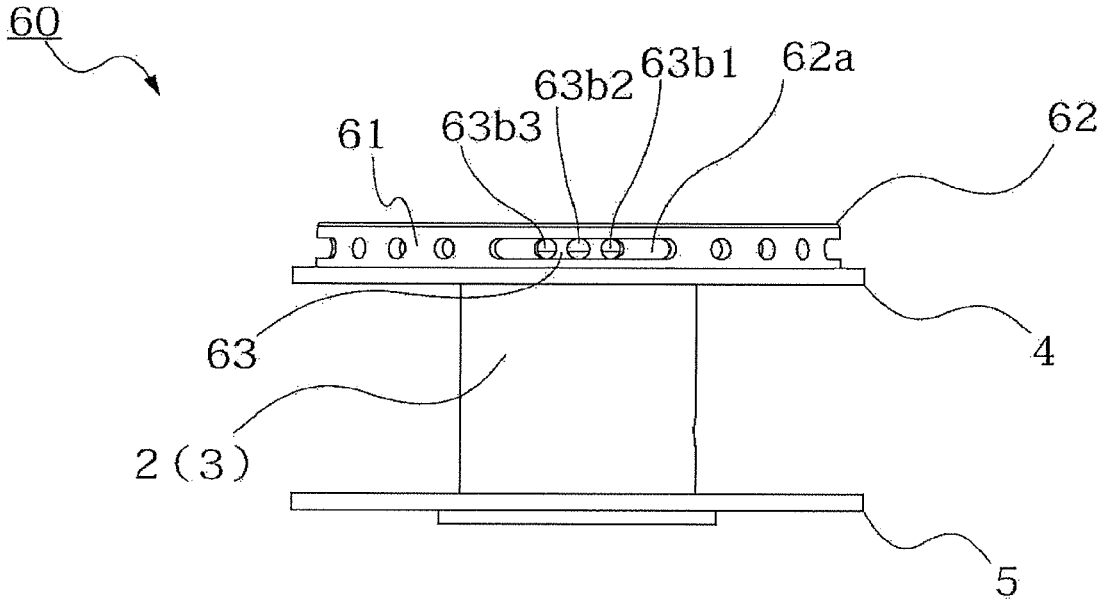
FIG. 35 is a front view of the reel according to the fifth embodiment.
Figure 36:
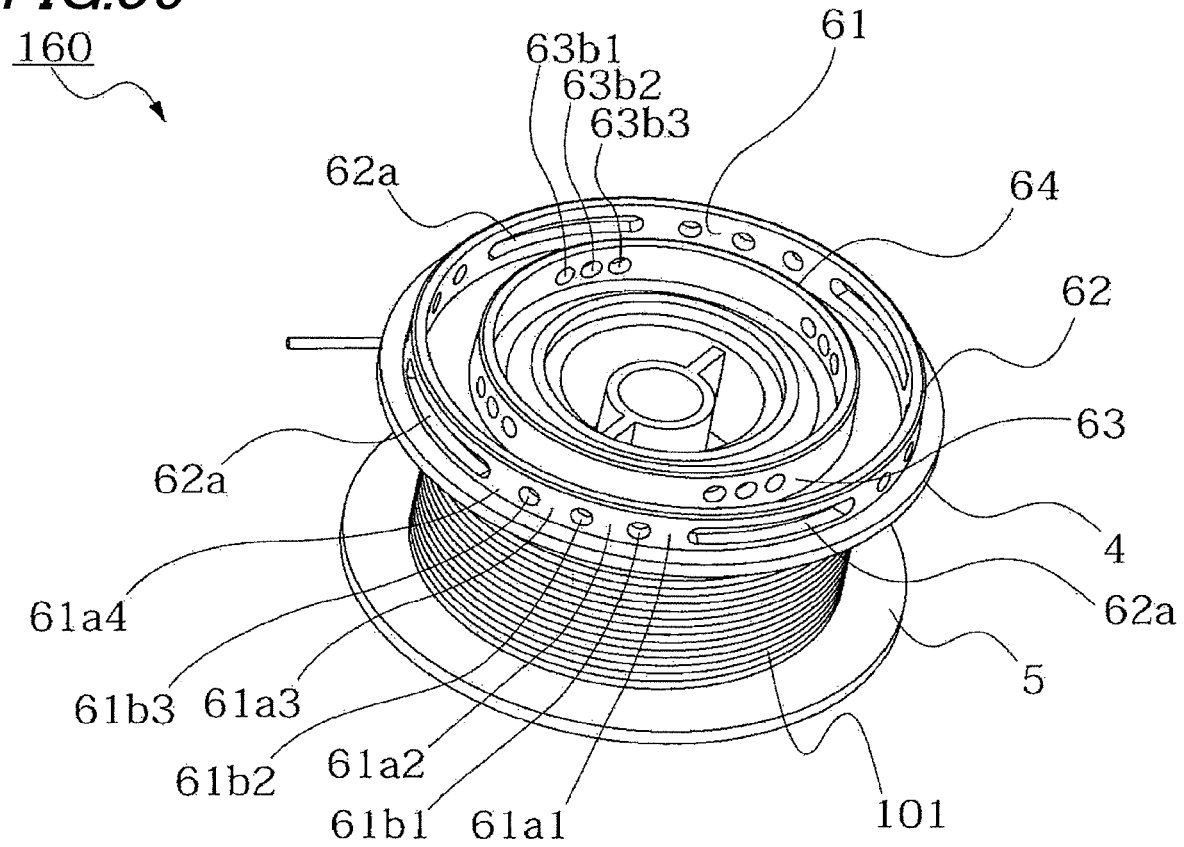
FIG. 36 is a perspective view of an external appearance of a wire supply body according to the fifth embodiment.

FIGS. 34 to 36 are explanatory diagrams for describing a reel (a reel 60) according to the fifth embodiment. FIG. 34 is a perspective view of an external appearance of the reel 60 when viewed from the flange 4. FIG. 35 is a front view of the reel 60. FIG. 36 is a perspective view of an external appearance of a wire supply body (a wire supply body 160) according to the fifth embodiment. In the explanation using FIGS. 34 to 36, the same components as those of the reel 1 and the wire supply body 100 will be denoted with the same symbols, and the description thereof will be omitted.

The reel 60 includes the hub 3 which is a cylindrical shaft having the winding part 2 of the wire in the outer peripheral surface similarly to the reel 1, and a pair of flanges 4 and 5 facing each other with the winding part 2 of the hub 3 interposed therebetween. The reel 60 is different from the reel 1 in the number of first information display portions and second information display portions provided on the surface 4*b* of the flange 4, and the other structures are almost the same.

The reel 60 includes four first information display portions 61 on the first circumference or circle C1 of the surface 4*b* of the flange 4. The first information display portion 61 is provided in an annular wall 62 which is erected as a continuous wall member on the first circumference C1. In the annular wall 62 (or first wall), there are formed a plurality of circular holes (openings or apertures) 61*b* and long holes 62*a* which pass through the wall surface in the circumferential direction. Specifically, the long holes (or elongated apertures) 62*a* are formed in the wall surface of the annular wall 62 at a predetermined interval in the circumferential direction. Three circular holes or first apertures 61*b* (61*b*1, 61*b*2, and 61*b*3) are disposed at an equal interval between the long holes 62*a*. Then, a region (a portion where the long hole 62*a* and the long hole 62*a* are interposed) between adjacent two long holes 62*a* in the annular wall 62 becomes the first information display portion 61.

Therefore, a wall surface portion (or wall section) 61*a*1 between one long hole 62*a* defining one end of the first information display portion 61 and the circular hole 61*b*1 neighboring the long hole 62*a*, a wall surface portion 61*a*2 between the circular hole 61*b*1 and the circular hole 61*b*2, a wall surface portion 61*a*3 (or first wall sections) between the circular hole 61*b*2 and the circular hole 61*b*3 (or first apertures), and a wall surface portion 61*a*4 (or first wall sections) between the other long hole (or elongated aperture) 62*a* defining the other end of the first information display portion 61 and the circular hole 61*b*3 neighboring the long hole 62*a* correspond respectively to the protrusions or first projections 9*a* (9*a*1, 9*a*2, 9*a*3, and 9*a*4) which is the first information display portion 9 of the reel 1. Then, three circular holes 61*b* (61*b*1, 61*b*2, and 61*b*3) or first apertures of the first information display portion 61 correspond respsectively to the recesses 9*b* (9*b*1, 9*b*2, and 9*b*3) which is the first information display portion 9 of the reel 1. The circular hole 61*b* is not necessarily limited to the circular shape, and for example may be a hole such as a polygonal shape.

The reel 60 includes four second information display portions 63 formed on the second circumference C2 having a diameter smaller than that of the first circumference or circle C1. The second information display portion 63 is provided in an annular wall 64 which is erected as a continuous wall member on the second circumference C2. In the annular wall 64, there are formed twelve circular holes (holes) 63*b* passing through the wall surface in the circumferential direction. Specifically, four sets of circular holes 63*b* (63*b*1, 63*b*2, and 63*b*3) or second apertures are formed in the wall surface of the annular wall 64 at an equal interval. Then, a region of three circular holes (or apertures) 63*b* (that is, a region or second wall sections 63*a*1, 63*a*2 interposed by the circular holes 63*b* on both end sides among three circular holes or second apertures 63*b*) in the annular wall 64 (or second wall sections) becomes the second information display portion 63.

Therefore, three circular holes 63*b* (63*b*1, 63*b*2, and 63*b*3) of the second information display portion 63 correspond respsectively to the recesses 12*b* (12*b*1, 12*b*2, and 12*b*3) which is the second information display portion 12 of the reel 1. Wall surface portions 63*a* (63*a*1 and 63*a*2) of the annular wall 64 interposed by the circular hole 63*b* (the circular holes 63*b*1 and 63*b*2, and 63*b*2 and 63*b*3) correspond to the protrusions 12*a* (12*a*1 and 12*a*2) which is the second information display portion 12 of the reel 1. The circular hole 63*b* is not necessarily limited to a circular shape, and for example may be an elliptical shape or a polygonal shape.

The first information display portion 61 is disposed in a region interposed between an extension of a line segment connecting the end of one second information display portion 63 among the adjacent two second information display portions 63 and the shaft center of the hub 3 and an extension of a line segment connecting the end of the other second information display portion 63 and the shaft center of the hub 3. Therefore, four first information display portions 61 are disposed on the first circumference or circle C1, and exactly not overlapped with the second information display portion 63 in the radial direction of the surface 4*b* of the flange 4. In other words, the first information display portion 61 and the second information display portion 63 are not disposed on the same diameter in the surface 4*b* of the flange 4. The expression "the end of the second information display portion 63" means the end on the outside of the circular hole (or aperture) 63*b* (63*b*1 or 63*b*3 or second apertures) positioned at the outermost end of the second information display portion 63.

On the other hand, the second information display portion 63 is disposed in a region surrounded by both inner ends of the adjacent two first information display portions 61 (the ends on sides where the adjacent first information display portions 61 face each other) and the shaft center of the hub 3. Therefore, four second information display portions 63 are disposed on the second circumference C2 in order not to be exactly overlapped with the first information display portion 61 in the radial direction of the surface 4*b* of the flange 4. The expression "both inner ends of the first information display portion 61" means the inner ends of the adjacent two long holes 62*a* defining the first information display portion 61.

In the annular wall 62, the long hole 62*a* (or elongated aperture) is formed between the first information display portion 61 and the first information display portion 61. The long hole 62*a* (or elongated aperture) is disposed (opened) to be overlapped with the second information display portion 63 when the flange 4 is viewed from the lateral direction. In other words, the long hole 62*a* corresponds to the gap portion 10 of the annular rib 25 or wall in the reel 1. The second information display portion 63 can be visually confirmed from the long hole 62*a* when the flange 4 is viewed from the lateral direction. Since the long hole (elongated aperture) 62*a* is formed to be overlapped with the second information display portion 63 at an equal interval in the circumferential direction, the second information display portion 63 can be visually confirmed even in any lateral direction of the flange 4. It is a matter of course that the first and second information display portions 61 and 63 can be detected by an optical sensor provided in the reinforcing bar binding machine body similar to the first and second information display portions 9 and 12.

Sixth Embodiment

Next, a reel 70 according to another embodiment will be described.

Figure 37:
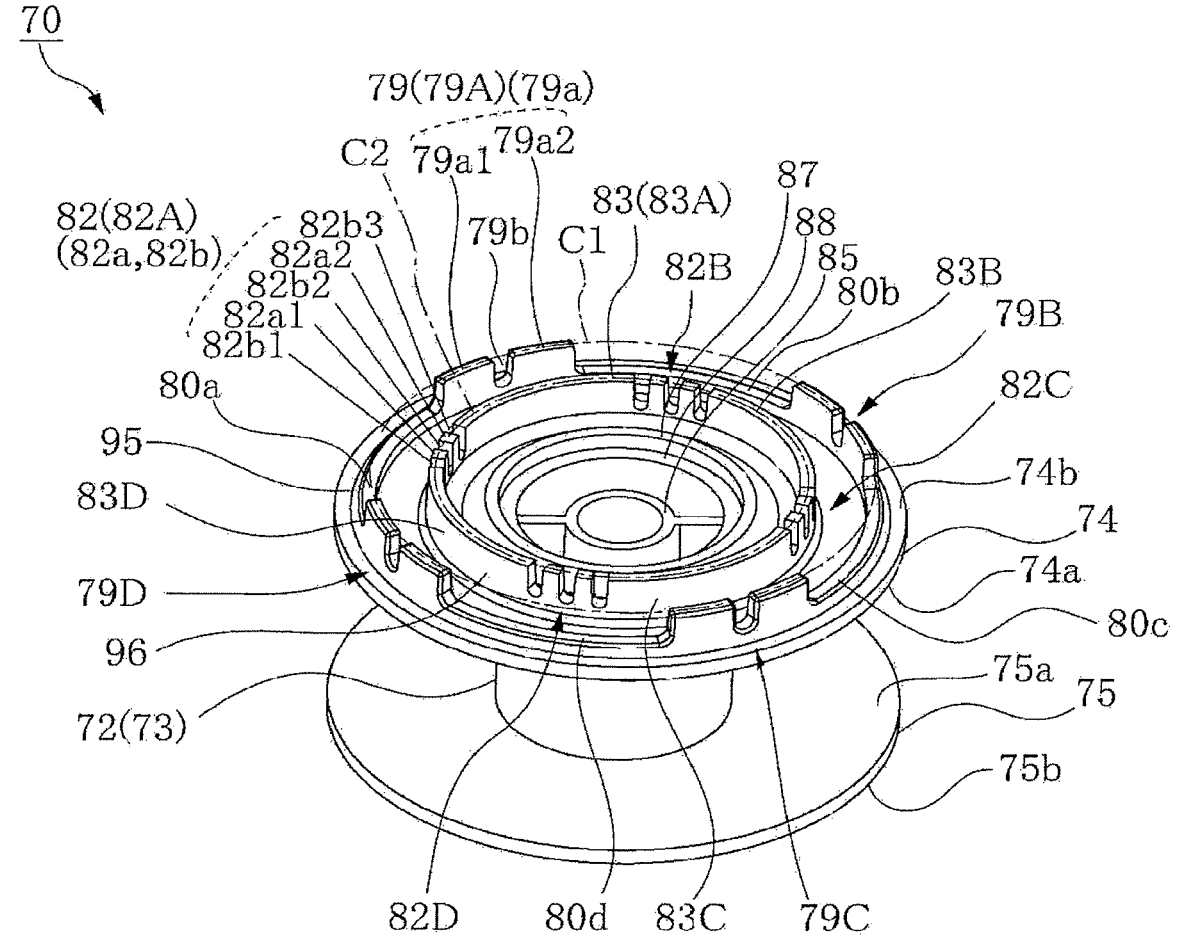
FIG. 37 is a perspective view of an external appearance of a reel according to a sixth embodiment when viewed from one side.
Figure 38:
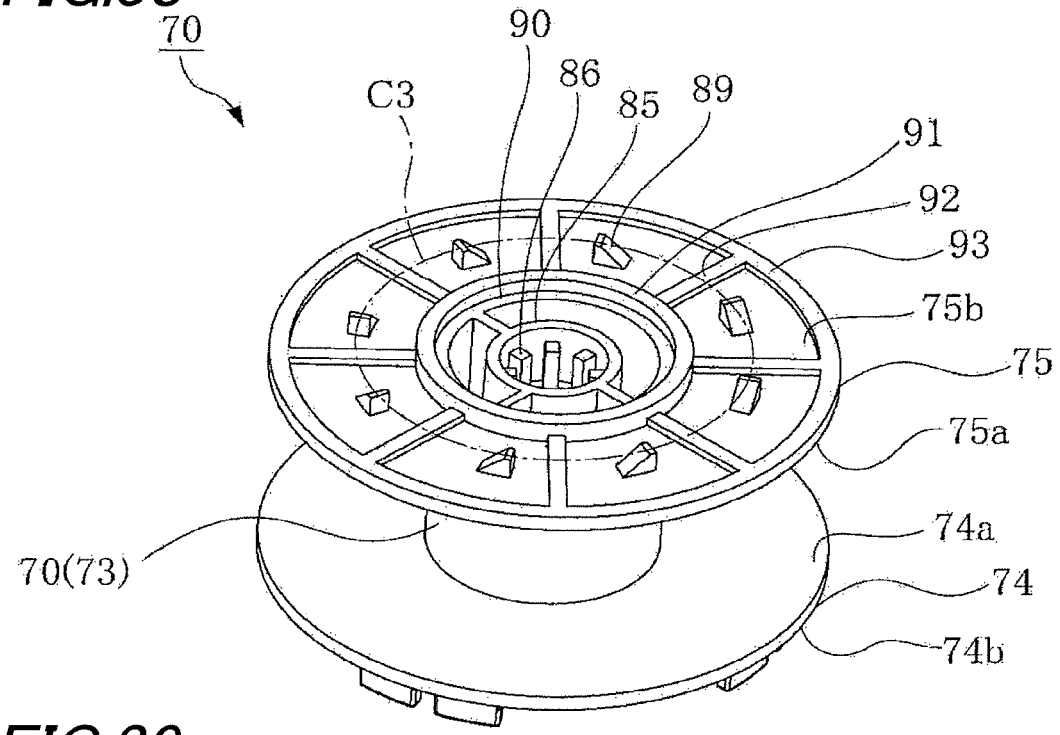
FIG. 38 is a perspective view of an external appearance of the reel according to the sixth embodiment when viewed from the other side.
Figure 39:
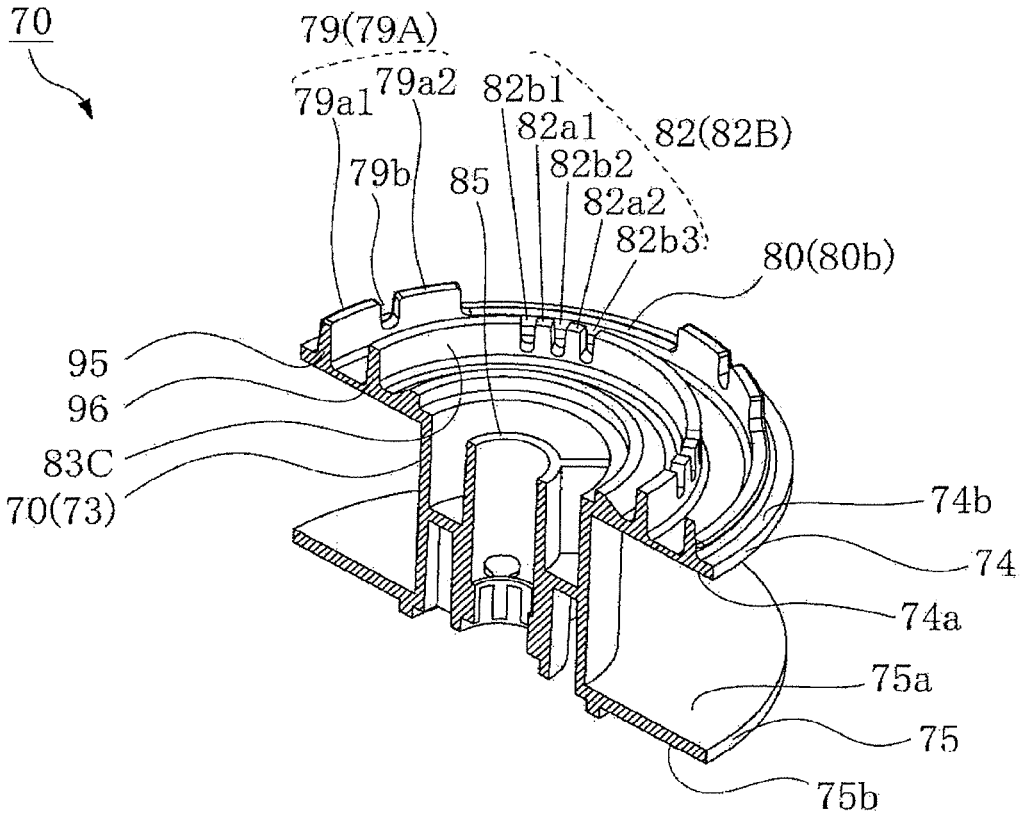
FIG. 39 is a cross-sectional perspective view of the reel according to the sixth embodiment.
Figure 40:
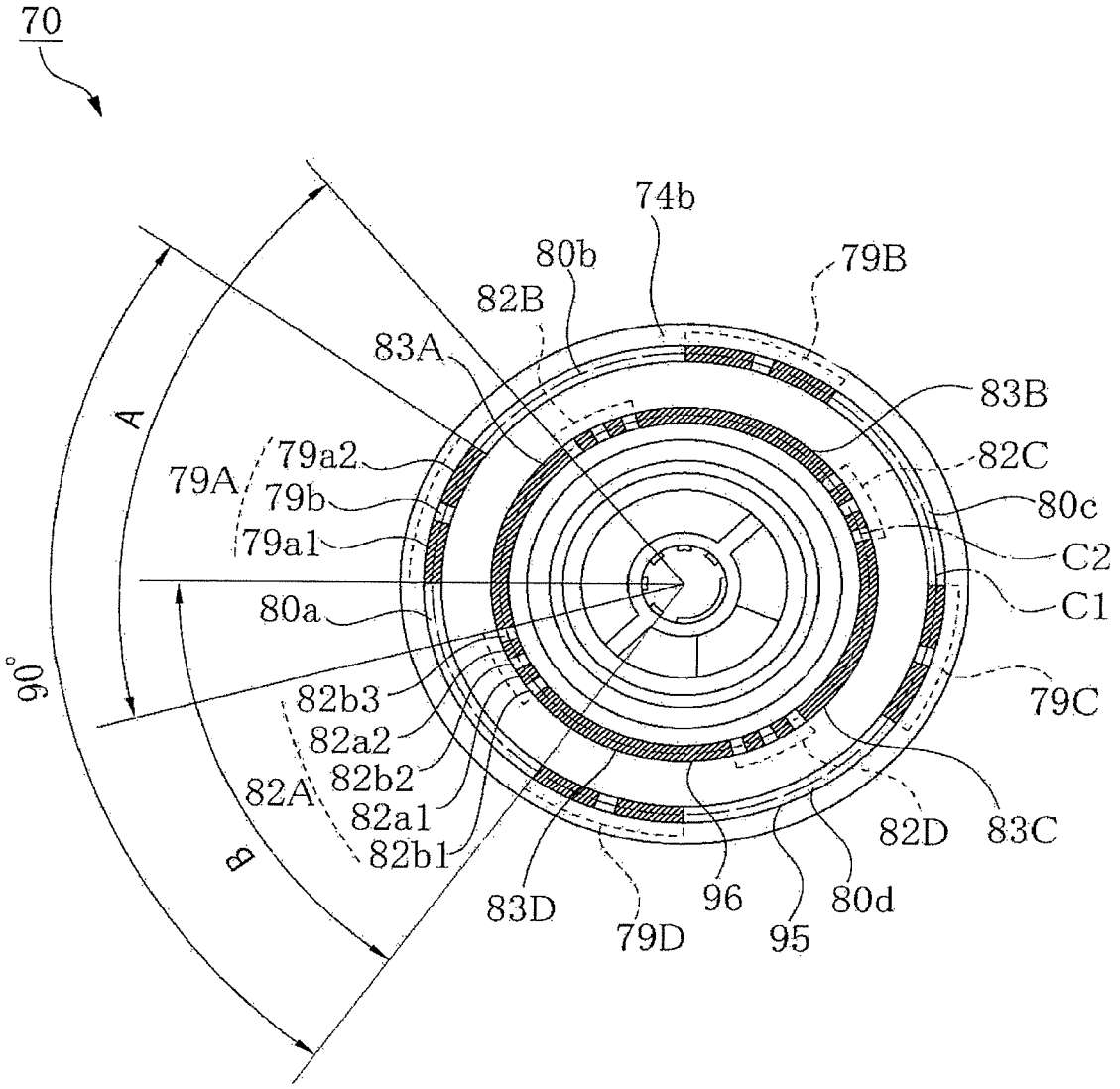
FIG. 40 is an explanatory diagram of an arrangement of a information display portion according to the sixth embodiment.

FIG. 37 is a perspective view of an external appearance of the reel 70 when viewed from a flange 74 on one side. FIG. 38 is a perspective view of an external appearance of the reel when viewed from a flange 75 on the other side. FIG. 39 is a cross-sectional perspective view of the reel 70. FIG. 40 is an explanatory diagram of an arrangement of the information display portion provided in the flange 74.

The reel 70 illustrated in FIGS. 37 to 40 is used to wind and house the wire similarly to the other embodiment, and is formed as a portable reel which can supply the wire to a reinforcing bar binding machine body. The reel 70 includes a cylindrical hub 73 which includes a winding part 72 on which the wire is windable, and a pair of flanges 74 and 75 which are provided on both sides of the hub 73 in an axis direction and include facing surfaces 74*a* and 75*a* facing each other with the winding part 72 interposed therebetween.

The hub 73 is formed as a cylindrical shaft which includes the winding part 72 in the outer peripheral surface, and serves as a rotation center (shaft center) of the reel 70. In the outer peripheral surface of the winding part 72, there is provided a hole which communicates to the inside of the hub 73 (not illustrated). Similarly to the hole 24, the hole is a portion used to insert and fix the end of the wire when the winding starts. The outer diameter of the winding part 72 is set to an extent such that the wound wire is not locally bent and the wire is not strongly wound. The shape of the winding part 72 is not limited to a cylindrical shape, and may be a polygonal shape approximating a circle as long as the local bending is not generated in the wound wire.

The hub 73 has a double cylinder structure, and includes a cylindrical portion 85 formed therein concentrically to the hub 73. In a portion inside the cylindrical portion 85 near the flange 75, there are formed a plurality of teeth 86 shaped as a protrusion, for example. The teeth 86 are used in a case where the reinforcing bar binding machine using the reel 70 includes a spindle which is capable of engaging with the teeth 86. Since there is a reinforcing bar binding machine having no such a spindle, the teeth 86 is not used in that case. The shape of the portion described as the cylindrical portion 85 is not necessarily limited to the cylinder shape, and may be formed in other shapes.

The flanges 74 and 75 are members radially extending in a disk shape from both sides of the hub 73, spaced in an axial direction of the hub 73. The flanges 74, 75 extend outwardly in the radial direction, and form a storage space of the wire together with the winding part 72. The flanges 74 and 75 are fixed to the hub 73, and rotate together with the hub 73. The hub 73 and the flanges 74 and 75 are formed as an integrated molded body by injection-molding of a resin material (for example, polypropylene). As the resin material, an ABS resin or polycarbonate may be used.

The disk-shaped portions of the flanges 74 and 75 have a substantially even or constant thickness. However, there is no need to have a constant thickness if the wire is smoothly wound, stored, and pulled out with respect to the hub 73. The outer peripheral shapes of the flanges 74 and 75 are not necessarily circular in shape, and any shape may be employed as long as the flange is rotatable in a state of being stored in the reinforcing bar binding machine body. For example, the flange may have a polygonal shape approximating a perfect circle or a shape equipped with teeth in the outer peripheral surface. The flanges 74 and 75 includes various shapes of ribs and protrusion/recesses in surfaces 74*b* and 75*b* facing the outside (that is, the opposite surfaces of the facing surfaces 74*a* and 75*a*) from a viewpoint of strength support and identification of the type of the wire.

On the surface 74*b* of the flange 74 (that is, one of the flanges 74 and 75 disposed to face each other), first information display portions 79 and second information display portions 82 are formed to identify the type of the wire. The first information display portions 79 are disposed at an equal interval in four places 79A, 79B, 79C, and 79D in the drawing along the first circumference C1 about the shaft center of the hub 73. The second information display portions 82 are disposed at an equal interval in four places 82A, 82B, 82C, and 82D in the drawing along the second circumference C2 having a diameter smaller than that of the first circumference C1 (that is, positioned on the inner side of the first circumference C1).

The first information display portion 79 is configured by a plurality of protrusions 79*a* (79*a*1 and 79*a*2) which extend in the substantially vertical direction with respect to the surface 74*b* of the flange 74, and recesses 79*b* which are formed between the protrusions 79*a*. In this embodiment, the annular rib 95 made of a low wall-shaped member is erected on the first circumference C1. The first information display portion 79 is formed on (the upper surface) the annular rib 95. The protrusion 79*a* is made of a shielding body (plate) of a substantially rectangular shape which is not transmissive, and has a height (a height from the upper surface of the annular rib 95 to the apex of the protrusion 79*a*) and a thickness of several mm. The two protrusions 79*a*1 and 79*a*2 are formed in almost the same shape.

Between one first information display portion 79 and the adjacent other first information display portion 79, gap portions 80 (80*a*, 80*b*, 80*c*, and 80*d*) are provided and serve as an opening when the flange 74 is viewed from a lateral direction (side), that is, when viewed from a direction orthogonal to the shaft center of the hub 73. The depth of the gap portion 80 is formed substantially to be equal to the height of the protrusion 79*a*. In this embodiment, the protrusions 79*a* and the recesses 79*b* are respective formed in the same shape. However, the shape may be changed as needed in a case where an information pattern for the identification of the wire is increased. For example, the widths of the protrusion 79*a* and the recess 79*b* in the circumferential direction may be different from each other. The heights of the protrusions 79*a* and the depths of the recesses 79*b* may be different from each other.

The protrusion 79*a* protrudes from the upper surface of the high annular rib 95 in the above example. The annular rib 95 has an annular plate configured by a continuous wall surface, and increases the strength of the flange 74 in order to prevent the deformation of the flange 74. However, the protrusion 79*a* may protrude from the surface 74*b* of the flange 74 without providing such an annular rib 95.

The second information display portion 82 is configured by a plurality of protrusions 82*a* (82*a*1 and 82*a*2) which extend substantially in the vertical direction with respect to the surface 74*b* of the flange 74, and a plurality of recesses (slits) 82*b* (82*b*1, 82*b*2, and 82*b*3) which are formed between and on both sides of the adjacent protrusions 82*a*. In this embodiment, an annular rib 96 made of a wall-shaped member is erected along the second circumference C2. The second information display portion 82 is integrally formed in the upper surface of the annular rib 96.

The protrusion 82*a* is made of a shielding body (plate) of a substantially rectangular shape which is not transmissive (i.e., not transmissive to light), and has a height (a height from the bottom surface of the recess 82*b* to the apex) and a thickness of several mm. The two protrusions 82*a*1 and 82*a*2 are formed in almost the same shape, and disposed in a predetermined interval. The portion other than the second information display portions 82A, 82B, 82C, and 82D of the annular rib 96 forms shielding bodies 83 (83A, 83B, 83C, and 83D) which is not transmissive by the wall surface formed by the remaining annular rib 96 having the same height as that of protrusion 82.

Since the recess 82*b* is formed in the second information display portion 82 by cutting the annular rib 96 from the upper surface in a slit shape, the upper surface of the protrusion 82*a* is configured to be substantially flush with the upper surface of the annular rib 96.

The upper surface of the protrusion 79*a* formed in the upper surface of the annular rib 95 and the upper surface of the annular rib 96 are configured to be substantially flush with each other with respect to the surface 74*b* of the flange 74. Therefore, the heights of the protrusion 79*a* and the protrusion 82*a* are equal (the height of the annular rib 96).

The shapes of the annular ribs 95 and 96 are not limited to that in the embodiment.

The annular rib 96 is also an annular protrude portion (plate portion) configured by a continuous wall surface similarly to the annular rib 95, and formed integrally to the flange 74. Therefore, the annular rib 96 is formed together with the annular rib 95, so that the strength of the flange 74 can be increased still further.

On the surface 74*b* of the flange 74, there is formed an annular recess 88 which is a circular depressed portion in the center concentrically to the hub 73. Furthermore, an annular boss portion 87 is formed to surround the annular recess 88. The annular recess 88 and the boss portion 87 are rotatably supported by the reinforcing bar binding machine body, also serve as a reinforcing material of the flange 74, and operates to increase the strength of the reel 70 together with the annular ribs 95 and 96.

FIG. 40 is an explanatory diagram for describing an arrangement of the first information display portion 79 and the second information display portion 82 on the surface 74*b* of the flange 74. In FIG. 40, the protrusions 79*a* and 82*a* are illustrated by hatching for the sake of clarity in arrangement of the protrusion 79*a* and the recess 79*b* of the first information display portion 79 and the protrusion 82*a* and the recess 82*b* of the second information display portion 82. As illustrated in FIG. 40, four first information display portions 79 are disposed at an equal interval on the first circumference C1. Four second information display portions 82 are disposed at an equal interval on the second circumference C2. However, there is no need to dispose the first and second information display portions 79 and 82 at an equal interval. The first and second information display portions 79 and 82 may be disposed roughly along the first circumference C1 and the second circumference C2, but not necessarily exactly matched with the respective circumferences C1 and C2.

The first information display portions 79 are disposed one by one about the shaft center of the hub 73 in regions each (an angular range of 90 degrees about the shaft center of the hub 73) obtained by dividing the surface 74*b* of the flange 74 into quarters.

The first information display portion 79 is disposed between the adjacent two second information display portions 82 about the shaft center of the hub 73. In other words, the first information display portion 79 is disposed in a region A which is an angular range interposed between an extension of a line segment connecting the end of one second information display portion 82 and the shaft center of the hub 73 and an extension of a line segment connecting the end of the other second information display portion 82 and the shaft center of the hub 73.

Therefore, four first information display portions 79 are disposed on the first circumference C1, and not overlapped at all with the second information display portion 82 in the radial direction of the surface 74*b* of the flange 74.

The second information display portions 82 are disposed one by one in the region quartered by 90°. In other words, the second information display portion 82 is disposed in a region B which is an angular range interposed by both inner ends of the adjacent two first information display portions 79 and the shaft center of the hub 73.

The region B is the gap portion (a portion with a gap therein) 80 which is not provided with the first information display portion 79. Therefore, four second information display portions 82 are disposed on the second circumference C2 in order not to be exactly overlapped with the first information display portion 79 in the radial direction of the surface 74*b* of the flange 74. In other words, the first and second information display portions are offset, at least partially, in a circumferential direction.

As described above, on the surface 74*b* of the flange 74, there is provided with the first information display portion 79 at every 90° and the second information display portion 82 which is disposed in the gap portion 80 between the adjacent first information display portions 79. Therefore, in the reel 70, there is formed an information set at every 90° which can visually confirm both of the first information display portion 79 and the second information display portion 82 even when viewed from any side. Specifically, there are provided four information such as a set of the first information display portions 79A and 79B and the second information display portion 82B, a set of the first information display portions 79B and 79C and the second information display portion 82C, a set of the first information display portions 79C and 79D and the second information display portion 82D, and a set of the first information display portions 79D and 79A and the second information display portion 82A. The respective information sets can be visually confirmed almost all around the flange 74, so that the reel 70 can be identified.

FIG. 38 is a perspective view of the reel 70 when viewed from the flange 75 opposite to the above-described flange 74 where the information display portion is provided.

The flange 75 is formed in a disk shape. In the center of the surface 75*b*, there are provided an annular recess 90 which is a circular recess formed at a position corresponding to an outer circumferential portion of the hub 73 and concentrically to the hub 73, and an annular first protrusion rib 91 formed to surround the annular recess 90. There are provided a plurality of second protrusion ribs 92 radially extending to the outside in the radial direction from the first protrusion rib 91, and an annular third protrusion rib 93 which is connected to the second protrusion rib 92 and formed along the outer peripheral edge of the surface of the flange 75.

The annular recess 90 and the first protrusion rib 91 serve as portions which are rotatably supported by the reinforcing bar binding machine body. With the first, second, third protrusion ribs 91, 92, and 93, the strength of the flange 75 is increased so as to prevent the deformation. In this embodiment, the description has been made about an example where two annular protrusion ribs 91 and 93 are provided. However, the number of annular protrusion ribs is not limited to two, but may be three or more. The rib may be formed in any other shape including a radially protruding rib 92 as long as the same function is exhibited.

On the surface 75*b* of the flange 75, a plurality of small projections 89 are provided along the third circumference C3 formed concentrically to the hub 73 and has a saw-toothed shape formed in almost the right-angled triangle when the flange 75 is viewed from the lateral direction. In this embodiment, eight small projections 89 each are provided at an equal interval between eight second protrusion ribs 92 disposed at an equal interval.

The small projection 89 is used to prevent the reel 70 from being reversely rotated. Specifically, when the reel 70 is housed in the mounting chamber 106 of the reinforcing bar binding machine body described below, a claw (a ratchet mechanism) provided in the mounting chamber is engaged to a portion corresponding to the opposite side of the small projection 89. Since the small projection 89 is formed in almost the right-angled triangle, the reel 70 is rotated in a direction indicated by the angle formed between the inclined side and the adjacent side of the small projection 89. However, the rotation of the reel is regulated against a direction corresponding to the opposite side where the claw is engaged with the small projection 89.

The direction indicated by the angle formed between the inclined side and the adjacent side of the small projection 89 formed in almost the right-angled triangle is configured to be matched to a direction to which the wire wound on the reel 70 is pulled out (a direction of the leading end of the wire). In other words, the facing direction of the small projection 89 and the rotation direction of the reel 70 are configured to be equal. Therefore, when viewing the small projection 89, the direction of pulling the wire out (that is, the rotation direction of the reel 70) can be confirmed.

Since the reel 70 has similar functions as those of the reel 1 described above, the operation and the effect are also substantially equal.

For example, since the information display portions 79 and 82 are disposed on the surface 74*b* of the flange 74, much more information can be provided compared to a case where the information display portion is disposed inside the hub 73 having a limited area. Since the information display portions 79 and 82 are disposed on the different circumferences C1 and C2 of the surface 74*b* of the flange 74, the surface 74*b* of the flange 74 is effectively used, so that much more information can be provided.

The numbers and the positions of the protrusions 79*a* and 82*a* and the recesses 79*b* and 82*b* can be used as information for identifying the type of the wire.

The reel 70 is configured such that the first information display portion 79 and the second information display portion 82 are disposed not to be overlapped in the radial direction of the surface 74*b* of the flange 74. A range not overlapped between the end of the first information display portion 79 and the end of the second information display portion 82 (in other words, a range where the regions A and B are overlapped in FIG. 40) is large compared to that in the reel 1 described above. Therefore, the amount of information of the first information display portion and the second information display portion is the same as that of the reel 1. When the flange 74 is viewed from the lateral direction, the discrimination is easily made compared to the case of the reel 1 when the first information display portion 79 and the second information display portion 82 are visually confirmed discriminated at the same time. The information display portions 79 and 82 are formed to protrude from the surface 74*b* of the flange 74. Therefore, it is easy for the operator to visually confirm the shape (for example, the numbers and the positions of the protrusions 79*a* and 82*a* and the recesses 79*b* and 82*b*) of the information display portions 79 and 82 compared to a case where the information is installed inside the hub 73. In this way, the type of the wire is easily identified by a beholder.

In the reel 70 according to this embodiment, the information display portions 79 and 82 are disposed on the two circumferences C1 and C2. Such circumferences where the information display portions 79 and 82 are disposed may be provided two or more. In this case, much more information can be provided on the surface 74*b* of the flange 74. When the information display portions 79 and 82 are increased in the radial direction of the surface 74*b* of the flange 74, the entire strength of the flange 74 can be increased in proportion thereto. In other words, the increased information display portions (the information display portions other than the information display portions 79 and 82) also effectively serve as the reinforcing member of the flange 74.

In the reel 70 according to this embodiment, the first information display portion 79 and the second information display portion 82 are disposed on the different diameters and are arranged so as to not overlap in the radial direction. However, the first information display portion 79 and the second information display portion 82 may be partially overlapped as long as the protrusions 79*a* and 82*a* and the recesses 79*b* and 82*b* of the first and second information display portion 79 and 82 are able to be identified at the same time.

Therefore, there is a case where the entire first information display portion 79 is disposed in the region A (see FIG. 40) so as not to be overlapped at all with the second information display portion 82, and a case where the most of the first information display portion 79 is disposed in the region A and a part thereof may be overlapped with the second information display portion 82 by protrusion from the region A.

Similarly, there is a case where the entire second information display portion 82 is disposed in the region B (see FIG. 40) so as not to be overlapped at all with the first information display portion 79, and a case where most of the second information display portion 82 is disposed in the region B, and a part thereof may be overlapped with the first information display portion 79 by protrusion from the region B.

The first circumference C1 is positioned on the inner side by several mm from the outer peripheral edge of the flange 74 (the inner side in the radial direction toward the shaft center), but not necessarily limited thereto. For example, the first circumference may be positioned substantially on the outer peripheral edge of the flange 74. In this case, the first information display portion 79 comes to be disposed substantially along the outer peripheral edge of the surface 74*b* of the flange 74. However, when the first information display portion 79 is positioned on the inside from the outer peripheral edge of the flange 74 as described in this embodiment, the first information display portion 79 can be protected by the outer peripheral edge of the flange 74 even in a case where an impact is applied on the reel 70 during transportation or due to dropping for example.

The reel 70 described above is configured such that the first and second information display portions 79 and 82 can be visually confirmed to identify the type of the wire. The reel 70 is configured such that the first and second information display portions 79 and 82 can be visually confirmed from the lateral direction even in a stacked state. Therefore, the reel has a feature that the type of the wire is able to be identified even when being stacked.

The principal operations, effects, and features of the reel 70 according to this embodiment described above are similar to those of the respective embodiment described above.

Seventh Embodiment

Next, a reel 200 according to another embodiment will be described.

Figure 41:
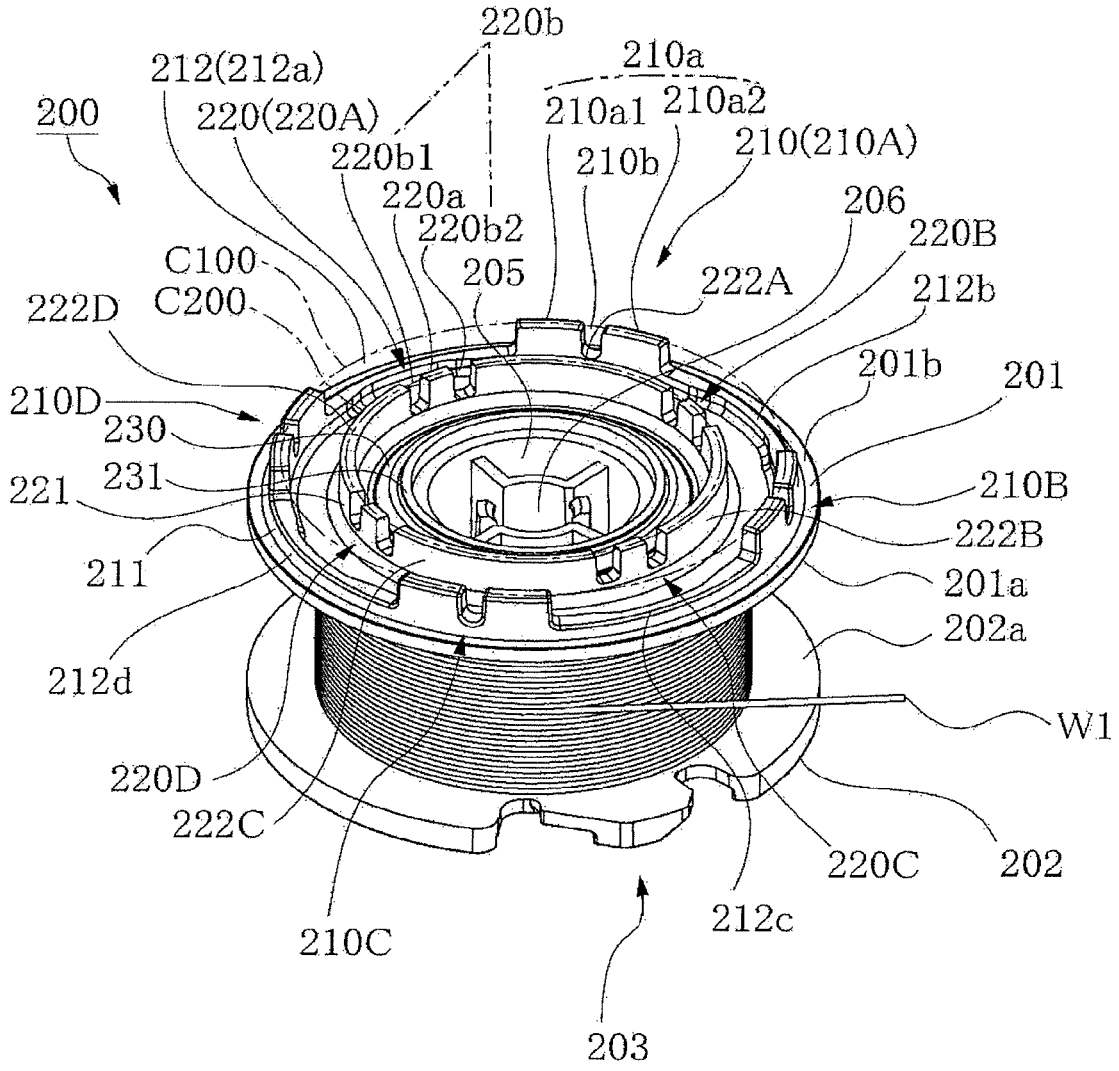
FIG. 41 is a perspective view of an external appearance of the reel wound with a single wire according to a seventh embodiment when viewed from one flange.
Figure 42:
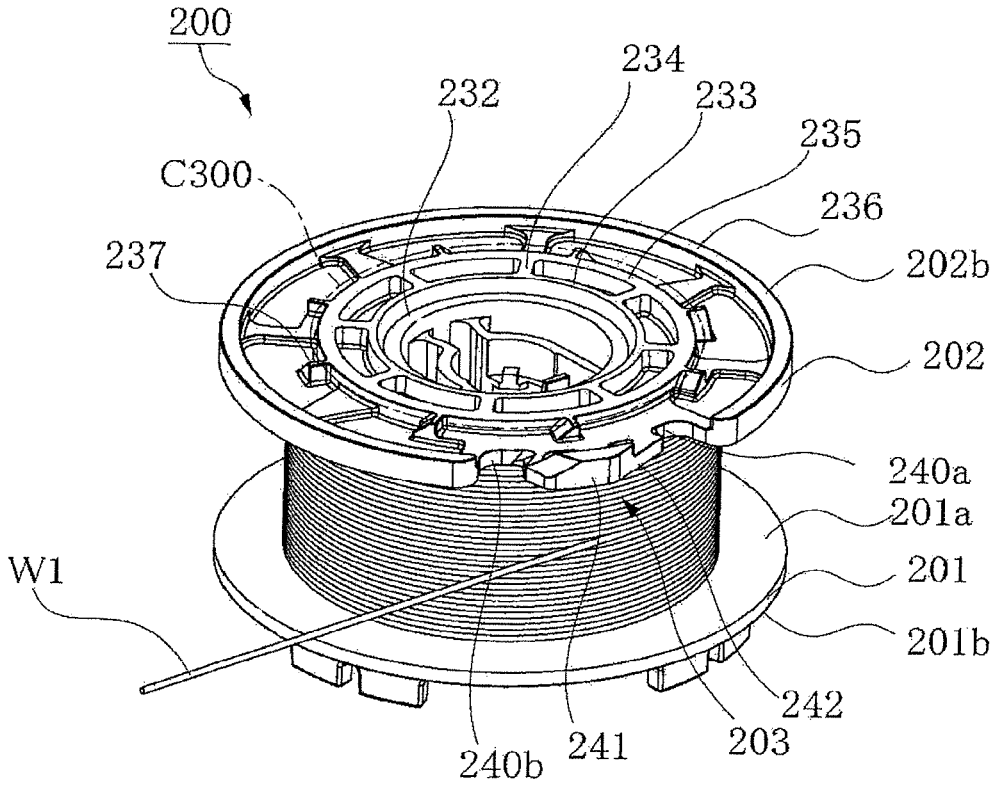
FIG. 42 is a perspective view of an external appearance of the reel wound with the single wire according to the seventh embodiment when viewed from the other flange.

FIG. 41 is a perspective view of an external appearance of the reel 200 wound with a single wire W1 when viewed from the flange 201. FIG. 42 is a perspective view of an external appearance of the reel 200 wound with the single wire W1 when viewed from the other flange 202.

Figure 43:
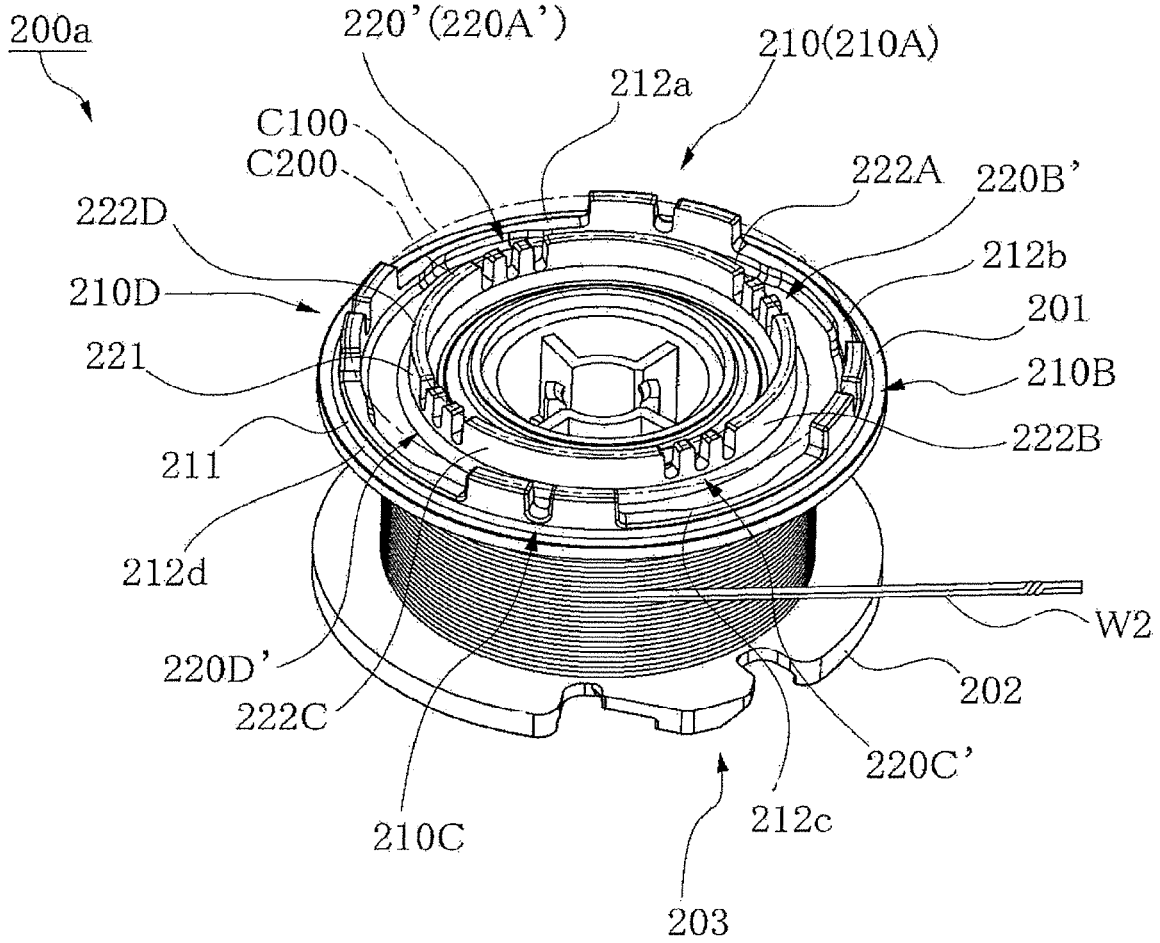
FIG. 43 is a perspective view of an external appearance of the reel wound with a double wire according to the seventh embodiment when viewed from one flange.

In addition, FIG. 43 is a perspective view of an external appearance of the reel 200*a* wound with a double wire W2 when viewed from the flange 201. The reel 200*a* illustrated in FIG. 43 has the same construction as that of the reel 200 except a second information display portion 220'(220A', 220B', 220C', and 220D').

Figure 45:
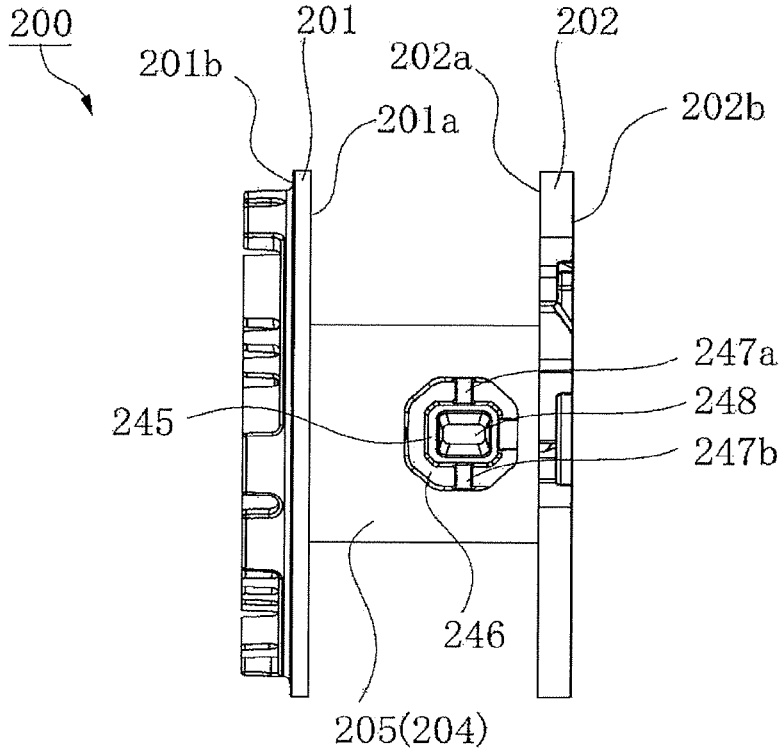
FIG. 45 is a side view of the reel according to the seventh embodiment.

The reel 200 includes a cylindrical hub 205 which includes a winding part 204 on which the wire illustrated in FIG. 45 is windable, and a pair of flanges 201 and 202 which include facing surfaces 201*a* and 202*a* facing each other with the winding part 204 interposed therebetween on both sides in the axial direction of the hub 205.

The hub 205 serving as the winding part 204 is configured such that the single wire W1 and the double wire W2 to pull out a plurality of single wires together are wound.

The hub 205 has a double cylinder structure, and includes a cylindrical through hole 206 formed therein concentrically to the hub 205. A frame to be described below is contained in the through hole 206 to fix a first winding part of the wire to the reel 200.

The basic structures, materials, modifications, and improvements of the reel 200 are similar to those of the above embodiments.

In the flange 201 of the flanges 201 and 202 disposed to face each other, a first information display portion 210 and a second information display portion 220 are formed in a surface 201*b* to identify the type of the wire.

The first information display portion 210 has the same shape as that of the sixth embodiment. Making an explanation again, the first information display portions 210 are disposed at an equal interval in four places 210A, 210B, 210C, and 210D in the drawing along a first circumference C100 about the shaft center of the hub 205.

The second information display portion 220 has a shape slightly different from that of the above embodiments. The second information display portion 220 are disposed at an equal interval in four places 220A, 220B, 220C, and 220D in the drawing along a second circumference C200 having a diameter smaller than that of the first circumference C100 (that is, positioned on the inner side of the first circumference C100.

The first information display portion 210 disposed at an equal interval in four places is configured by two protrusions 210*a* (210*a*1 and 210*a*2) which extend in the substantially vertical direction with respect to the surface 201*b* of the flange 201, and a recess 210*b* which is formed between the protrusion 210*a*1 and the protrusion 210*a*2.

In this embodiment, an annual rib 211 made of a low wall-shaped member is erected on the first circumference C100, and the first information display portion 210 is formed on (the upper surface) the annual rib 211. The protrusion 210*a* is made of a shielding body (plate) of a substantially rectangular shape which is not transmissive, and has a height (a height from the upper surface of the annual rib 211 to the apex of the protrusion 210*a*) and a thickness of several mm. Two protrusions 210*a*1 and 210*a*2 are formed in substantially the same shape.

Between one first information display portion 210 and the adjacent other first information display portion 210, gap portions 212 (212*a*, 212*b*, 212*c*, and 212*d*) are provided and serve as an opening when the flange 201 is viewed from a lateral direction (side), that is, when viewed from a direction orthogonal to the shaft center of the hub 205.

The depth of the gap portion 212 is formed substantially to be equal to the height of the protrusion 210*a*. In this embodiment, the protrusions 210*a* and the recesses 210*b* may be changed in shape as needed in a case where an information pattern for the identification of the wire is increased. For example, the widths of the protrusion 210*a* and the recess 210*b* in the circumferential direction may be different from each other. The heights of the protrusions 210*a* and the depths of the recesses 210*b* may be different from each other.

The protrusion 210*a* protrudes from the upper surface of the high annular rib 211 in the above example. The annular rib 211 has an annular bump portion (plate) configured by a continuous wall surface, and increases the strength of the flange 201 in order to prevent the deformation of the flange 201. The protrusion 210*a* may protrude from the surface 201*b* of the flange 201 without providing such an annular rib 211.

The second information display portion 220 is configured by two recesses (slits) 220*b*1 and 220*b*2 which are formed on both sides of a protrusion 220*a* extending in the substantially vertical direction with respect to the surface 201*b* of the flange 201.

In the case of the reel 200*a* illustrated in FIG. 43, the second information display portion 220 (220A', 220B', 220C', and 220D') is configured by three recesses with two protrusions interposed therebetween.

In this embodiment, an annual rib 221 made of a wall-shaped member is erected along the second circumference C200, and integrally formed with the second information display portion 220 by notching the upper surface of the annual rib 221.

The protrusion 220*a* is made of a shielding body (plate) of a substantially rectangular shape which is not transmissive, and has a height (a height from the bottom surface of the recesses 220*b*1 and 220*b*2 to the apex) and a thickness of several mm.

The portions other than the second information display portions 220A, 220B, 220C, and 220D of the annual rib 221 is configured by the shielding bodies 222A, 222B, 222C, and 222D which are not transmissive by the wall surface formed by the remaining annual rib 221.

Since the recesses 220*b*1 and 220*b*2 are formed in the second information display portion 220 by cutting the annular rib 221 from the upper surface in a slit shape, the upper surface of the protrusion 220*a* is configured to be substantially flush with the upper surface of the annular rib 221.

Further, the upper surface of the protrusion 210*a* formed in the upper surface of the annular rib 221 and the upper surface of the annular rib 211 are configured to be substantially flush with each other with respect to the surface 201*b* of the flange 201. Therefore, the heights of the protrusion 210*a* and the protrusion 220*a* are equal (the height of the annular rib 221).

The shapes of the annular ribs 211 and 221 are not limited to that in the embodiment.

The annular rib 221 is also an annular protrude portion (plate portion) configured by a continuous wall surface similarly to the annular rib 211, and formed integrally to the flange 201. Therefore, the annular rib 221 is formed together with the annular rib 211, so that the strength of the flange 201 can be increased still further.

On the surface 201*b* of the flange 201, there is formed an annular recess 230 which is a circular depressed portion in the center concentrically to the hub 205. Furthermore, an annular boss portion 231 is formed to surround the annular recess 230. The annular recess 230 and the boss portion 231 are rotatably supported by the reinforcing bar binding machine body, also serve as a reinforcing material of the flange 201, and operates to increase the strength of the reel 200 together with the annular ribs 211 and 221.

FIG. 42 illustrates a perspective view of the reel 200 when viewed from the flange 202 facing the flange 201 which is provided in the information display portion.

The flange 202 is formed in a disk shape. In the center of the surface 202*b*, there are provided an annular recess 232 which is a circular recess formed at a position corresponding to an outer circumferential portion of the hub 205 and concentrically to the hub 205, and an annular first protrusion rib 233 formed to surround the annular recess 232. There are provided a plurality of second protrusion ribs 234 radially extending to the outside in the radial direction from the first protrusion rib 233, and an annular third protrusion rib 235 which is connected to the second protrusion rib 234. Furthermore, an annual fourth protrusion rib 236 is provided along the outer peripheral edge of the surface of the flange 202.

The annual recess 232 and the first protrusion rib 233 serve as portions which are rotatably supported by the reinforcing bar binding machine body. With the first to fourth protrusion ribs 233, 234, 235, and 236, the strength of the flange 202 is increased so as to prevent the deformation.

In this embodiment, the annual protrusion ribs (233, 235, and 236) have been exemplified, and the number of annual protrusion ribs is not limited to the example. The rib may be provided in any other shape including a radially protruding rib (234) as long as the same function is exhibited.

On the surface 202*b* of the flange 202, eight small projections 237 are provided along a third circumference C300 formed concentrially to the hub 205 and has a saw-toothed shape formed in almost the right-angled triangle when the flange 202 is viewed from the lateral direction.

The small projection 237 is used to prevent the reel 200 from being reversely rotated. Specifically, when the reel 200 is housed in the mounting chamber 106 of the reinforcing bar binding machine body, a claw (a ratchet mechanism) provided in the mounting chamber is engaged to a portion corresponding to the opposite side of the small projection 237. Since the small projection 237 is formed in almost the right-angled triangle, the reel 200 is rotated in a direction indicated by the angle formed between the inclined side and the adjacent side of the small projection 237. However, the rotation of the reel is regulated against a direction corresponding to the opposite side where the claw is engaged with the small projection 237.

The direction indicated by the angle formed between the inclined side and the adjacent side of the small projection 237 formed in almost the right-angled triangle is configured to be matched to a direction to which the wire wound on the reel 200 is pulled out (a direction of the leading end of the wire). In other words, the facing direction of the small projection 237 and the rotation direction of the reel 200 are configured to be equal. Therefore, when viewing the small projection 237, the direction of pulling the wire out (that is, the rotation direction of the reel 200) can be confirmed.

Since the reel 200 has similar functions as those of the reel 1 described above, the operation and the effect are also substantially equal.

For example, since the information display portions 210 and 220 are disposed on the surface 201*b* of the flange 201, much more information can be provided compared to a case where the information display portion is disposed inside the hub 205 having a limited area. Since the information display portions 210 and 220 are disposed on the different circumferences C100 and C200 of the surface 201*b* of the flange 201, the surface 201*b* of the flange 201 is effectively used, so that much more information can be provided.

The numbers and the positions of the protrusions 210*a* and 220*a* and the recesses 210*b* and 220*b* can be used as information for identifying the type of the wire besides the material and the wire diameter of the wire such as the reel 200 on which the single wire W1 is wound by two recesses of the second information display portion 220 as illustrated in FIG. 41 and the reel 200*a* on which the double wire W2 is wound by three recesses of the second information display portion 220' as illustrated in FIG. 43. The information display portions 210 and 220 are formed to protrude from the surface 201*b* of the flange 201. Therefore, it is easy for the operator to visually confirm the shape (for example, the numbers and the positions of the protrusions 210*a* and 220*a* and the recesses 210*b* and 220*b*) of the information display portions 210 and 220 compared to a case where the information is installed inside the hub 205. In this way, the type of the wire is easily identified by a beholder.

In the reel 200 according to this embodiment, the information display portions 210 and 220 are disposed on the two circumferences C100 and C200. Such circumferences where the information display portions 210 and 220 are disposed may be provided two or more. In this case, much more information can be provided on the surface 201*b* of the flange 201. When the information display portions 210 and 220 are increased in the radial direction of the surface 201*b* of the flange 201, the entire strength of the flange 201 can be increased in proportion thereto. In other words, the increased information display portions (the information display portions other than the information display portions 210 and 220) also effectively serve as the reinforcing member of the flange 201.

The reel 200 described above is configured such that the first and second information display portions 210 and 220 can be visually confirmed to identify the type of the wire. The reel 200 is configured such that the first and second information display portions 210 and 220 can be visually confirmed from the lateral direction even in a stacked state. Therefore, the reel has a feature that the type of the wire is able to be identified even when being stacked.

The principal operations, effects, and features of the reel 200 according to this embodiment described above are identical or substantially identical to those of the above first to sixth embodiments.

Figure 44:
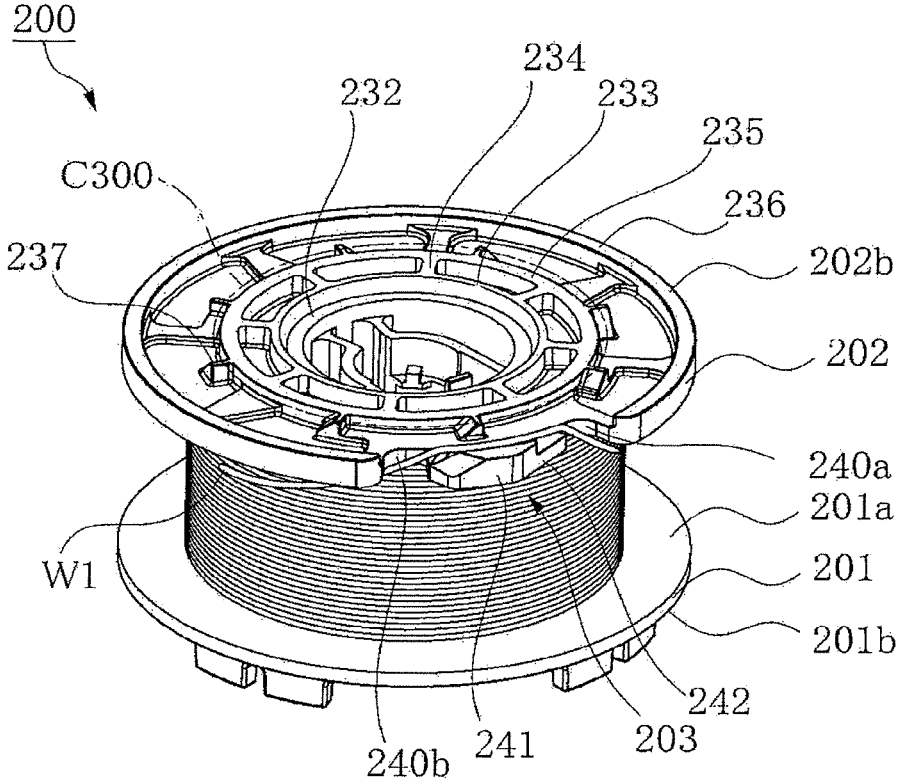
FIG. 44 is a perspective view of an external appearance according to the seventh embodiment in a state where the single wire is engaged with a wire hook.

FIG. 44 is a perspective view of an external appearance illustrating a state where the single wire W1 is engaged with a wire hook 203 formed in the flange 202.

The wire hook 203 is formed by a notch which is formed in the outer periphery of the flange 201 to fix the end of the winding wire W1.

The wire hook 203 is made of two depressed portions 240*a* and 240*b* formed to face the center from the peripheral edge of the flange 201, and a protruding piece 241 which is provided between the two depressed portions 240*a* and 240*b*. The end of the winding wire W1 passes to the depressed portion 240*a*, comes across the protruding piece 241, and then passes to the depressed portion 240*b* so as to be fixed.

In a portion of the protruding piece 241 near the depressed portion 240*a* to which the wire W1 firstly passes, an inclined surface 242 is provided in a direction from the center of the protruding piece 241 to the bottom of the depressed portion 240*a*. The inclined surface 242 has a function of introducing the wire W1 toward the depressed portion 240*a* when the wire W1 is wound to the depressed portion 240*a* while drawing the wire W1. With such an introduction of the inclined surface 242, the wire W1 can be fixed without causing the wire to be loosely wound around the hub 205.

FIG. 45 is an explanatory diagram of the reel 200 when viewed from the side surface. As illustrated in the drawing, a frame 245 is provided in the hub 205. The frame 245 is a member which holds the end of the wire W1 when the wire W1 starts to be wound around the hub 205.

The frame 245 is fixed in a space from an opening 246 provided in the cylindrical wall forming the hub 205 toward the center of the hub 205 through two connection portions 247*a* and 247*b*. The frame 245 includes a small hole 248 in the center through which the wire W1 is inserted, and the wire W1 is held to be pulled out when the end of the wire W1 is wound in a coil shape by another device after the wire W1 is inserted.

Figure 46:
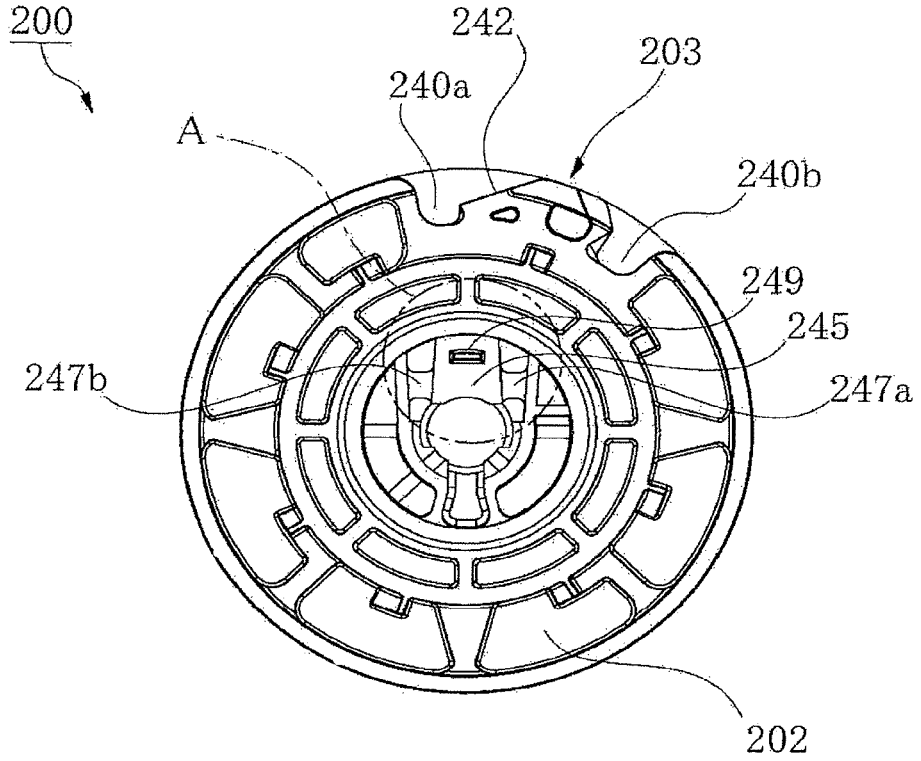
FIG. 46 is an explanatory diagram acording to the seventh embodiment illustrating a state where a frame is fixed when viewed from a flange 202.
Figure 47:
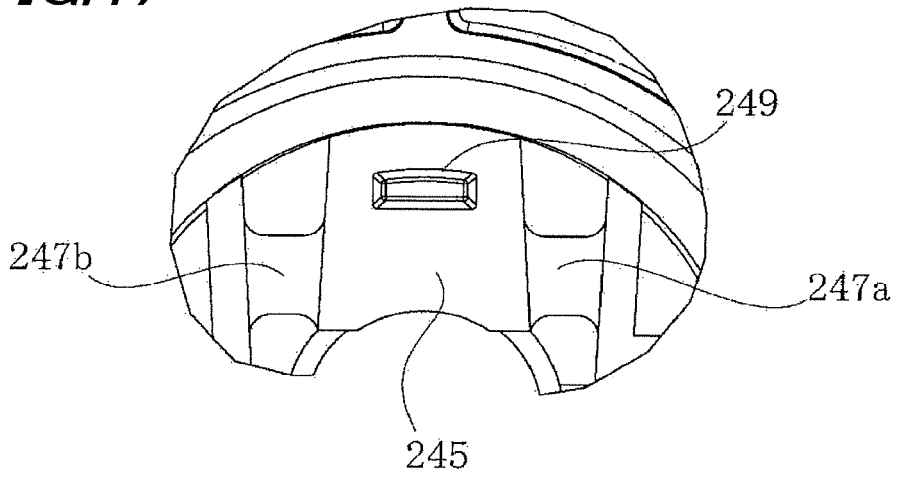
FIG. 47 is an enlarged view of the frame illustrated in FIG. 46.

FIG. 46 is a diagram illustrating the reel 200 in a state where the frame 245 is fixed to the hub 205 when viewed from the flange 202, and FIG. 47 is an enlarged view of portion A illustrated in FIG. 46.

After the wire W1 is wound around the hub 205, the connection portions 247*a* and 247*b* is cut by the other device.

Figure 48:
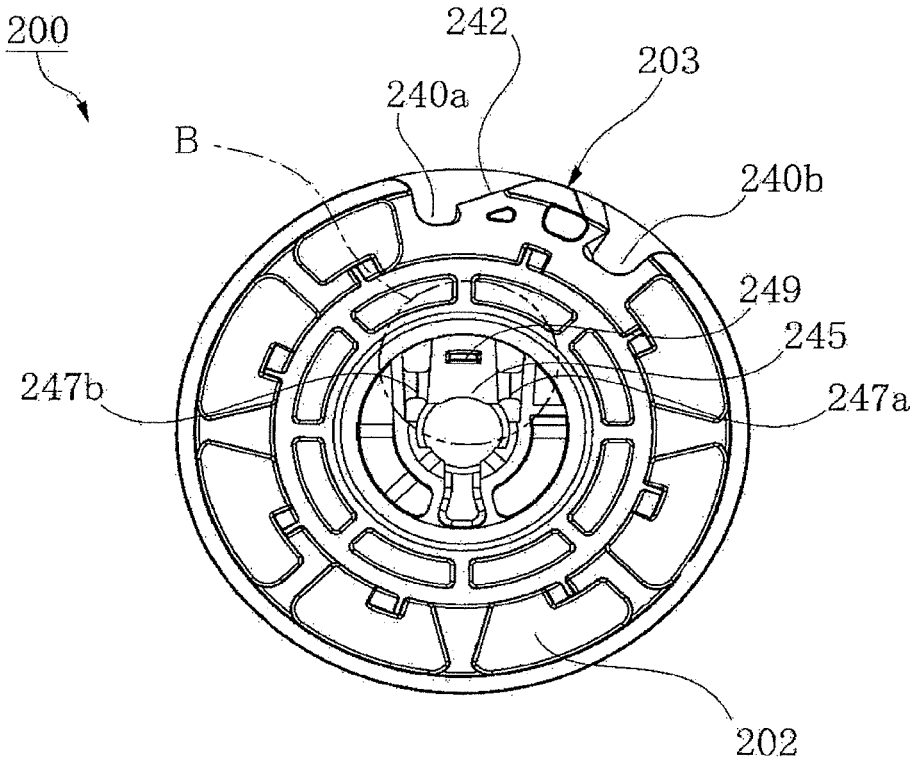
FIG. 48 is an explanatory diagram according to the seventh embodiment illustrating a state where a joint portion fixing the frame is cut when viewed from the flange 202.
Figure 49:
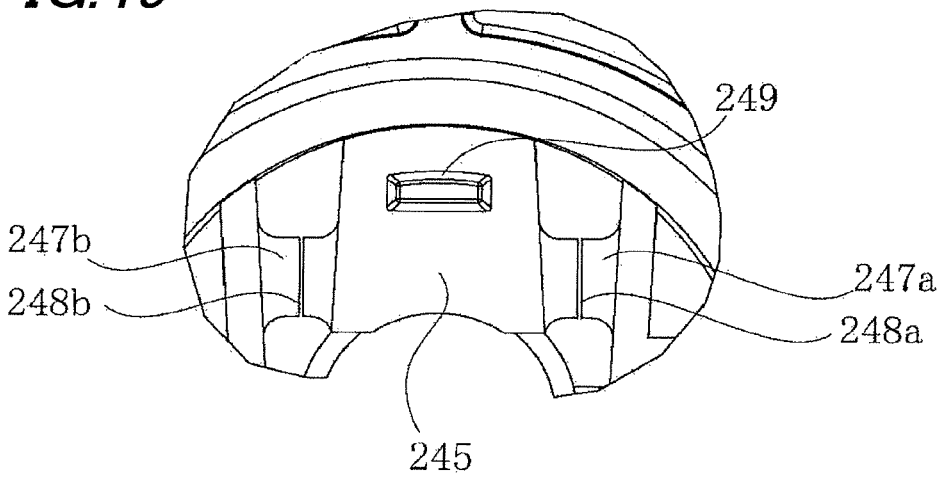
FIG. 49 is an enlarged view of the frame illustrated in FIG. 48.

FIG. 48 illustrates the reel 200 in a state where the connection portions 247*a* and 247*b* are cut when viewed from the flange 202, and FIG. 49 illustrates an enlarged view of portion B illustrated in FIG. 47.

The connection portions 247*a* and 247*b* is separated from the hub 205 by cut portions 248*a* and 248*b*. The frame 245 of which the connection portions 247*a* and 247*b* are cut enters a state of being held by the wire W1 wound around the hub 205, and remains in the hub 205 until all the wound wire W1 is pulled out.

In a case where the wire W1 wound in a binding machine is used up, the frame 245 is also pulled out in a direction of pulling out the wire when the wire W1 is pulled out by the binding machine. At this time, the frame 245 is also pulled by the wire W1 and separated from the reel 200. However, a protruding piece 249 formed in the frame 245 is pulled to the inner peripheral edge of the opening 246, and the separation of the frame 245 is temporally hindered.

Figure 50:
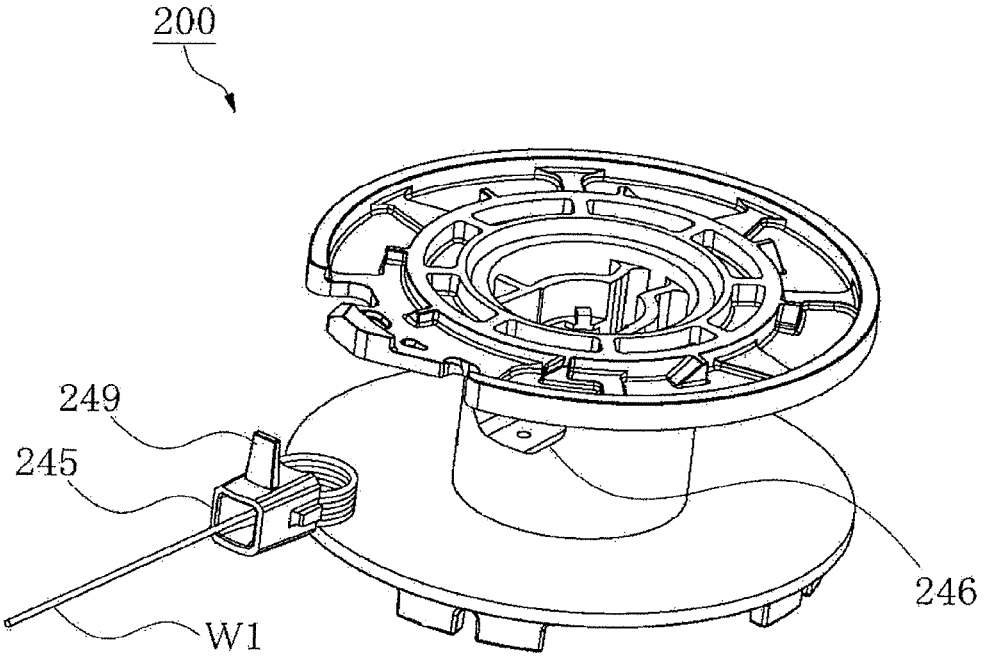
FIG. 50 is an explanatory diagram according to the seventh embodiment illustrating a state where the frame is removed from the reel.
Figure 51:
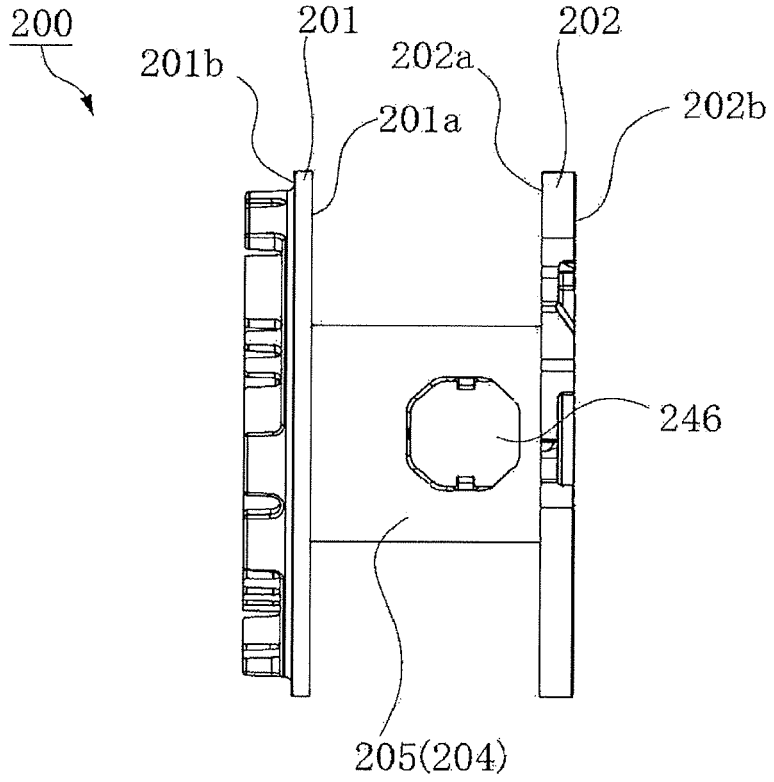
FIG. 51 is a side view of the reel according to the seventh embodiment in a state where the frame is removed.

On the other hand, when the posture of the frame 245 is adjusted, the frame 245 can be removed from the opening 246 as illustrated in FIG. 50. In the reel 200 after removing the frame 245, the opening 246 from which the frame 245 is removed is left in the side surface of the hub 205 as illustrated in FIG. 51.

As described above, the frame 245 is configured to be removed in order to separate the reels 200 and 200*a* and the metal wires W1 and W2. Through such a separation, the resin members and the metal-containing members can be disposed separately.

The principal operations, effects, and features of the reels 200 and 200*a* according to this embodiment described above are similar to those of the respective embodiments described above.

In the first to seventh embodiments described above, the light transmissive recesses 9*b*, 12*b*, 79*b*, 82*b*, 210*b*, 210, and 220*b* and the light transmissive circular holes 61*b* and 63*b* of the first and second information display portions 9, 12, 79, 82, 210, and 220 in the respective embodiments are formed as spaces to provide light transmissive portions. However, the subject space may also be formed as a light-transmitting body (for example, a transparent member or a semitransparent member) formed of a light-transmitting material to provide light transmissive portions. Herein, the light-transmitting material includes a plastic or a film. The plastic may be provided by being fitted or inserted, or the film may be provided by being attached. The annular wall erected on the first and second circumferences C1, C2, C100, and C200 may be configured by a light-transmitting material. The portions (the wall surfaces or wall sections) corresponding to the convex portion and the shielding bodies (or light blocking) 9*a*, 12*a*, 79*a*, 82*a*, and 210*a* may be configured by attaching a light-blocking shielding body or by coating a shielding member. In a case where the recesses 9*b*, 12*b*, 79*b*, 82*b*, 210*b*, 220*b*1, and 220*b*2 and the circular holes 61*b* and 63*b* formed in the annular ribs (or walls) 25, 26, 95, 96, 211, and 221 and the annular walls 62 and 64 are filled with a transparent member or a semitransparent member, the strength of the annular ribs 25, 26, 95, 96, 211, and 221 and the annular walls 62 and 64 can be increased. Therefore, the strength of the flange 4 can be increased.

In the first to seventh embodiments, the first and second information display portions 9,12,79, and 82 are configured by the protrusions 9*a*, 12*a*, 79*a*, 82*a*, 210*a*, and 220*a* and the recesses 9*b*, 12*b*, 79*b*, and 82*b* or the walls 61*a* and 63*a* and the circular holes 61*b* and 63*b*. The shapes of the first and second information display portions 9, 12, 79, and 82 are not limited to the above shapes as long as the type of the wire can be identified.

The respective embodiments may be implemented in various combinations. The invention is not limited to the above embodiments, and various changes in design can be made within a scope not departing from the claims.

Some or all of the embodiments may be described as the following notes.

(Additional Note 1)

A reel comprising:

a cylindrical hub that includes a winding part where a wire is windable;

first and second flanges that are spaced in an axial direction along the hub and that include facing surfaces with the winding part interposed therebetween;

a plurality of first information display portions that are formed on a surface opposite to the facing surface of the first flange and that are disposed on a first circumference radially spaced from a shaft center of the hub; and a second information display portion that is formed on the surface of the first flange and that is disposed on a second circumference having a diameter smaller than that of the first circumference about the shaft center of the hub, wherein the second information display portion is offset in a circumferential direction from each of said plurality of first information display portions such that at least part of said second information display portion is positioned so that a radial line extending from said shaft center and through said at least part of said second information display portion does not extend through any of said plurality of first information display portions.

(Addition Note 2)

The reel according to (Addition Note 1), wherein a plurality of second information display portions are disposed on the second circumference, and wherein each of said plurality of second information display portions is offset in the circumferential direction with respect to a nearest one of said plurality of first information display portions.

(Addition Note 3)

The reel of (Addition Note 2), wherein each of said plurality of first information display portions protrudes from the surface of the first flange; and wherein each of the plurality of second information display portions protrudes from the surface of said flange.

(Addition Note 4)

The reel of (Addition Note 3), wherein each of the plurality of first information display portions includes at least one light blocking part and at least one light transmissive part; and wherein each of said second information display portions includes at least one light blocking part and at least one light transmissive part.

(Addition Note 5)

The reel of (Addition Note 4), wherein the at least one light blocking part of each of said first and second information display portions includes at least two projections projecting in a direction axially away from said surface, and wherein the at least one transmissive part of each of said first and second information display portions includes a recess between said at least two projections.

(Addition Note 6)

The reel of (Addition Note 4), wherein a rib extends along at least one of said first circumference and said second circumference, and wherein a corresponding one of said plurality of first information display portions or said plurality of second information display portions extends from said rib in said axial direction.

(Addition Note 7)

The reel of (Addition Note 4), wherein the plurality of first information display portions includes a plurality of first wall portions each having at least one first aperture extending therethrough; and wherein the plurality of second information display portions includes a plurality of second wall portions each having at least one second aperture extending therethrough.

(Addition Note 8)

The reel of (Addition Note 7), wherein the first wall portions are part of a wall extending along the first circumference, and wherein a plurality of elongated apertures are provided at circumferential locations between adjacent first information display portions, said elongated apertures having a size larger than said at least one first aperture, and wherein said second information display portions are visible through said elongated apertures.

(Addition Note 9)

The reel of (Addition Note 1), wherein each first information display portion includes at least two first projections and a first recess positioned between adjacent first projections;

wherein the second information display portion includes at least two second projections and a second recess between adjacent second projections;

the reel further including wire wound around the winding part; and wherein the first projections and the second projections project in an axial direction away from the surface of the first flange.

(Addition Note 10)

A plurality of reels of (Addition Note 9), wherein each reel is configured to be stackable with other reels of the plurality of reels, and wherein in a stacked position of the plurality of reels the second information display portion of each reel is visible from a lateral direction orthogonal to axes of said reels.

(Addition Note 11)

A reel comprising:

a hub that includes a winding part upon which a wire is windable;

first and second flanges that are spaced in an axial direction along the hub and that include facing surfaces with the winding part interposed therebetween;

a first information display portion protruding from a surface opposite the facing surface of the first flange, wherein the first information display portion is positioned on a first circumference radially spaced from a shaft center of the hub;

a second information display portion protruding from the surface of the first flange and that is disposed on a second circumference having a diameter smaller than said first circumference;

wherein with respect to a circle defined by said first circumference the first information display portion is positioned in a first sector of said circle, and at least part of said second information display portion is positioned in a second sector of said circle, wherein the second sector of said circle is adjacent to and does not overlap with said first sector of said circle.

(Addition Note 12)

The reel of (Addition Note 11), wherein said second information display portion is entirely positioned with said second sector.

(Addition Note 13)

The reel of (Addition Note 11), wherein a plurality of first information display portions are respectively positioned within a plurality of first sectors of said circle, and a plurality of second information display portions are at least partially positioned within a plurality of second sectors of said circle, and wherein said first sectors and said second sectors are alternatingly arranged about said first circumference.

(Addition Note 14)

The reel of (Addition Note 13), wherein each of said first information display portions includes a light blocking portion and a light transmissive portion; and wherein each of said second information display portions includes a light blocking portion end a light transmissive portion.

(Addition Note 15)

The reel of (Addition Note 14), wherein a wall extends along said first circumference, and wherein the first information display portions each include a section of said wall and at least one aperture extending through said section of said wall, and wherein an elongated aperture extends through said wall in each of said second sectors.

(Addition Note 16)

The reel of (Addition Note 14), wherein each of said first information display portions includes at least two projections and a recess between adjacent projections, wherein the projections provide light blocking portions and the recess provides a light transmissive portion.

(Addition Note 17)

The reel of (Addition Note 11), wherein the first information display portion comprises:

a first wall section having at least one first aperture extending therethrough; or at least two first projections having a first recess between adjacent first projections;

wherein the second information display portion comprises:

a second wall section having at least one second aperture extending therethrough; or at least two second projections having a second recess between adjacent second projections.

(Addition Note 18)

The reel of (Addition Note 11), wherein the first information display portion includes at least two first projections and a first recess between said at least two first projections; and wherein the second information display portion includes at least two second projections and a second recess between said at least two second projections, and wherein said at least two second projections are located within said second sector.

(Addition Note 19)

The reel of (Addition Note 18), further including wire wound around said winding part.

(Addition Note 20)

A plurality of reels of (Addition Note 19), wherein each reel is configured to be stackable with other reels of the plurality of reels, and wherein in a stacked position of the plurality of reels the second information display portion of each reel is visible from a lateral direction orthogonal to axes of said reels.

INDUSTRIAL APPLICABILITY

The invention is applicable to a reel for a wire used in a reinforcement binding machine.

This application is based upon and claims the benefit of priority from Japanese Patent Application No. 2015-145259 filed on Jul. 22, 2015 and Japanese Patent Application No. 2016-135746 filed on Jul. 8, 2016, the entire contents of which are incorporated herein by reference.

REFERENCE SIGNS LIST

1: reel
2: winding part
3: hub
4: flange
5: flange
9: information display portion (first information display portion)
9*a*: protrusion
9*b*: recess
10: gap portion
12: information display portion (second information display portion)
12*a*: protrusion
12*b*: recess
13: shielding body
15: cylindrical portion
16: teeth
17: boss portion
18: annual recess
19: small projection
20: annual recess
21: first protrusion rib
22: second protrusion rib
23: third protrusion rib
24: hole
25: annual rib
26: annual rib
62: annual wall
64: annual wall
100: wire supply body
102: reinforcing bar binding machine
30: reel
31: information display unit (first information display portion)
31*a*: protrusion
31*b*: recess
32: gap portion
33: information display portion (second information display portion)
33*a*: protrusion
33*b*: recess
130: wire supply body
40: reel
41: information display portion (first information display portion)
41*a*: protrusion
41*b*: recess
42: gap portion
43: information display portion (second information display portion)
43*a*: protrusion
43*b*: recess
140: wire supply body
50: reel
51: information display portion (first information display portion)
51*a*: protrusion
51*b*: recess
52: gap portion
53: information display portion (second information display portion)
53*a*: protrusion
53*b*: recess
150: wire supply body
60: reel
61: information display portion (first information display portion)
61*a*: wall surface portion (protrusion)
61*b*: circular hole (recess (hole))
62*a*: long hole (opening)
63: information display portion (second information display portion)
63*a*: wall surface portion (protrusion)
63*b*: circular hole (recess (hole))
160: wire supply body

What is claimed is:

1. A reel comprising:

a hub that includes a winding part upon which a wire is windable;

first and second flanges that are spaced in an axial direction along the hub and that include facing surfaces with the winding part interposed therebetween;

a first information display portion protruding from a surface opposite the facing surface of the first flange, wherein the first information display portion is positioned on a first circumference radially spaced from a shaft center of the hub;

a second information display portion protruding from the surface of the first flange and that is disposed on a second circumference having a diameter smaller than said first circumference;

wherein with respect to a circle defined by said first circumference the first information display portion is positioned in a first sector of said circle, and at least part of said second information display portion is positioned in a second sector of said circle, wherein the second sector of said circle is adjacent to and does not overlap with said first sector of said circle such that the first information display portion is circumferentially offset from said second information display portion.

2. The reel of claim 1, wherein said second information display portion is entirely positioned within said second sector.

3. The reel of claim 1, wherein a plurality of first information display portions are respectively positioned within a plurality of first sectors of said circle, and a plurality of second information display portions are at least partially positioned within a plurality of second sectors of said circle, and wherein said first sectors and said second sectors are alternatingly arranged about said first circumference.

4. The reel of claim 3, wherein each of said first information display portions includes a light blocking portion and a light transmissive portion; and wherein each of said second information display portions includes a light blocking portion and a light transmissive portion.

5. The reel of claim 4, wherein a wall extends along said first circumference, and wherein the first information display portions each include a section of said wall forming the light blocking portion, and at least one aperture extending through said section of said wall forming the light transmissive portion, and wherein an elongated aperture extends through said wall in each of said second sectors.

6. The reel of claim 4, wherein each of said first information display portions includes two of said light blocking portions formed by at least two projections, and the light transmissive portion includes a recess between adjacent projections.

7. The reel of claim 1, wherein the first information display portion comprises:

a first wall section having at least one first aperture extending therethrough; or at least two first projections having a first recess between adjacent first projections;

wherein the second information display portion comprises:

a second wall section having at least one second aperture extending therethrough; or at least two second projections having a second recess between adjacent second projections.

8. The reel of claim 1, wherein the first information display portion includes at least two first projections and a first recess between said at least two first projections; and wherein the second information display portion includes at least two second projections and a second recess between said at least two second projections, and wherein said at least two second projections are located within said second sector.

9. The reel of claim 8, further including wire wound around said winding part.

10. A plurality of reels of claim 9, wherein each reel is configured to be stackable with other reels of the plurality of reels, and wherein in a stacked position of the plurality of reels the second information display portion of each reel is visible from a lateral direction orthogonal to axes of said reels.

11. The reel of claim 1, wherein said information display portion is entirely positioned within said second sector and no portion of the first information display portion is positioned within said second sector.

12. The reel of claim 1, wherein a radial line extending through one of said first information display portion or said second information display portion does not extend through the other of said first information display portion or the second information display portion.

13. The reel of claim 1, wherein a wall extends along the first circumference and portions of the wall in the first sector are configured to form the first information display portion, and wherein the wall includes an elongated opening in the second sector through which the second information display portion of the second circumference is visible.

14. The reel of claim 13, wherein the first information display portion includes at least one aperture or recess having a size smaller than the elongated aperture.

* * * * *